US005580713A

United States Patent [19]

Hara et al.

[11] Patent Number: 5,580,713

[45] Date of Patent: Dec. 3, 1996

[54] SILVER HALIDE COLOR REVERSAL PHOTOGRAPHIC LIGHT-SENSITIVE MATERIAL

[75] Inventors: Takefumi Hara; Makoto Kikuchi; Hisashi Okamura, all of Minami-Ashigara, Japan

[73] Assignee: Fuji Photo Film Co., Ltd., Kanagawa, Japan

[21] Appl. No.: 376,446

[22] Filed: Jan. 23, 1995

Related U.S. Application Data

[63] Continuation of Ser. No. 139,650, Oct. 22, 1993, abandoned.

[30] Foreign Application Priority Data

Oct. 23, 1992 [JP] Japan ..... 4-307855

[51] Int. Cl.[6] ..... G03C 1/06

[52] U.S. Cl. ..... 430/607; 430/611; 430/613; 430/567; 430/569; 430/504; 430/362

[58] Field of Search ..... 430/504, 505, 430/362, 607, 611, 613, 567, 569

[56] References Cited

U.S. PATENT DOCUMENTS 4,720,451 1/1988 Shuto et al. ..... 430/613
5,418,124 5/1995 Suga et al. ..... 430/567

FOREIGN PATENT DOCUMENTS 268538 3/1990 Japan .

*Primary Examiner*—Geraldine Letscher
*Attorney, Agent, or Firm*—Sughrue, Mion, Zinn, Macpeak & Seas

[57] ABSTRACT

A silver halide color reversal photographic light-sensitive material includes at least one blue-sensitive silver halide emulsion layer, at least one green-sensitive silver halide emulsion layer, and at least one red-sensitive silver halide emulsion layer, formed on a support. At least one light sensitive emulsion layer contains silver halide grains having a silver halide phase formed in the presence of an iodide ion-releasing agent, under controlled release of iodide ions from the releasing agent. At least one hydrophilic colloid layer contains a certain heterocyclic compound or a certain DIR compound.

13 Claims, No Drawings

SILVER HALIDE COLOR REVERSAL PHOTOGRAPHIC LIGHT-SENSITIVE MATERIAL

This is a continuation of application No. 08/139,650 filed Oct. 22, 1993, now abandoned.

BACKGROUND OF THE INVENTION

1. Field of the Invention

The present invention relates to a silver halide photographic light-sensitive material, and more particularly a silver halide color reversal photographic light-sensitive material which exhibits great interimage effect and small dependency on the changes in developing process factors.

2. Description of the Related Art

It is demanded of color reversal photographic light-sensitive materials to achieve good photographic properties. Demand for image quality is particularly great as compared with other photographic properties. Main items determining image quality are graininess, sharpness, and color reproduction. Of these items, sharpness and color reproduction may be improved by the technique of enhancing interimage effect, which has hitherto been studied.

Interimage effect is described in, for example, Hanson et al. "Journal of the Optical Society of America," Vol. 42, pp. 663–669, and A. Thiels, "Zeitschrift fuer Wissenschaftliche photographie, Photophysique and Photochemie," vol. 47, pp. 106–118 and pp. 246–255.

Known as methods of enhancing interimage effect are as follows:

U.S. Pat. No. 3,536,486 discloses a method of introducing diffusible 4-thiazoline-2-thione into exposed color reversal photographic element, in order to attain desirable interimage effect. Also, U.S. Pat. No. 3,536,487 discloses a method of introducing diffusible 4-thiazoline-2-thione into unexposed color reversal photographic element, for the same purpose.

Further, JP-B-48-34169 describes that marked interimage effect results by making an N-substituted-4-thiazoline-2-thione compound present when the color photographic light-sensitive material is developed to reduce silver halide. ("JP-B" means Published Examined Japanese Patent Application.)

The technique of forming a colloidal siver-containing layer between the cyan and magenta layers of a color reversal photographic element, thereby to obtain desirable interimage effect is described in Research Disclosure No. 131, pp. 13116 (1975).

U.S. Pat. No. 4,082,553 discloses a method of attaining desirable interimage effect in a color reversal light-sensitive material of an arrangement in which iodine ions can move while the material is being developed. In this method, silver iodide grains which form latent images are contained in one of the layers of the material, and silver iodide grains which forms latent images and silver halide grains which are surface-fogged to be developed regardless of image exposure are contained in another of the layers of the material.

Moreover, JP-A-62-11854 discloses the technique of enhancing interimage effect by using 5-mercapto-1,3,4-thiazole compounds. ("JP-A" means Published Unexamined Japanese Patent Application.)

As for color negative film, a method in which so-called DIR couplers are used is known. This is the technique wherein couplers release development inhibitors as dyes are formed during color development, and the concentration difference between the development inhibitors results in interimage effect, thereby to improve sharpness. Although applicable to color light-sensitive materials (e.g., color negative film and color paper), the method cannot be expected to achieve interimage effect in black-and-white photographic materials or color light-sensitive materials (e.g., color reversal film and color reversal paper), in which main image-forming process is effected during black-and-white development. This is because the method achieves the effect during color development only.

Known as a technique of obtaining interimage effect during black-and-white development is to use a DIR-hydroquinone which releases a development inhibitor through the development. (See U.S. Pat. Nos. 3,364,022 and 3,379,529, JP-A-50-62435, JP-A-50-133833, JP-A-51-51941, JP-A-50-119631, JP-A-52-57828, JP-A-62-103639, and JP-A-62-251746.)

JP-A-64-546 describes a image-forming method, in which a silver halide photographic light-sensitive material having a hydrophilic colloid layer containing no silver halide and a DIR-hydroquinone is subjected to treatment including a black-and-white development step, thereby improving sharpness and graininess.

The methods described above, wherein mercapto compounds, triazole compounds, benzothiazolium compounds, or DIR-hydroquinones are used to enhance interimage effect, are disadvantageous in view of an increased dependency on the changes in developing process factors.

The term "changes in developing process factors" are mainly the changes in the composition of the first development solution (i.e., black-and-white development solution) in the color reversal treatment. These changes may also include those in temperature and in stirring conditions. The composition mainly changes due to the changes in the amount of materials processed, and those in controlling conditions of the development facility (e.g., quantity of replenisher and evaporated amount of process solutions). More specific examples are the changes in the pH of the first development solution, the amount of potassium bromide contained in the solution, and the amount of potassium thiocyanate contained in the solution.

If the dependency on the changes in developing process factors is great, it will be difficult to form images of constant quality always. Accordingly it has been demanded that light-sensitive materials be provided which exhibit enhanced interimage effect and which are yet hardly affected by such changes in developing process factors.

SUMMARY OF THE INVENTION

An object of the present invention is to provide a color reversal photographic light-sensitive material which exhibits great interimage effect and small dependency on the changes in developing process factors.

The above object and other objects which will become apparent from the following detailed description are achieved according to one aspect of the present invention by a silver halide color reversal photographic light-sensitive material comprising at least one blue-sensitive silver halide emulsion layer, at least one green-sensitive silver halide emulsion layer, and at least one red-sensitive silver halide emulsion layer, formed on a support, wherein at least one light sensitive emulsion layer contains silver halide grains having a silver halide phase formed in the presence of an iodide ion-releasing agent, under controlled release of iodide ions from the releasing agent, and at least one hydrophilic colloid layer contains at least one compound selected from the group consisting of the compounds represented by the following formulas (I-I), (I-II) and (I-III):

Formula (I-I)

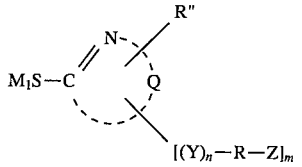

where $M_1$ represents a hydrogen atom, a cation, or a protective group for the mercapto group, which is split off by an alkali; Q represents an atomic group required to form a 5- or 6-membered heterocyclic ring, together with —C═N—; R represents a straight-chain or branched-chain alkylene group, a straight-chain or branched-chain alkenylene group, a straight-chain or branched-chain aralkylene group, or an arylene group; Z represents a polar substituent; Y represents a divalent group; R" represents a hydrogen atom or a substituent thereof; n represents 0 or 1; and m represents 0, 1 or 2;

Formula (I-II)

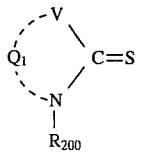

where $R_{200}$ represents a substituted or unsubstituted alkyl, aralkyl, alkenyl, aryl or heterocyclic group; V represents O, S, Se, or $NR_{201}$ wherein $R_{201}$ represents an alkyl group, an aralkyl group, an alkenyl group, an aryl group, or a heterocyclic group, and may be the same as, or different from, $R_{200}$; $Q_1$ represents an atomic group required to form a 5- or 6-membered heterocyclic ring, together with V, C and N, and the heterocyclic ring may be further fused;

Formula (I-III)

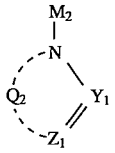

where each of $Y_1$ and $Z_1$ independently represents methine, a substituted methine, or a nitrogen atom; $Q_2$ represents an atomic group required to form a 5- or 6-membered heterocyclic ring, together with N, $Y_1$ and $Z_1$, and the heterocyclic ring may be further fused; and $M_2$ represents a hydrogen atom, or a cation such as an alkali metal cation or an ammonium ion.

According to a second aspect of the present invention, there is provided a silver halide color reversal photographic light-sensitive material comprising at least one blue-sensitive silver halide emulsion layer, at least one green-sensitive silver halide emulsion layer, and at least one red-sensitive silver halide emulsion layer, formed on a support, wherein at least one light sensitive emulsion layer contains silver halide grains having a silver halide phase formed in the presence of an iodide ion-releasing agent, under controlled release of iodide ions from the releasing agent, and at least one hydrophilic colloid layer contains at least one compound represented by the following formula (III-I):

Formula (III-I) $A—(L)_j—(G)_k—(Time)_t—DI$ where A represents a redox nucleus or a precursor thereof, and is an atomic group which allows $—(L)_j—(G)_k—(Time)_t—DI$ to split off upon oxidation during development; Time represents a group which allows DI to split off after released from a oxidized form of A; DI represents a development inhibitor residue; L represents a divalent linking group; G represents a polarizable group, and each of j, k, and t represents 0 or 1.

The iodide ion-releasing agent used in the present invention is preferably represented by the following formula (II-I):

Formula (II-I)

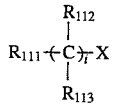

where X represents an iodine atom; each of $R_{111}$, $R_{112}$ and $R_{113}$ represents a hydrogen atom or a substituent thereof, and may be combined together to form a carbocyclic or heterocyclic ring; and i represents an integer of 1 to 5.

DETAILED DESCRIPTION OF THE PREFERRED EMBODIMENTS

The present invention will be described in detail, as follows.

In the silver halide color reversal photographic light-sensitive material, at least one hydrophilic colloid layer contains at least one of the compounds represented by the formulas (I-I), (I-II), and (I-III).

The formula (I-I) will be explained in more detail.

In the formula (I-I), $M_1$ represents a hydrogen atom, a cation, or a protective group of the mercapto group which is cleaved by an alkali, and Q represents an atomic group required to forme a 5- or 6-membered heterocyclic ring, jointly with —C═N—. The heterocyclic ring may have a substituent group or may be fused. To state more specifically, $M_1$ is a hydrogen atom, an cation (e.g., sodium ion, potassium ion, ammonium ion), or a protective group of the mercapto group (e.g., —COR', —COOR', or $—CH_2CH_2COR'$, where R' is, for example, a hydrogen atom, an alkyl group, an aralkyl group, or an aryl group) which is cleaved by an alkali.

The heterocyclic ring, which Q forms, contains a heteroatom such as a sulfur atom, a selenium atom, a nitrogen atom, or an oxygen atom, and may be fused. Examples of the 5- or 6-membered heterocyclic ring are: tetrazole, triazole, imidazole, oxazole, thiadiazole, pyridine, pyrimidine, triazine, azabenzimidazole, purine, tetrazaindene, triazaindene, pentazaindene, benzotriazole, benzimidazole, benzoxazole, benzothiazole, benzoselenazole, and naphthoimidazole rings.

R represents a straight or branched alkylene group, a straight or branched alkenylene group, a straight or branched aralkylene group, or an arylene group. Y represents —S—, —O—, $—(R_1)N—$, $—CO—N(R_2)—$, $—(R_3)N—CO—$, $—SO_2N(R_4)—$, $—(R_5)NSO_2—$, —COO—, —OCO—, —CO—, $—(R_6)NCON(R_7)—$, $—(R_8)N—C(═S)—N(R_9)—$, or $—(R_{10})N—COO—$, wherein $R_1$, $R_2$, $R_3$, $R_4$, $R_5$, $R_6$, $R_7$, $R_8$, $R_9$, and $R_{10}$ are each a hydrogen atom, or a substituted or unsubstituted alkyl, aryl, alkenyl or aralkyl group.

R" represents a hydrogen atom or a substituent, n represents 0 or 1, and m represents 0, 1 or 2.

The polar substituent represented by Z may be, for example, a substituted or unsubstituted amino group, a quaternary ammonium group, an alkoxy group, an aryloxy group, an alkylthio group, an arylthio group, a sulfonyl group, a carbamoyl group, a sufamoyl group, a ureido group, a thioureido group, a heterocyclic group, or a hydroxy group.
Of the compounds represented by the formula (I-I), the listed below are preferable. Nonetheless, the compounds used in the invention are not limited to these.
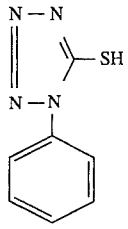
(I-I-1)
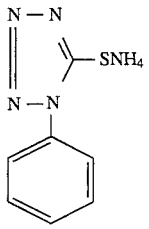
(I-I-2)
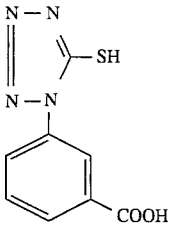
(I-I-3)
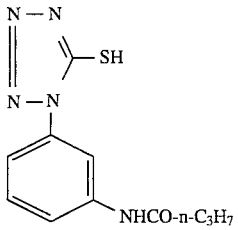
(I-I-4)
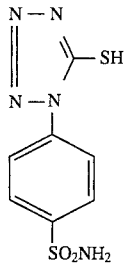
(I-I-5)
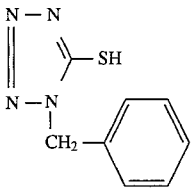
(I-I-6)
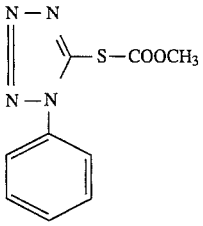
(I-I-7)
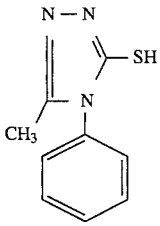
(I-I-8)
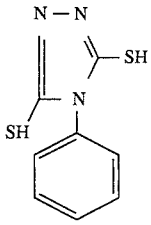
(I-I-9)
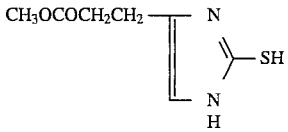
(I-I-10)
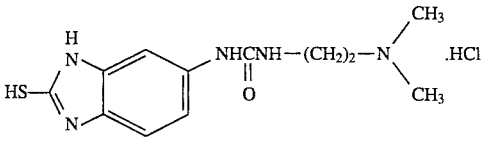
(I-I-11)
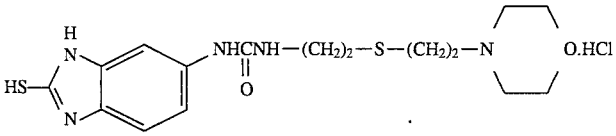
(I-I-13)

-continued
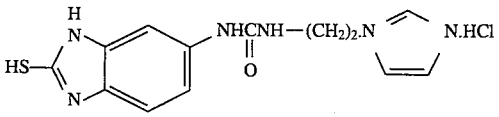
(I-I-13)
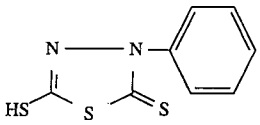
(I-I-14)
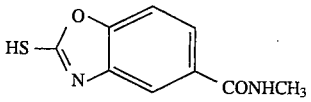
(I-I-15)
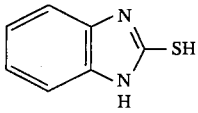
(I-I-16)
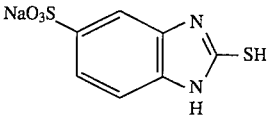
(I-I-17)
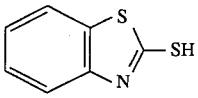
(I-I-18)
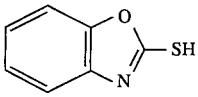
(I-I-19)
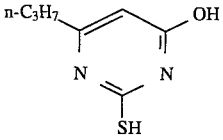
(I-I-20)
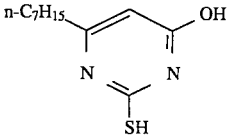
(I-I-21)
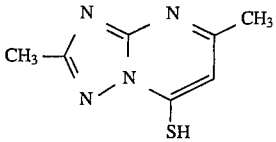
(I-I-22)
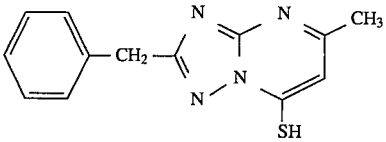
(I-I-23)
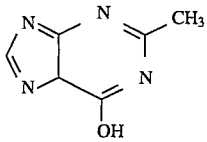
(I-I-24)
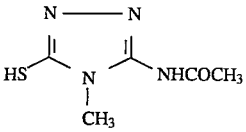
(I-I-25)
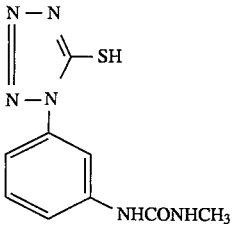
(I-I-26)
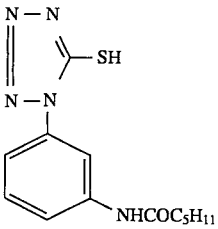
(I-I-27)
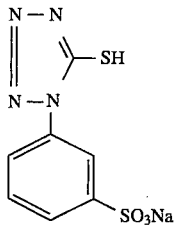
(I-I-28)
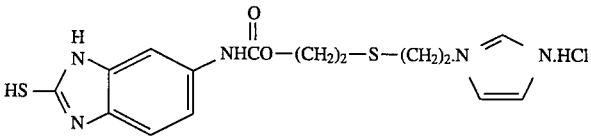
(I-I-29)
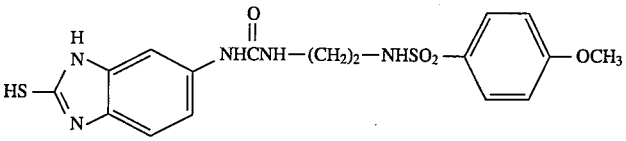
(I-I-30)

-continued (I-I-31)

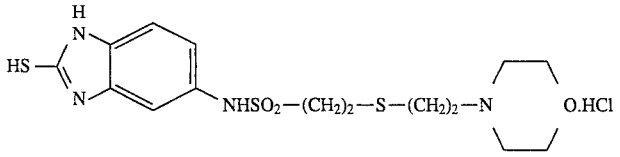

(I-I-32)

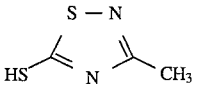

(I-I-33)

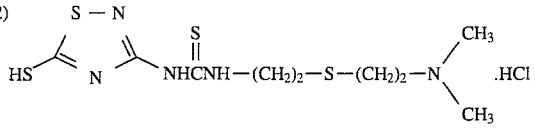

(I-I-34)

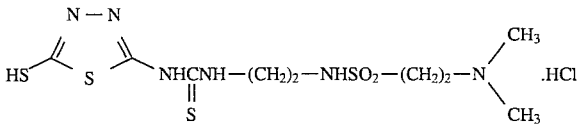

(I-I-35)

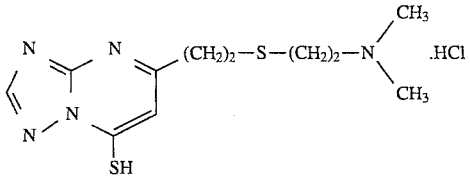

(I-I-36)

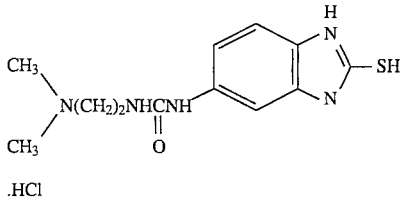

(I-I-37)

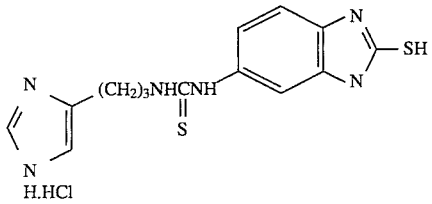

(I-I-38)

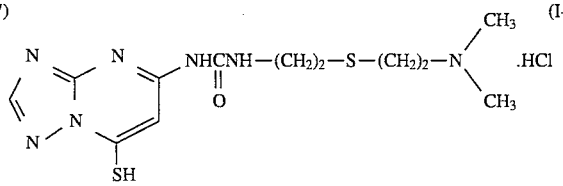

(I-I-39)

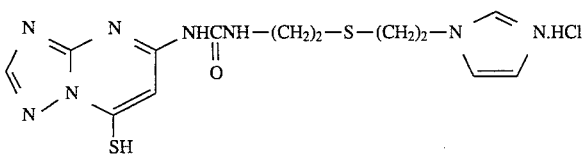

(I-I-40)

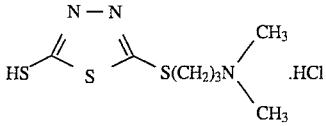

(I-I-41)

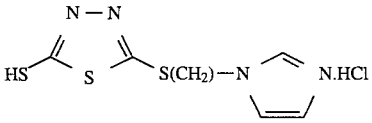

The formula (I-II) will be explained in greater detail. In the formula, $R_{200}$ represents a substituted or unsubstituted alkyl, aralkyl, alkenyl, aryl or heterocyclic group. V represents O, S, Se, or $NR_{201}$ ($R_{201}$ represents an alkyl group, an aralkyl group, an alkenyl group, an aryl group, or a heterocyclic group, and may be identical to or different from $R_{200}$). $Q_1$ represents an atomic group required to form a 5- or 6-membered heterocyclic ring, Jointly with V, C and N. This heterocyclic ring may be fused.

The alkyl groups represented by $R_{100}$ and $R_{201}$ preferably have 1 to 20 carbon atoms, which may be substituted. Examples of the substituent groups are: a halogen atom (e.g., chlorine atom), a cyano group, a carboxy group, a hydroxy group, an acyloxy group (e.g., acetoxy) having 2 to 6 carbon atoms, an alkoxycarbonyl group (e.g., ethoxycarbonyl or butoxycarbonyl) having 2 to 22 carbon atoms, a carbamoyl group, a sulfamoyl group, a sulfo group, an amino group, and a substituted amino group. Useful alkyl groups are, for example, methyl, n- or iso-propyl, n-, iso- or t-butyl, amyl (which may be branched), hexyl, octyl, dodecyl, pentadecyl, heptadecyl, chloromethyl, 2-chloroethyl, 2-cyanoethyl, carboxymethyl, 2-carboxyethyl, 2-hydroxy ethyl, 2-acetoxyethyl, acetoxymethyl, ethoxycarbonylmethyl, butoxycarbonylmethyl, 2-methoxycarbonylethyl, benzyl, o-nitrobenzyl, and p-sulfobenzyl.

The aralkyl groups represented by $R_{200}$ and $R_{201}$ are, for example, benzyl or phenethyl.

The alkenyl groups represented by $R_{200}$ and $R_{201}$ are, for example, allyl.

The aryl groups represented by $R_{200}$ and $R_{201}$ are single-ring or two-ring aryl groups, preferably single-ring aryl groups, and may include substituted ones. Among the substitutent groups are: an alkyl group having 1 to 20 carbon atoms (e.g., methyl, ethyl, or nonyl), an alkoxy group having 1 to 20 carbon atoms (e.g., methoxy or ethoxy), a hydroxy group, a halogen atom (e.g., chlorine atom or bromine atom), a carboxy group, and a sulfo group. Specific examples of the aryl group are, for example, phenyl, p-tolyl, p-methoxyphenyl, p-hydroxyphenyl, p-chlorophenyl, 2,5-dichlorophenyl, p-carboxyphenyl, o-carboxyphenyl, 4-sulfophenyl, 2,4-disulfophenyl, 2,5-disulfophenyl, 3-sulfophenyl, and 3,5-disulfophenyl.

The 5- or 6-membered heterocyclic ring formed by using $Q_1$ is, for example, a thiazoline ring, a thiazolidine ring, a selezoline ring, an oxazoline ring, an oxazoli dine ring, an imidazoline ring, an imidazolidine ring, a 1,3,4-thiadiazoline ring, a 1,3,4-oxadiazoline ring, a 1,3,4-triazoline ring, a tetrazoline ring, or a pyrimidine ring. Needless to say, the 5- or 6-membered heterocyclic ring includes one formed by fusing any one of the the heterocyclic rings exemplified here and a 5-to 7-membered carbocyclic or heterocyclic ring. To be more specific, the 5- or 6-membered heterocyclic ring includes, for example, a benzothiazoline nucleus, a naphthothiazoline nucleus, a dihydronaphthothiazoline nucleus, a tetrahydrobenzothiazoline nucleus, a benzoselenazoline nucleus, a benzoxazoline nucleus, a naphthoxazoline nucleus, a benzimidazoline nuleus, a dihydroimidazolopyrimidine nucleus, a dihydrotriazolopyridine nucleus, and a dihydrotriazolopyrimidine.

Various substituent groups may be located on the nucleus of any of the fused heterocyclic rings specified above. Examples of the substituent groups are not only those which have been exemplified as substituent group for the aryl groups represented by $R_{200}$ and $R_{201}$, but also an alkylthio group (e.g., ethylthio), an unsubstituted or substituted amino group (e.g., methylamino, diethylamino, benzylamino, or anilino), an acylamino group (e.g., acetylamino or benzoylamino), a sulfonamido group (e.g., methanesulfonamido or p-toluenesulfonamido), a thioamido group (e.g., propionylamido), an alkenyl group having 2 to 20 carbon atoms (e.g., allyl), an aralkyl group having 1 to 4 carbon atoms in the alkyl moiety (e.g., benzyl), a cyano group, a carbamoyl group (including a substituted one, for example methylcarbamoyl), an alkoxycarbonyl group having 2 to 22 carbon atoms (e.g., butoxycarbonyl), and an alkylcarbonyl group having 2 to 22 carbon atoms (e.g., caproyl).

The alkyl group described above may be further substituted with a carboxy group, a sulfo group, an alkoxycarbonyl group, an acyloxy group or an aryl group.

The compounds described above can be synthesized by, for example, the methods disclosed in JP-B-48-34169, "Journal of Pharmacology," No. 74, pp. 1365–1369 (1954), JP-B-49-23368, "Beilstein," Vol. XII, p. 394, Vol. IV, p. 212, and JP-B-47-18008.

Of those compounds represented by the formula (I-II), the listed below are preferable. Nonetheless, the compounds used in the invention are not limited to these.

(I-II-1)

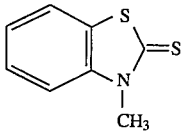

(I-II-2)

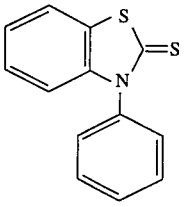

-continued (I-II-3)

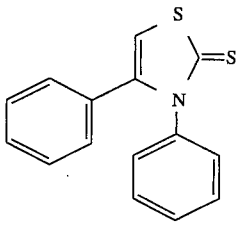

(I-II-4)

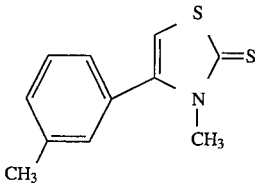

(I-II-5)

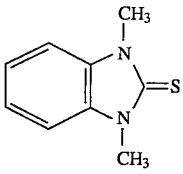

(I-II-6)

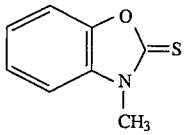

(I-II-7)

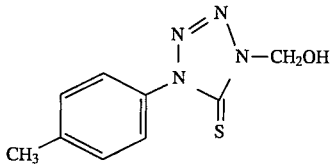

(I-II-8)

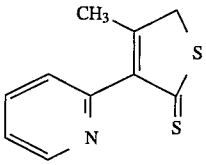

(I-II-9)

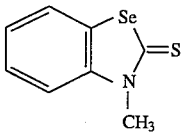

(I-II-10)

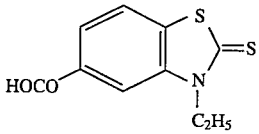

-continued (I-II-11)

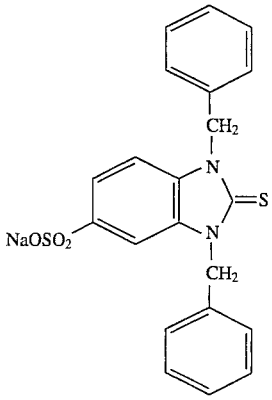

The formula (I-III) will be explained in greater detail. Each of $Y_1$ and $Z_1$ independently represents methine, a substituted methine, or a nitrogen atom. $Q_2$ represents an atomic group required to form a 5- or 6-membered heterocyclic ring, jointly with $Y_1$ and $Z_1$. The heterocyclic ring may be fused. $M_2$ represents a hydrogen atom or a cation such as an alkali metal cation or an ammonium ion.

Examples of the ring formed with $Q_2$ are: trizole, tetrazole, imidazole, oxazole, thiadiazole, pyridine, pyrimidine, triazine, azabenzimidazole, purine, tetrazaindene, triazaindene, pentazaindene, benzotriazole, benzimidazole, benzoxazole, benzothiazole, benzoselenazol, indazole, and naphthoimidazole rings.

Any of these heterocyclic rings may be substituted with, for example, an alkyl group (e.g., methyl, ethyl, n-hexyl, hydroxyethyl or carboxyethyl), an alkenyl group (e.g., allyl), an aralkyl group (e.g., benzyl or phenethyl), an aryl group (e.g., phenyl, naphthyl, p-acetamidophenyl, p-carboxyphenyl, m-hydroxyphenyl, p-sulfamoylphenyl, p-acetylphenyl, o-methoxyphenyl, 2,4-diethylaminophenyl, or 2,4-dichlorophenyl), an alkylthio group (e.g., methylthio, ethylthio, or n-butylthio), an arylthio group (e.g., phenylthio or naphthylthio), or an aralkylthio group (e.g., benzylthio). On a fused ring, in particular, a nitro group, an amino group, a halogen atom, a carboxyl group, or a sulfo group may be substituted, besides any of the substituent groups specified above.

Of those compounds represented by the formula (I-III), the listed below are desirable. However, the compounds used in the invention are not limited to these.

(I-III-1)

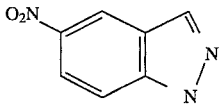

(I-III-2)

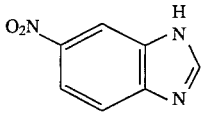

(I-III-3)

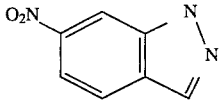

(I-III-4)

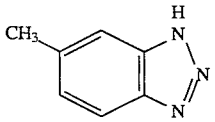

-continued (I-III-5)

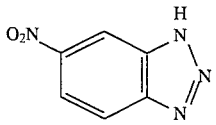

(I-III-6)

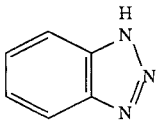

(I-III-7)

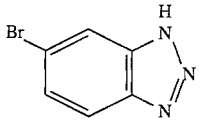

(I-III-8)

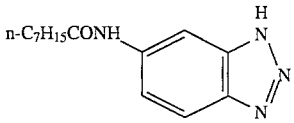

(I-III-9)

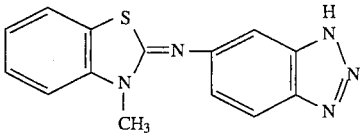

(I-III-10)

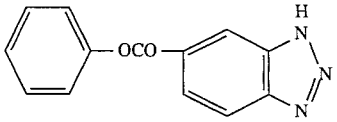

(I-III-11)

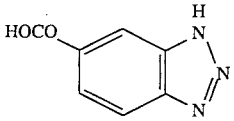

(I-III-12)

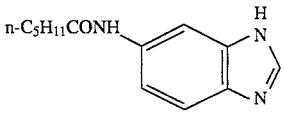

(I-III-13)

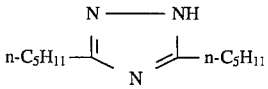

(I-III-14)

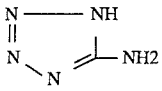

(I-III-15)

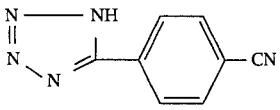

(I-III-16)

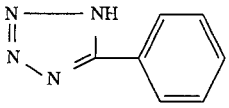

The compounds represented by the formulas (I-I), (I-II), and (I-III) are used generally in the same layer together with the silver halide emulsion of this invention. Nonetheless, they may be used in a non-light-sensitive hydrophilic colloid layer. The amount in which they are used is generally $10^{-6}$ to $10^{-1}$ mol per mol of silver halide, preferably $10^{-5}$ to $10^{-2}$ mol per mol of silver halide of the present invention.

The compounds represented by the formulas (I-I) to (I-III) of this invention may be used either singly or in combination of two or more.

In the case where any compound represented by the formulas (I-I) to (I-III) is mixed with the silver halide emulsion of the present invention, it is desirable that the compound be adsorbed exclusively to the surfaces of the silver halide emulsion grains. Hence, in order to contain the silver halide emulsion in a red-sensitive layer, a green-sensitive layer, or a blue-sensitive layer, the compound of this invention should better be added to the silver halide emulsion beforehand. The compound of the invention may, however, be added to a coating solution containing the silver halide emulsion. The compound represented by the formula (I-I), the formula (I-II) and/or the formula (I-III) may be added at the time the grains of the silver halide emulsion are formed.

Of the compounds represented by the formulas (I-I) to (I-III) Of the present invention, particularly preferable are those represented by the formulas (I-I) and The compounds represented by the formula (III-I) will be described in greater detail.

The redox mother nucleus represented by A in the formula (III-I) is one which accords to the Kendall-Pelz law. Examples of this nucleus are hydroquinone, catechol, p-aminophenol, o-aminophenol, 1,2-naphthalenediol, 1,4-naphthalenediol, 1,6-naphthalenediol, 1,2-aminonaphthol, 1,4-aminonaphthol, 1,6-aminonaphthol, gallic ester, gallic amide, hydrazine, hydroxylamine, pyrazolidone, and reductone.

It is desirable that the amino group which these redox mother nuclei have be substituted with a sulfonyl group having 1 to 25 carbon atoms or an acyl group having 1 to 25 carbon atoms. Examples of the sulfonyl group are substituted or unsubstituted aliphatic and aromatic sulfonyl groups. Examples of the acyl group are substituted or unsubstituted aliphatic and aromatic acyl groups. The hydroxy or amino group which forms the redox mother nucleus represented by A may be protected by a protective group which enables to be deprotected at the time of development. Examples of the protective group are those having 1 to 25 carbon atoms, such as an acyl group, an alkoxycarbonyl group, a carbamoyl group, and the protective groups disclosed in JP-A-59-197037 and JP-A-59-201057. The protective group may bond to the substituent group of A, which will be described below, to form a 5-, 6-, or 7-membered ring, if possible.

The redox mother nucleus represented by A, in its substitutable position, may be substituted with a substituent group. Examples of this substituent group are those having 25 or less carbon atoms, such as an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, a cyano group, a halogen atom, an acyl group, a carboxyl group, a sulfo group, a nitro group, a heterocyclic group, and $—(L)_j—(G)_k—(Time)_t—DI$. These substituent groups may, in turn, be substituted with the substituent groups described above. Further, these substituent groups may bond together, if possible, forming a saturated or unsaturated carbocyclic ring, or a saturated or unsaturated heterocyclic ring.

Preferable examples of A are hydroquinone, catechol, p-aminophenol, o-aminophenol, 1,4-naphthalenediol, 1,4-aminonaphthol, gallic ester, gallic amide, and hydrazine. Of these, hydroquinone, catechol, p-aminophenol, o-aminophenol, and hydrazine are more preferable. Hydroquinone and hydrazine are most preferable.

L in the formula (III-I) is a divalent linking group. Preferable as this group are alkylene, alkenylene, arylene, oxyalkylene, oxyarylene, aminoalkyleneoxy, aminoalkenyleneoxy, aminoaryleneoxy, and an oxygen atom.

G in the formula (III-I) represents an acidic group. It is preferably —CO—, —COCO—, —CS—, —SO—, $SO_2$—, $—P(=O)(OR_{21})$–, or $—C(=NR_{22})$—. Here, $R^{21}$ is an alkyl, aryl, or heterocyclic group, and $R^{22}$ is a hydrogen atom, or of the same meaning as $R^{21}$. G is preferably —CO—, —COCO—, $—P(=O)(OR^{21})$— or $—C(=NR^{22})$—, more preferably —CO— or —COCO—, and most preferably —CO—.

In the formula (III-I), each of j and k is 0 or 1. Whether j and k should better be 0 or 1 depends on the type of A. Preferably, j=0, more preferably j=k=0 if A is hydroquinone, catechol, aminophenol, naphthalenediol, aminonaphythol, or the gallic derivative. Preferably, j=0, and k=1 if A is hydrazine or hydroxylamine. Preferably, j=k=1 if A is pyrazolidone.

In the formula (III-I), $—(Time)_t—DI$ is a group which is split off in the form of $[—(Time)_t—DI]^-$, when the redox mother nucleus represented by A undergoes cross oxidation and changes into an oxidized form during the processing of development.

It is desirable that Time links to G through a sulfur atom, a nitrogen atom, an oxygen atom, or a selenium atom.

Time is a group which enables to release DI after it has been released, and may have timing-adjusting function. Alternatively, it may be a coupler or a redox group which reacts with the oxidized form of a developing agent to release DI.

Examples of Time which has timing-adjusting function are disclosed in, for example, U.S. Pat. Nos. 4,248,962, 4,409,323, British Patent 2,096,783, U.S Pat. No. 4,146,396, JP-A-51-146828, and JP-A-57-56837. Two or groups, selected from these, may be used in combination.

Preferred examples of the timing-adjusting group are as follows:

(1) Group Utilizing Cleavage Reaction of Hemiacetal

Example of this group is the group represented by the following formula (T-1) disclosed in, for example, U.S. Pat. No. 4,146,396, JP-A-60-249148, and JP-A-60-249149. In the formula, mark * indicates the position where the group bonds to $A—(L)_j—(G)_k—$ in the formula (III-I), and mark ** indicates the position where the group bonds to -DI in the formula (III-I).

Formula (T-1)

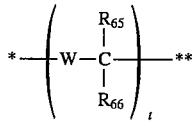

In this formula, W is an oxygen atom, a sulfur atom, or $—N(R_{67})$— group, each of $R_{65}$ and $R_{66}$ is a hydrogen atom or a substituent, $R_{67}$ is a substituent, and t is 1 or 2. If t is 2, the two $—W—C(R_{65})(R_{66})$— groups are either identical or different. If $R_{65}$ and $R_{66}$ are substituents, typical examples of these, as well as of $R_{67}$ are: $R_{69}$ group, $R_{69}CO$— group, $R_{69}SO_2$— group, $N(R_{69})(R_{70})CO$— group, and $N(R_{69})(R_{70})SO_2$— group. $R_{69}$ is an aliphatic group, an aromatic group, or a heterocyclic group, and $R_{70}$ is a hydrogen atom, an aliphatic group, an aromatic group, or a heterocyclic group. $R_{65}$, $R_{66}$, and $R_{67}$ may be divalent groups, and bond together, forming a ring.

(2) Group Causing Cleavage by Using Intramolcular Nucleophilic Substitution Reaction An example of this group is the timing group disclosed in U.S. Pat. No. 4,248,292. This group can be represented by the following formula (T-2):

Formula (T-2) * —Nu—Link—E—**

In the formula (T-2), marks * and  are of the same meaning as in the formula (T-i). Nu is a nucleophilic group, and examples thereof are an oxygen atom and a sulfur atom. E is electrophilic group which can cleave the bond at the position  when attacked by the nucleophilic group Nu, and Link is a linking group which sterically links Nu and E such that Nu and E can undergo intramolecular nucleophilic substitution reaction.

(3) Group Causing Cleavage by Using Electron Transfer Along Conjugate System

Example of this group is the group represented by the following formula (T-3) disclosed in, for example, U.S. Pat. Nos. 4,409,323 and 4,421,845, JP-A-57-188035, JP-A-58-98728, JP-A-58-209736, and JP-A-58-209738.

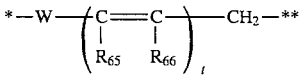

Formula (T-3)

In the formula (T-3), marks * and **, W, $R_{65}$, $R_{66}$ and t are of the same meaning as explained in connection with the formula (T-1).

(4) Group Utilizing Cleavage by Hydrolysis of Ester

An example of this group is the linking group disin, for example, West German Laid-Open Patent Application 2,626,315. There are two types of this group, which are represented by the following formulas (T-4) and (T-5):

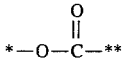

Formula (T-4)

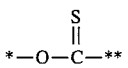

Formula (T-5)

In these formulas, marks * and ** are of the same meaning as in the formula (T-1).

(5) Group Utilizing Cleavage of Iminoketal

An example of this group is the linking group disclosed in U.S. Pat. No. 4,546,073. This group is represented by the following formula (T-6):

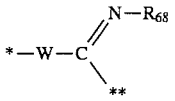

Formula (T-6)

In the formula (T-6), marks * and **, and W are of the same meaning as explained in connection with the formula (T-1). $R_{68}$ is of the same meaning as $R_{67}$ described above.

The following can be cited as examples of the group represented by Time which is either a coupler or a redox group.

An example of Time which is a coupler is a phenol type coupler which is bonded to G in the formula (III-I) at the oxygen atom of the hydroxy group which is removed of the hydrogen atom. Another example of Time which is a coupler is a 5-pyrazolone type coupler which is bonded to G at the oxygen atom of the hydroxy group of the tautomerized 5-hydroxypyrazole from which is removed the hydrogen atom.

These couplers act as couplers only after they have split off G, and react with an oxidized form of a developing agent to release DI bonded at their coupling position.

Preferable examples of Time which is a coupler are those represented by the following formulas (C-1) to (C-4):

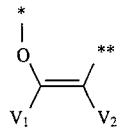

Formula (Cp-1)

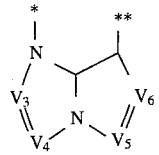

Formula (Cp-2)

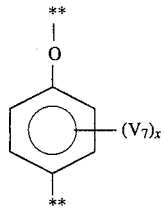

Formula (Cp-3)

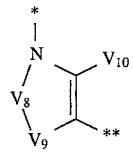

Formula (Cp-4)

In these formulas, each of $V_1$ and $V_2$ is a substituent, each $V_3$, $V_4$, and $V_5$ is a nitrogen atom, or a substituted or unsubstituted methine group, $V_7$ is a substituent, and x is an integer of 0 to 4. $V_7$represents identical or different groups if x is 2, 3 or 4, and two groups $V_7$ may bond to each other to form a ring. $V_8$ is —CO— group, —$SO_2$— group, an oxygen atom, or a substituted imino group, $V_9$ is a non-metallic atomic group required to form a 5- to 8-membered ring, and V10 is a hydrogen atom or a substituent. The mark * indicates the position where the coupler bonds to A—$(L)_j$—$(G)_k$in the formula (III-I), and the mark ** indicates the position where the coupler bonds to —DI in the formula (III-I).

If the group represented by Time in the formula (III-I) is a redox group, it is preferably one which is represented by the following formula (R-1):

Formula (R-1) *—J—$(T{=}U)_h$—$Q_{10}$—B

In the formula (R-1), each of J and $Q_{10}$ is independently an oxygen atom, or a substituted or unsubstituted imino group, at least one of h number of T's and h number of U's is a methine group having DI as a substituent, and the remaining T's and U's are substituted or unsubstituted methine groups, or nitrogen atoms. h is an integer of 1 to 3 (h number of T's are identical or different, and h number of U's are likewise identical or different), and B is a hydrogen atom or a group which can be removed by an alkali. Any two of the substituent groups J, T, U, $Q_{10}$ and B may be divalent groups, which link together to form a ring. For example, (T=U)h may a benzene ring or a pyridine ring.

When each of J and $Q_{10}$ represents a substituted or unsubstituted imino group, it is preferably an imino group substituted with a sulfonyl or acyl group. In this case, J and $Q_{10}$ are represented by the following formula (N-1) or (N-2):

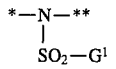

Formula (N-1)

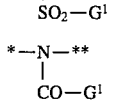

Formula (N-2)

In these formulas, the mark * indicates the position where the group bonds to G in the formula (III-I) or the position where the group bonds to B in the formula (R-1), and the mark ** indicates the position where the group bonds to either one of the free bonds of $—(T{=}U)_h—$. $G^1$ represents an aliphatic group, an aromatic group, or a heterocyclic group.

Of the groups which are represented by the formula (R-1), particularly preferable are those which are represented by the following formulas (R-2) and (R-3): Formula (R-2)

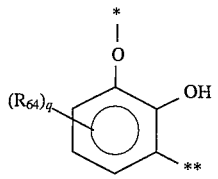

Formula (R-2)

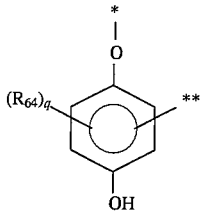

Formula (R-3)

In the formulas (R-2) and (R-3), the mark * indicates the position where the group bonds to G of formula (III-I), and the mark ** indicates the position where the group bonds to DI of the formula (III-I).

In the formulas (R-2) and (R-3), $R_{64}$ is a substituent, and q is 0, 1, 2 or 3. If q is 2 or 3, the groups $R_{64}$ may be the same or different. If two substituent groups $R_{64}$ are on adjacent carbon atoms, they may be divalent groups, bonding together to form a ring.

In the formula (III-I), DI represents a development inhibitor. Preferable examples of DI are a compound having a mercapto group which bonds to a heterocyclic ring, represented by the following formula (X-1), or a heterocyclic compound which can form imino silver, represented by the following formula (X-2).

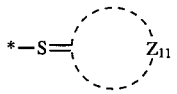

Formula (X-1)

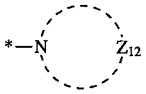

Formula (X-2)

In the formulas (X-1) and (X-2), $Z_{11}$ is a non-metallic atomic group required to form a monocyclic or fused heterocyclic ring, and $Z_{12}$ is a non-metallic atomic group required to form, along with N, a monocyclic or fused heterocyclic ring. The heterocyclic ring may have a substituent. The mark * indicates the position where the group bonds to Time. Preferable as a heterocyclic ring formed by $Z_{11}$ or $Z_{12}$ is a 5- to 8-membered heterocyclic rings having at least one heteroatom selected from a nitrogen atom, an oxygen atom, a sulfur atom, or a selenium atom. Of these, the most preferred is a 5- or 6-membered heterocyclic ring.

Examples of the heterocyclic ring formed by $Z_{11}$ are: azoles (tetrazole, 1,2,4-triazole, 1,2,3-triazole, 1,3,4-thiadiazole, 1,3,4-oxadiazole, 1,3-thiazole, 1,3-oxazole, imidazole, benzothiazole, benzoxazole, benzimidazole, pyrrole, pyrazole, and indazole), azaindenes (tetrazaindene, pentazaindene, and triazaindene), and azines (pyrimidine, triazine, pyrazine, and pyridazine).

Examples of the heterocyclic ring formed by $Z_{12}$ are: triazoles (1,2,4-triazole, benzotriazole, and 1,2,3-triazole), indazole, benzimidazole, azaindenes (tetrazaindene and pentazaindene), and tetrazole.

Preferable as the substituent group which the development inhibitors presented by the formula (X-1) and (X-2) have are: $R_{77}$ group, $R_{78}O—$ group, $R_{77}S—$ group, $R_{770}CO—$ group, $R_{770}SO_2—$ group, a halogen atom, a cyano group, a nitro group, $R_{77}SO_2—$ group, $R_{78}CO—$ group, $R_{77}COO—$ group, $R_{77}SO_2N(R_{78})—$ group, $R_{78}N(R_{79})SO_2—$ group, $R_{78}N(R_{79})CO—$ group, $R_{77}(R_{78})C{=}N—$ group, $R_{77}(R_{78})N—$ group, $R_{78}CON(R_{79})—$ group, $R_{770}CON(R_{78})—$ group, $R_{78}N(R_{79})CON(R_{80})—$ group, $R_{77}SO_2O—$ group, or groups indicated below:

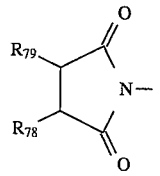

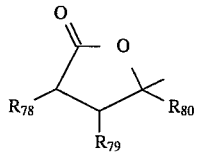

Here, $R_{77}$ is an aliphatic group, an aromatic group, or a heterocyclic group, and each of $R_{78}$, $R_{79}$ and $R_{80}$ is an aliphatic group, an aromatic group, a heterocyclic group, or a hydrogen atom. If there are two or more $R_{77}$ groups, two or more $R_{78}$ groups, two or more $R_{79}$ groups, and two or more $R_{80}$ groups, these may bond together, forming a ring (e.g., a benzene ring).

Examples of the compound represented by the formula (x-1) are: substituted or unsubstituted mercaptoazoles (e.g., 1-phenyl-5-mercaptotetrazole, 1-propyl-5-mercaptotetrazole, 1-butyl-5-mercaptotetrazole, 2-methylthio-5-mercapto-1,3,4-thiadiazole, 3-methyl-4-phenyl-5-mercapto-1,2,4-triazole, 1-(4-ethylcarbamoylphenyl)-2-mercaptoimidazole, 2-mercaptobenzoxazole, 2-mercaptobenzimidazole, 2-mercaptobenzothiazole, 2-mercaptobenzoxazole, 2-phenyl-5-mercapto-1,3,4-oxadiazole, 1-(3-(3-methylureido)phenyl)-5-mercaptotetrazole, 1-(4-nitrophenyl)-5-mercaptotetrazole, and 5-(2-ethylhexanoylamino)-2-mercaptobenzimidazole), substituted or unsubstituted mercaptoazaindenes (e.g., 6-methyl-4-mercapto-1,2,3a,7-tetrazaindene, and 4,6-dimethyl-2-mercapto-1,3,3a,7-tetrazaindene), and substituted or unsubstituted mercaptopyrimidines (e.g., 2-mercaptopyrimidine, and 2-mercapto-4-methyl-6-hydroxypyrimidine).

Examples of the heterocyclic compound which can form imino silver are: substituted or unsubstituted triazoles (e.g., 1,2,4-triazole, benzotriazole, 5-methylbenzotriazole, 5-nitrobenzotriazole, 5-bromobenzotriazole, 5-n-butylbenzotriazole, and 5,6-dimethylbenzotriazole), substituted or unsubstituted indazoles (e.g., indazole, 5-nitroindazole, 3-nitroindazole, and 3-chloro-5-nitroindazole), and substituted or unsubstituted benzimidazoles (e.g., 5-nitrobenzimidazole, and 5,6-dichlorobenzimidazole).

In the formula (III-I), DI may also be a development inhibitor which is released from Time, becoming a development-inhibiting compound, which, in turn, reacts with a component of a developing solution, changing to a compound which substantially does not have, or little have, a development-inhibiting property. A functional group which undergos such chemical reaction is, for example, an ester group, a carbonyl group, an imino group, an immonium group, a Michael addition receptor group, or an imido group.

Groups which can be cited as examples of such a deactivated development inhibitor are the development inhibitor residual groups described in, for example, U.S. Pat. Nos. 4,477,563, JP-A-60-218644, JP-A-60-221750, JP-A-60-233650, and JP-A-61-11743.

Of these compounds, those having an ester group are preferred. Examples of such a compound are 1-(3-phenoxycarbonylphenyl)-5-mercaptotetrazole, 1-(4-phenoxycarbonylphenyl)-5-mercaptotetrazole, 1-(3-maleinimidophenyl)-5-mercaptotetrazole, 5-phenoxycarbonylbenzotriazole, 5-(4-cyanophenoxycarbonyl)benzotriazole, 2-phenoxycarbonylmethylthio-5-mercapto-1,3,4-thiadiazole, 5-nitro-3-phenoxycarbonylimidazole, 5-(2,3-dichloropropyloxycarbonyl)benzotriazole, 1-(4-benzoyloxyphenyl)-5-mercaptotetrazole, 5-(2-methanesulfonylethoxycarbonyl)-2mercaptobenzothiazole, 5-cinnamoylaminobenzotriazole, 1-(3-vinylcarbonylphenyl)-5-mercaptotetrazole, 5-succinimidomethylbenzotriazole, 2-(4-succinimidophenyl)-5-mercapto-1,3,4-oxadiazole, 6-phenoxycarbonyl-2-mercatobenzoxazole, 2-(1-methoxycarbonylethylthio)-5-mercapto-1,3,4-thiadiazole, 2-butoxycarbonylmethoxycarbonylmethylthio-5-mercapto-1,3,4-thiadiazole, 2-(N-hexylcarbamoylmethoxycarbonylmethylthio)- 5-mercapto-1,3,4-thiadiazole, and 5-butoxycarbonylmethoxycarbonylbenzotriazole.

Of the compounds represented by Formula (III-I), preferable are those represented by the following formulas (III-II) and (III-II):

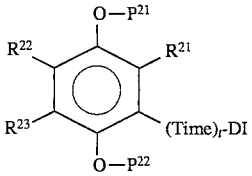

Formula (III-II)

where each of $R^{21}$ to $R^{23}$ is a hydrogen atom, or a group which can be substituted on the hydroquinone nuclei, each of $P^{21}$ and $P^{22}$ is a hydrogen atom or a protective group which can be deprotected at the time of development, and Time, DI, and t are of the same meaning as in Formula (III-I).

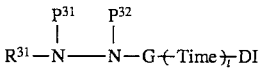

Formula (III-III)

where $R^{31}$ is an aryl group, a heterocyclic group, an alkyl group, an aralkyl group, an alkenyl group, or an alkynyl group, each of $P^{31}$ and $P^{32}$ is a hydrogen atom or a protective group which can be deprotected at the time of development, and G, Time, DI, and t are of the same meaning as in Formula (III-I).

The formula (III-II) will be described in greater detail. The substituent groups represented by $R^{21}$ to $R^{23}$ can be those exemplified as substituent groups for A in the formula (III-I). Nonetheless, preferable as $R^{22}$ and $R^{23}$ are a hydrogen atom, an alkylthio group, an arylthio group, an alkoxy group, an aryloxy group, an amido group, a sulfonamido group, an alkoxycarbonylamino group, and a ureido group. Of these, particularly preferable are a hydrogen atom, an alkylthio group, an alkoxy group, an amido group, a sulfonamido group, an alkoxycarbonylamino group, and a ureido group. $R^{22}$ and $R^{23}$ may combine together, forming a ring.

Preferable as $R^{21}$ is a hydrogen atom, a carbamoyl group, an alkoxycarbonyl group, a sulfamoyl group, a sulfonyl group, a cyano group, an acyl group, or a heterocyclic group. Of these, more preferable are a hydrogen atom, a carbamoyl group, an alkoxycarbonyl group, a sulfamoyl group, and a cyano group.

Examples of protective groups $P^{21}$ and $P^{22}$ may be those exemplified above as protective groups for the hydroxy group of A in the formula (III-I). Preferable as the protective groups are: a hydrolyzable group, such as an acyl group, an alkoxycarbonyl group, an aryloxycabonyl group, a carbamoyl group, an imidoyl group, an oxazolyl group, or a sulfonyl group; a precursor group of the type disclosed in U.S. Pat. No. 4,009,029, which utilizes reverse Mickael reaction; a precursor group of the type disclosed in U.S. Pat. No. 4,310,612, which utilizes an anion generated after ring-cleavage reaction as an intramolcular nucleophilic group; a precursor group of the type disclosed in U.S. Pat. Nos. 3,674,478, 3,932,480 and 3,993,661, which causes cleavage reaction due to the electron transfer of anions along the conjugate system; a precursor group of the type disclosed in U.S. Pat. No. 4,335,200, which causes cleavage reaction due to the electron transfer of anions which had reacted after ring-cleavage; and a precursor group of the type disclosed in U.S. Pat. Nos. 4,363,865 and 4,410,618, which utilizes an imidomethyl group.

Preferable as $P^{21}$ and $P^{22}$ are hydrogen atoms.

Preferable as DI are mercaptoazoles and benzotriazoles. Particularly preferable mercaptoazoles are mercaptotetrazoles, 5-mercapto-1,3,4-thiadiazoles, and 5-mercapto-1,3,4-oxadiazoles.

The most preferable as DI is a 5-mercapto-1,3,4-thiadiazole.

Of the compounds represented by Formula (III-II), particularly preferred are those represented by the following formulas (III-IIa) and (III-IIb):

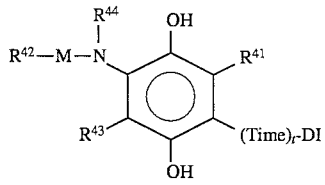

Formula (III-IIa)

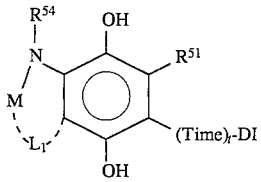

Formula (III-IIb)

where $R^{42}$ is an aliphatic group, an aromatic group or a heterocyclic group, and M is —CO—, —$SO_2$—, —N($R_{45}$)—CO—, —OCO—or —N($R_{45}$)—$SO_2$—. Each of $R^{44}$, $R^{45}$, and $R^{54}$ is a hydrogen atom, an alkyl group, or an aryl group. $L^1$ is a divalent linking group required to form a 5- to 7-membered ring. $R^{41}$ and $R^{51}$ are of the same meaning as $R^{21}$ in the formula (III-II), $R^{43}$ is of the same meaning as $R^{23}$ in the formula (III-II), and —(Time)$_t$—DI is of the same meaning as —(Time)$_t$—DI in the formula (III-II).

$R^{42}$ will be described in more detail. If $R^{42}$ is an aliphatic group, it is preferably a straight-chain, branched-chain or cyclic alkyl, alkenyl or alkynyl group, having 1 to 30 carbon atoms. If it is an aromatic group, it preferably has 6 to 30 carbon atoms and includes a phenyl or naphthyl group. If it is a heterocyclic group, it is preferably a 3- to 12-membered one having at least one heteroatom selected from nitrogen, oxygen and sulfur. Group $R^{42}$ may be substituted with any group exemplified above as substituent groups for A.

Formula (III-III) will be described in more detail below.

If $R^{31}$ is an aryl group, it preferably has 6 to 20 carbon atoms and is, for example, phenyl or naphthyl. If it is a heterocyclic group, it is preferably a 5- to 7-membered one having at least one heteroatom selected from nitrogen, oxygen and sulfur, and is, for example, furyl or pyridyl. If it is an alkyl group, it preferably has 1 to 30 carbon atoms, and is, for example, methyl, hexyl, or octadecyl. If it is an aralkyl group, it preferably has 7 to 30 carbon atoms, and is, for example, benzyl or trityl. If it is an alkenyl group, it preferably has 2 to 30 carbon atoms, and is, for example, allyl. If it is an alkynyl group, it preferably has 2 to 30 carbon atoms, and is, for example, propagyl. $R^{31}$ is preferably an aryl group, and more preferably phenyl.

Examples of the protective groups $P^{31}$ and $P^{32}$ are those which have been exemplified above as protective groups for the amino group of A in the formula (III-I). Preferable as $P^{31}$ and $P^{32}$ are hydrogen atoms.

Preferable as G is —CO-, and preferable as DI is one which has been described in conjunction with the formula (III-II).

$R^{21}$ to $R^{23}$ in the formula (III-II), and $R^{31}$ in the formula (III-III) may each be substituted with a substituent. This substituent may have a so-called ballast group which imparts anti-diffusability or a group which can be adsorbed to silver halide. A ballast group is preferred. If $R^{31}$ is a phenyl group, the substituent is preferably an electron-donating group, such as a sulfonamido group, an amido group, an alkoxy group, or a ureido group. If $R^{21}$, $R^{22}$, $R^{23}$ or $R^{31}$ has a ballast group, it is particularly desirable that a polar group, such as a hydroxy group, a carboxyl group, or a sulfo group, exist in the molecule.

To describe the present invention more specifically, the compounds represented by the formula (I) will be specified below. However, the compounds which can be used in the invention are not limited to these.

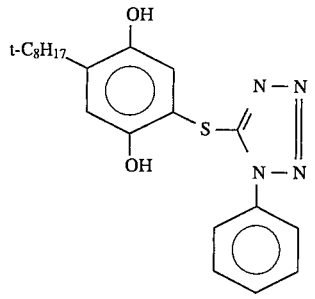

(III-I-1)

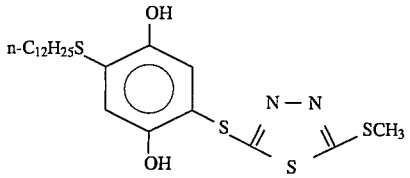

(III-I-2)

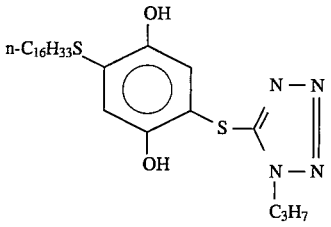

(III-I-3)

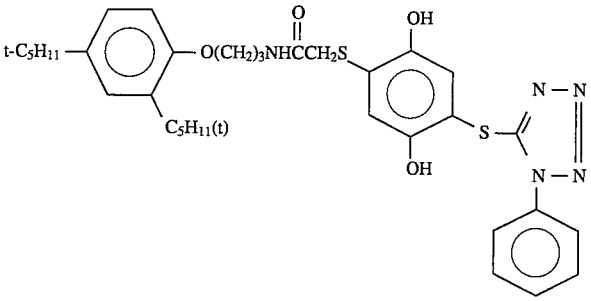

(III-I-4)

-continued
(III-I-5)
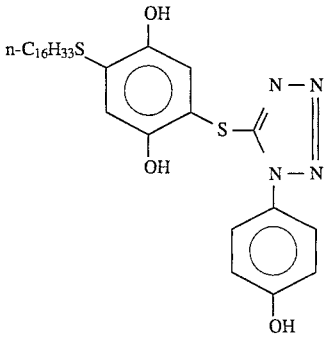
(III-I-6)
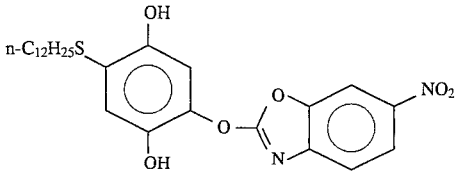
(III-I-7)
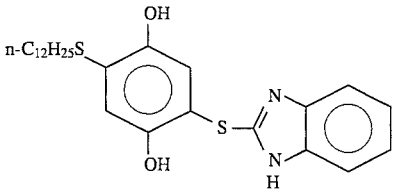
(III-I-8)
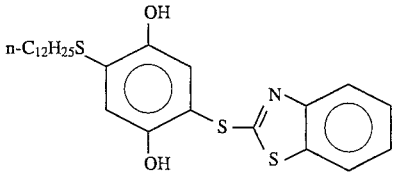
(III-I-9)
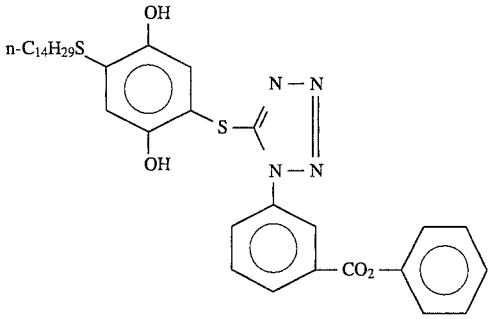
(III-I-10)
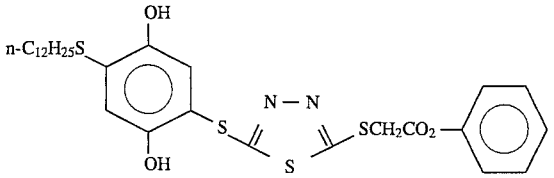
(III-I-11)
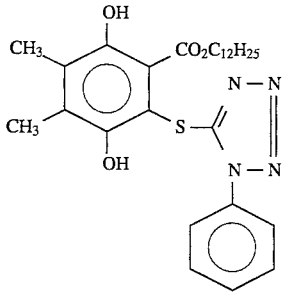

-continued
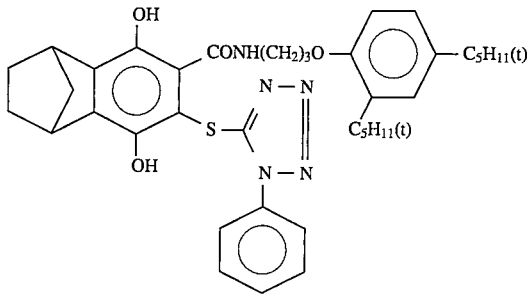
(III-I-12)
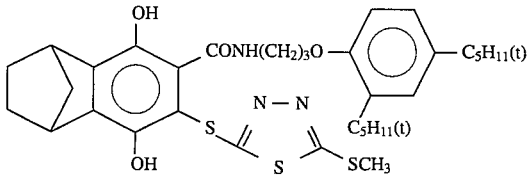
(III-I-13)
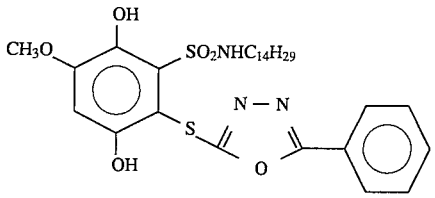
(III-I-14)
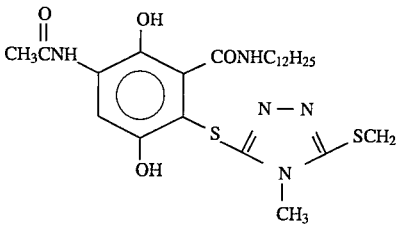
(III-I-15)
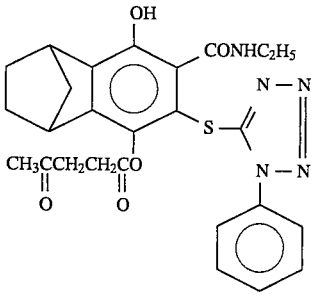
(III-I-16)
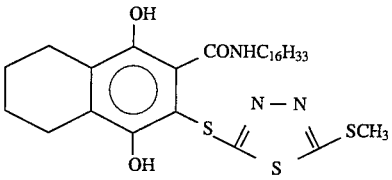
(III-I-17)
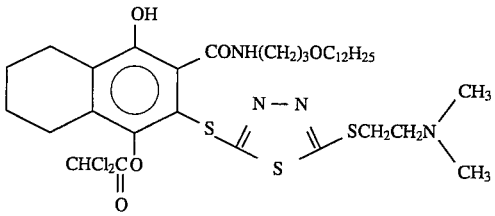
(III-I-18)

-continued
(III-I-19)
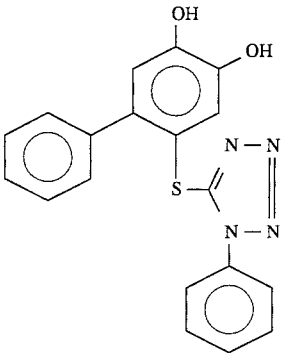
(III-I-20)
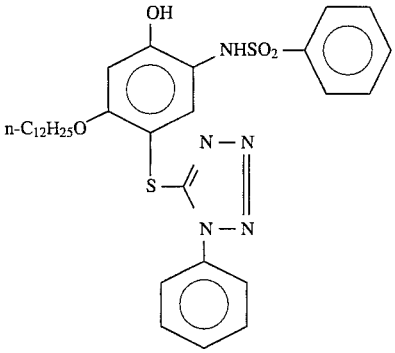
(III-I-21)
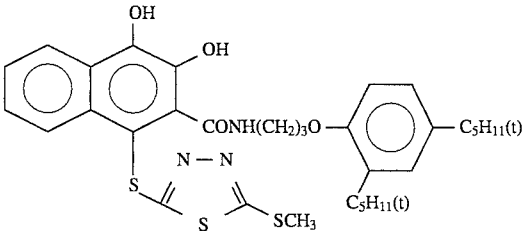
(III-I-22)
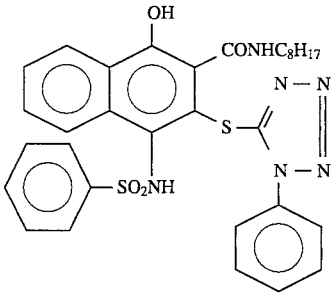
(II-I-23)
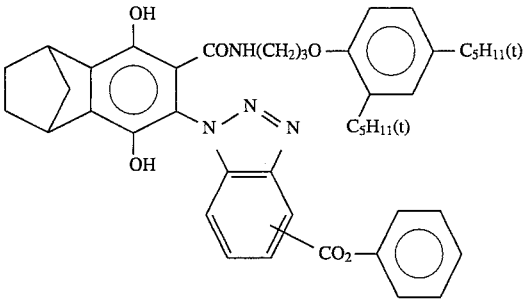

-continued
(III-I-24)
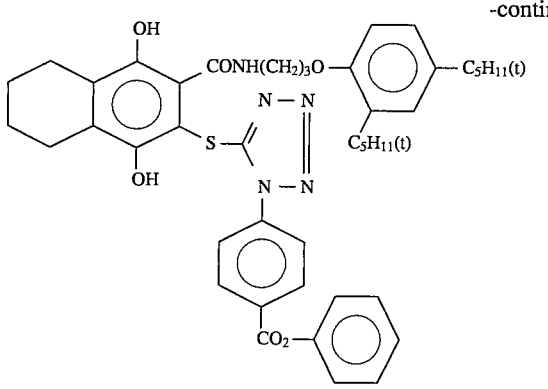
(III-I-25)
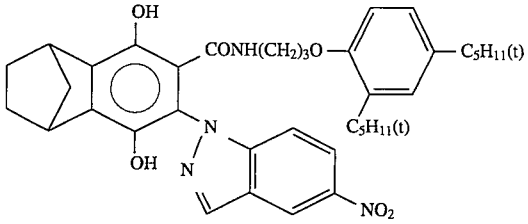
(III-I-26)
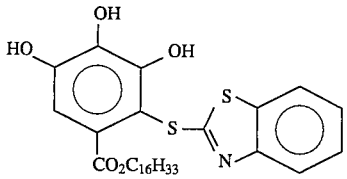
(III-I-27)
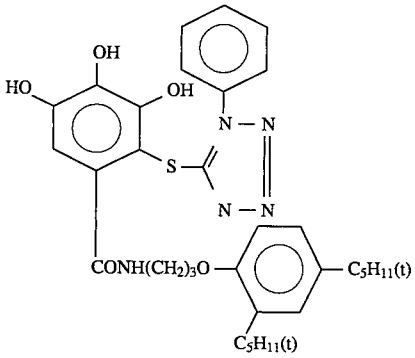
(III-I-28)
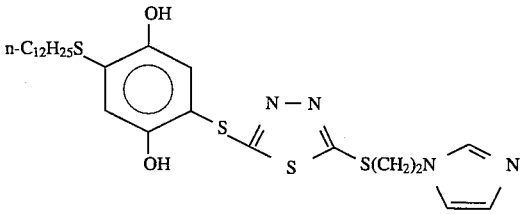
(III-I-29)
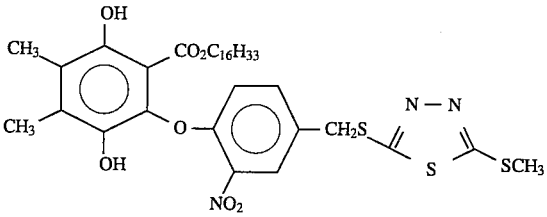

-continued
(III-I-30)
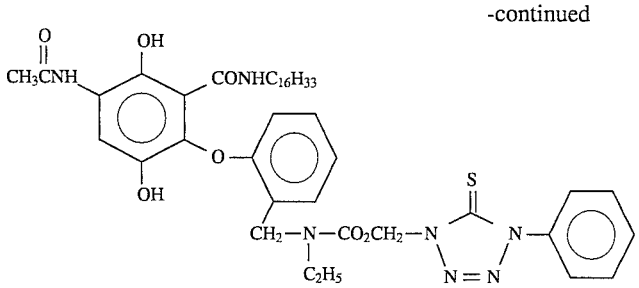
(III-I-31)
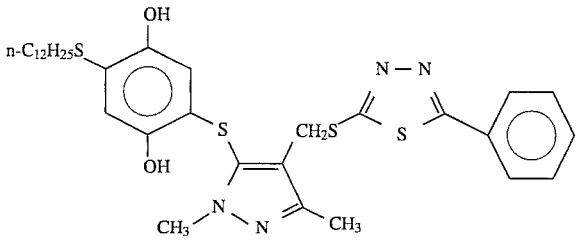
(III-I-32)
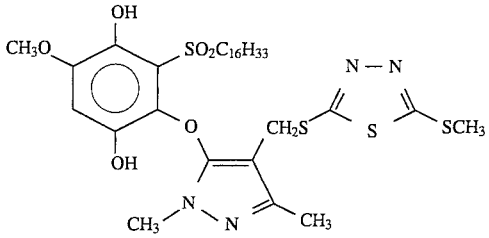
(III-I-33)
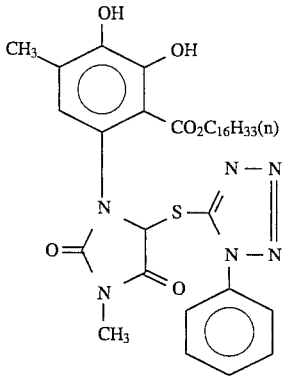
(III-I-34)
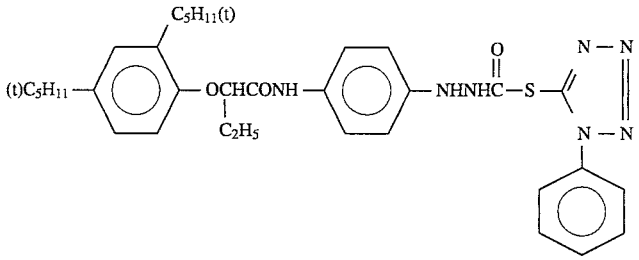
(III-I-35)
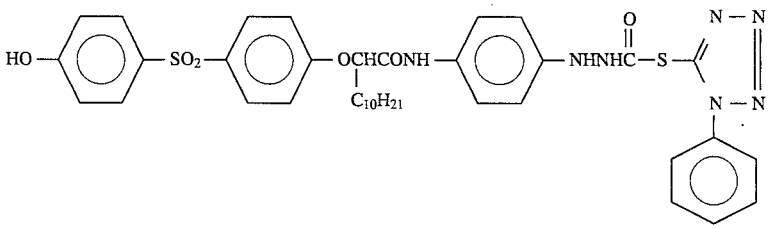

-continued
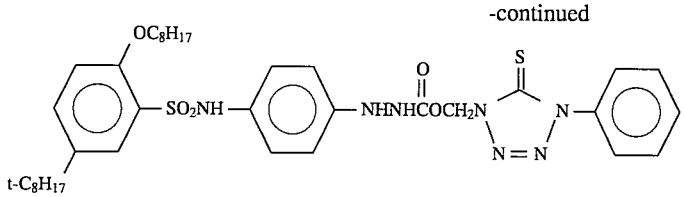
(III-I-36)
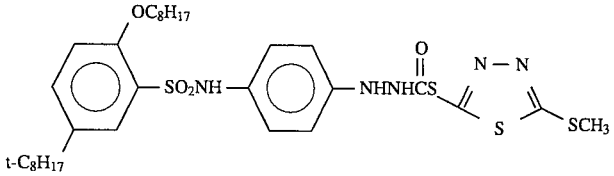
(III-I-37)
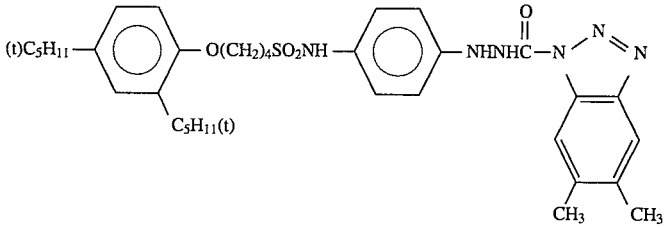
(III-I-38)
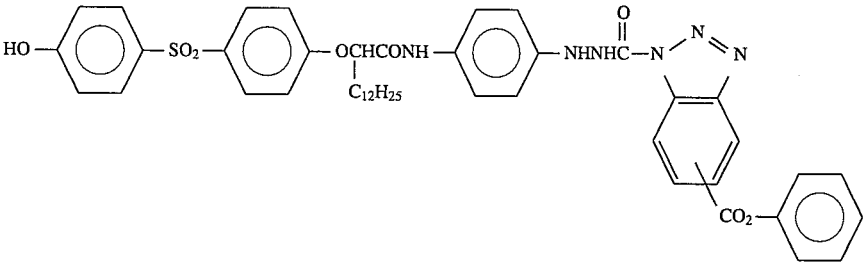
(III-I-39)
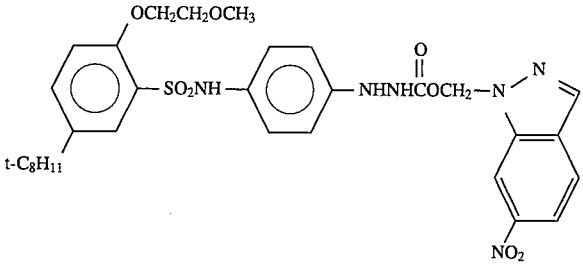
(III-I-40)
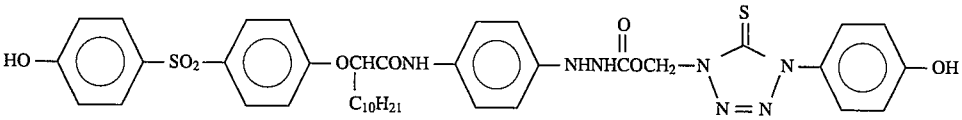
(III-I-41)
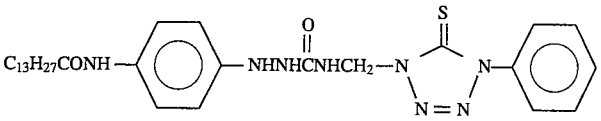
(III-I-42)
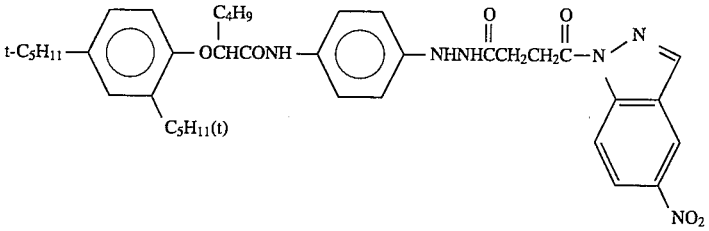
(III-I-43)

-continued
(III-I-44)
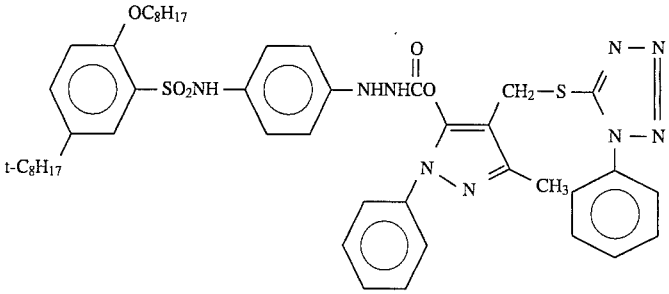
(III-I-45)
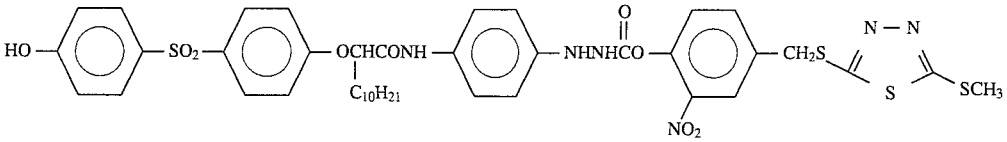
(III-I-46)
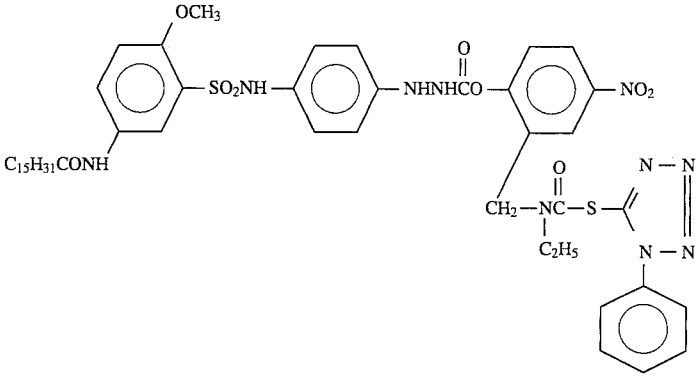
(III-I-47)
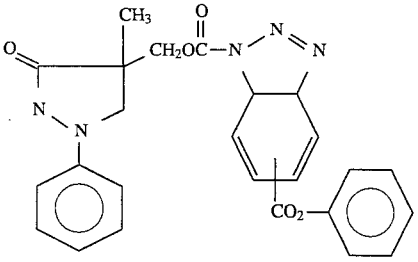
(III-I-48)
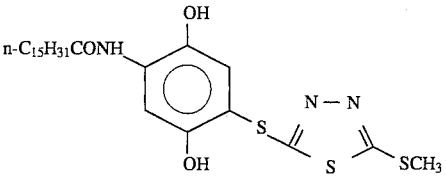
(III-I-49)
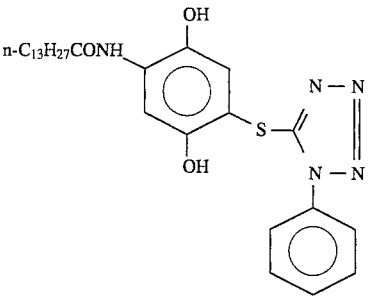

-continued
(III-I-50)
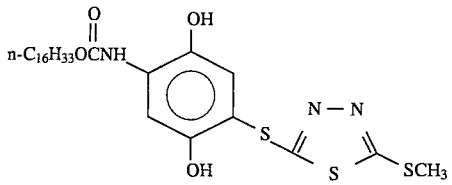
(III-I-51)
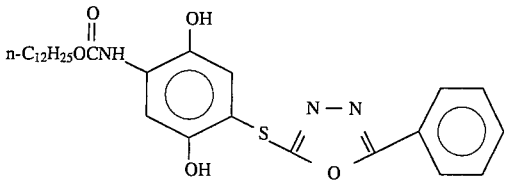
(III-I-52)
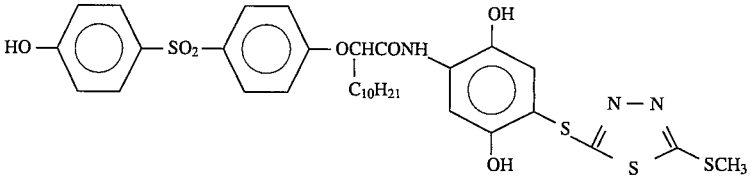
(III-I-53)
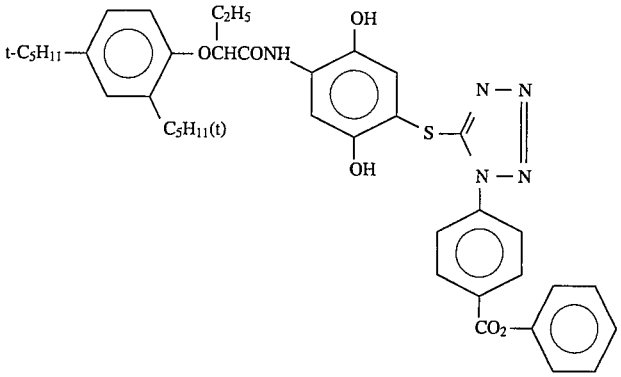
(III-I-54)
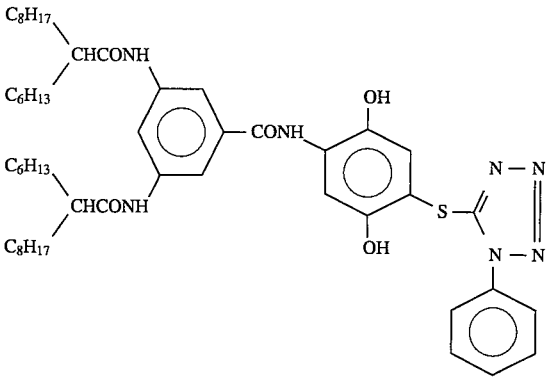
(III-I-55)
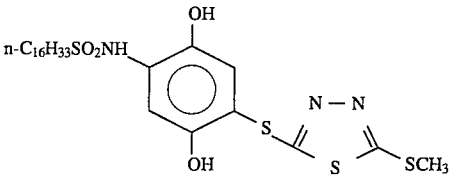

-continued
(III-I-56)
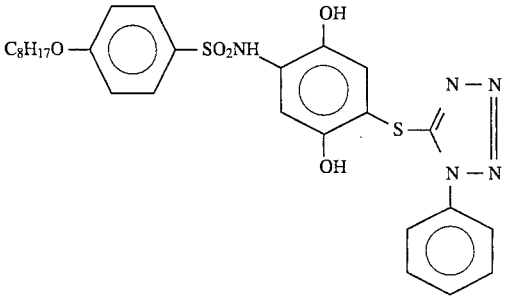
(III-I-57)
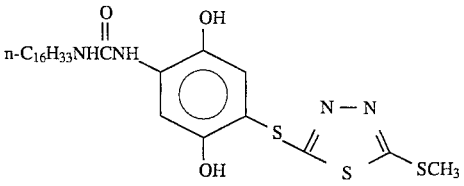
(III-I-58)
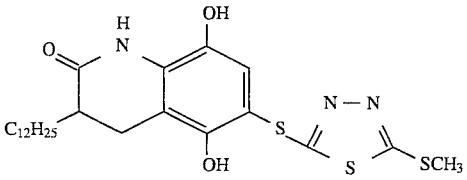
(III-I-59)
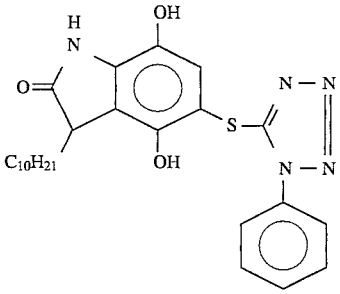
(III-I-60)
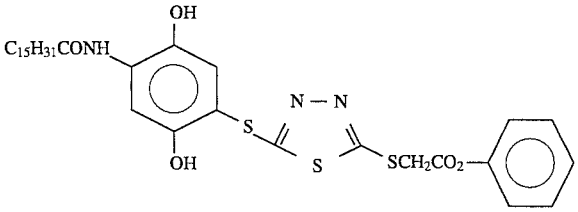
(III-I-61)
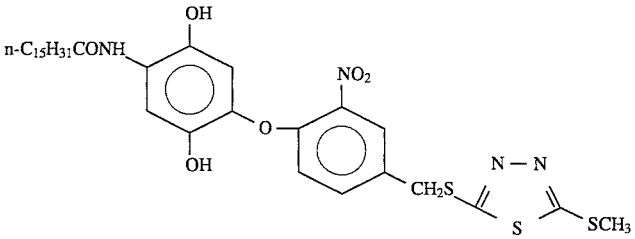
(III-I-62)
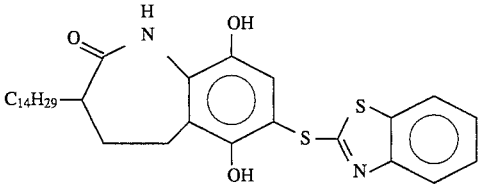

-continued
(III-I-63)
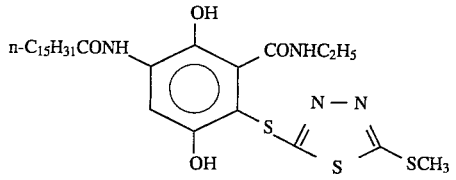
(III-I-64)
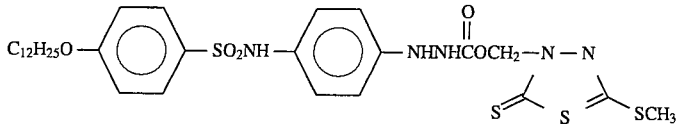
(III-I-65)
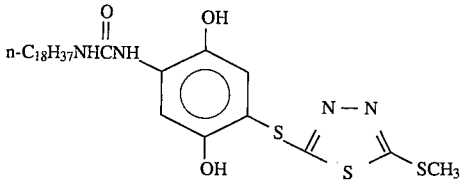
(III-I-66)
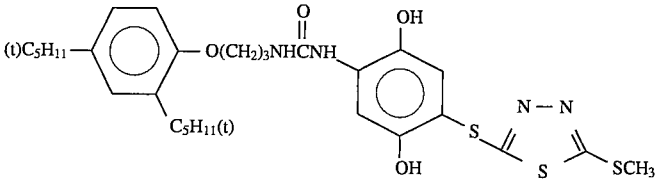
(III-I-67)
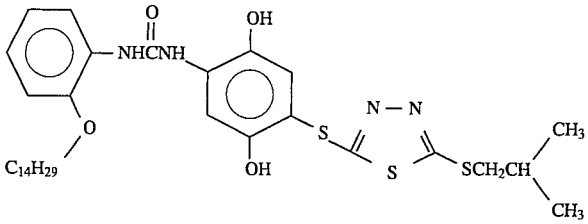
(III-I-68)
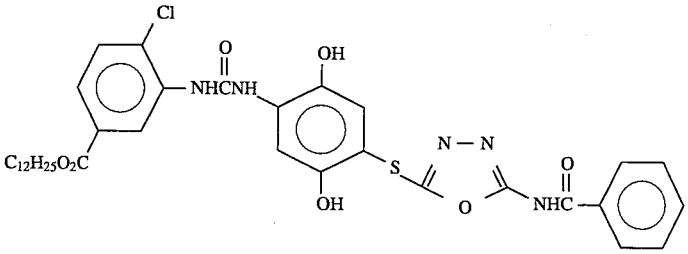
(III-I-69)
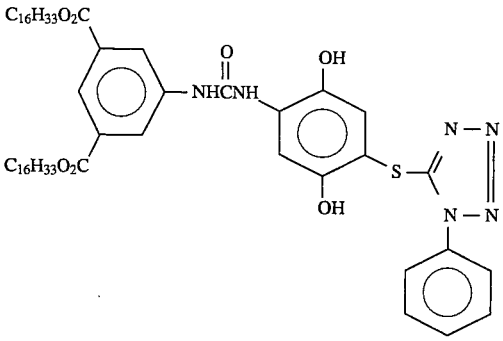

-continued
(III-I-70)
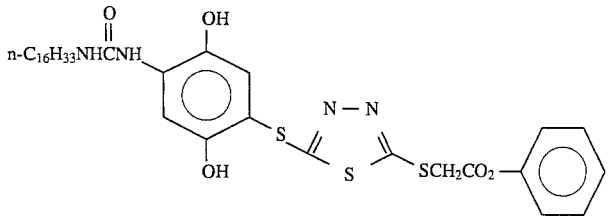
(III-I-71)
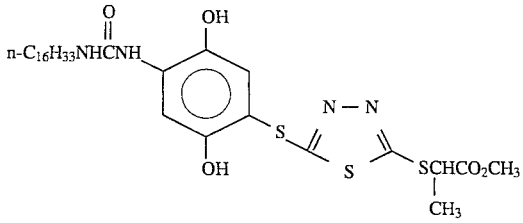
(III-I-72)
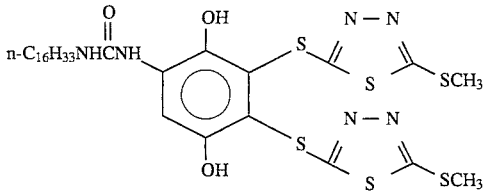
(III-I-73)
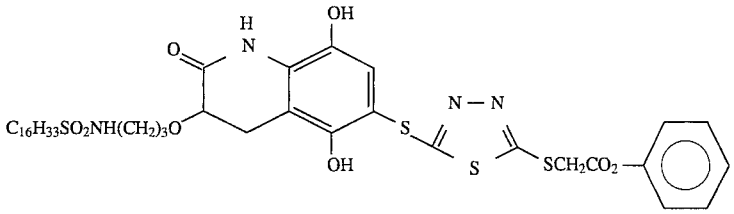
(III-I-74)
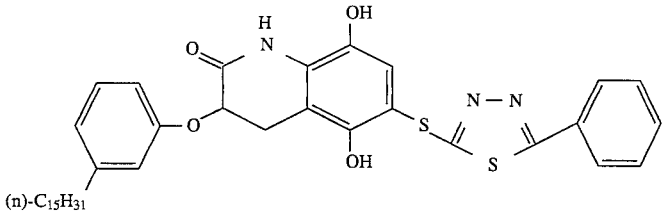
(III-I-75)
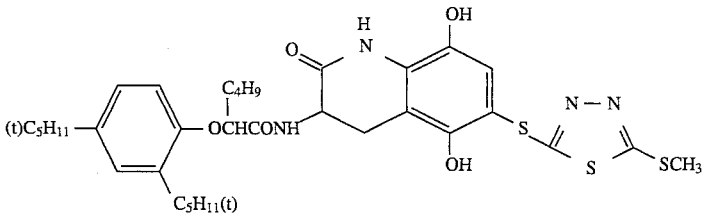
(III-I-76)
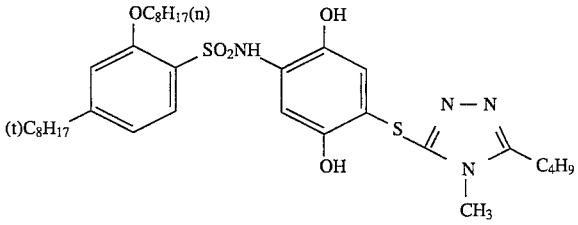

-continued
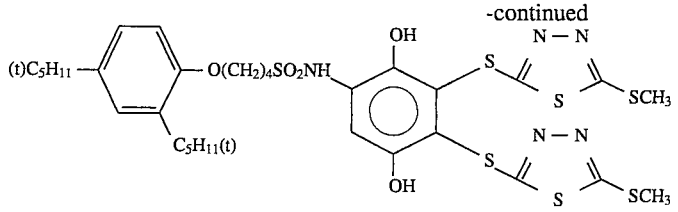
(III-I-77)
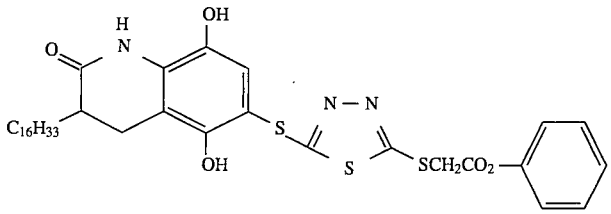
(III-I-78)
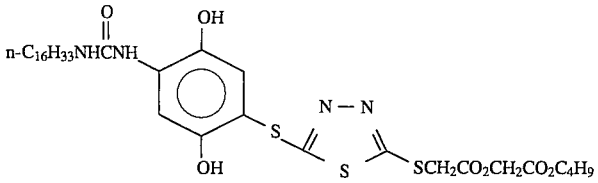
(III-I-79)
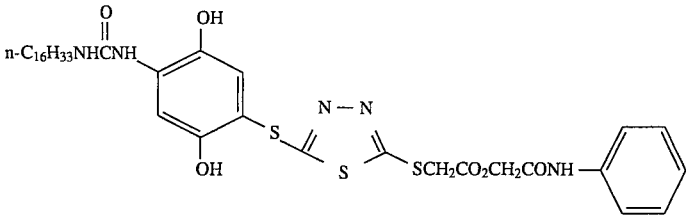
(III-I-80)
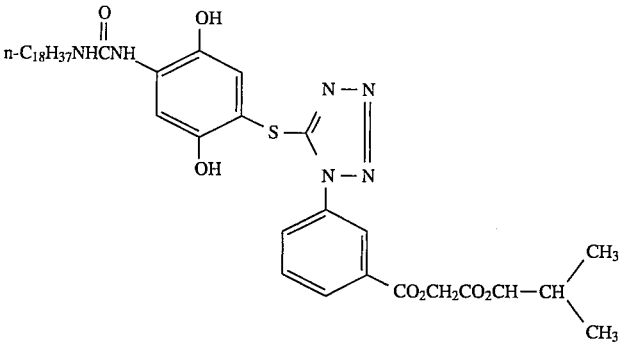
(III-I-81)
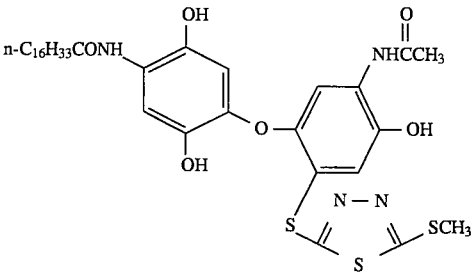
(III-I-82)

-continued
(III-I-83)
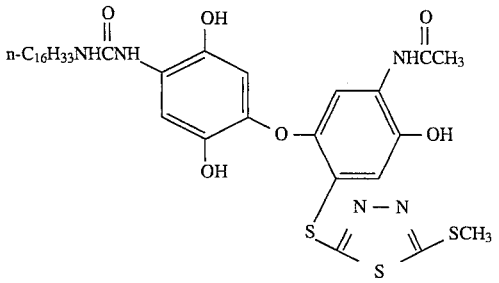
(III-I-84)
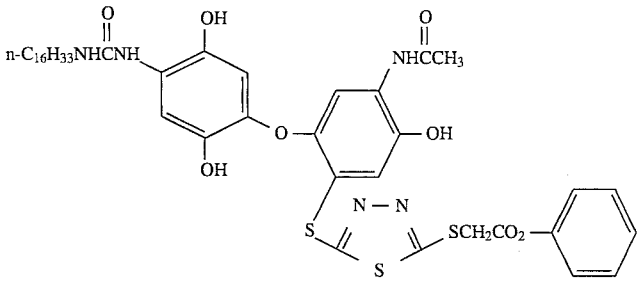
(III-I-85)
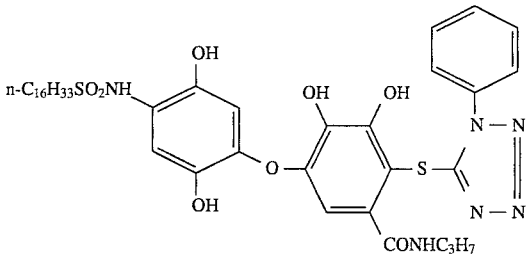
(III-I-86)
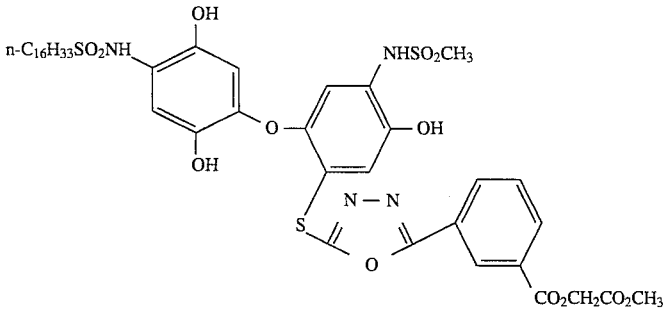
(III-I-87)
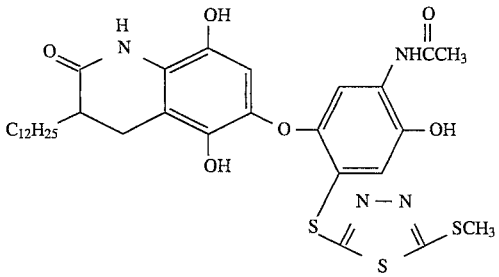
(III-I-88)
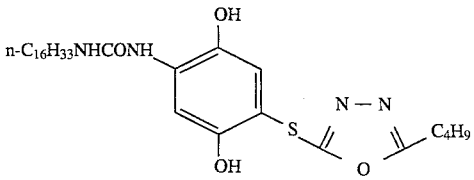
The compound represented by the formula (III-I) can be synthesized by the methods disclosed in JP-A-49-129536, JP-A-52-57828, JP-A-60-21044, JP-A-60-233642, JP-A-60-233648, JP-A-61-18946, JP-A-61-156043, JP-A-61-213847, JP-A-61-230135, JP-A-61-236549, JP-A-62-

62352, JP-A-62-103639, and U.S. Pat. Nos. 3,379,529, 3,620,746, 4,332,828, 4,377,634 and 4,684,604.

A compound represented by Formula (III-I) may be added to any emulsion layer and/or any non-light-sensitive layer. The addition amount is preferably 0.001 to 0.2 mmol/$m^2$, and more preferably 0.01 to 0.1 mmol/$m^2$.

Next, the iodide ion-releasing agent of the invention represented by the formula (II-I) will be described in detail.

In the formula (II-I), X represents an iodine atom. Each of $R_{111}$, $R_{112}$ and $R_{113}$ represents a hydrogen atom or a substituent. $R_{111}$, $R_{112}$ and $R_{113}$ may be combined together to form a carbocyclic or heterocyclic ring. i is an integer of 1 to 5.

Examples of the substituent represented by $R_{111}$, $R_{112}$ or $R_{114}$ are: a halogen atom (e.g., fluorine, chlorine, bromine, or iodine), an alkyl group (e.g., methyl, ethyl, n-propyl, isopropyl, t-butyl, n-octyl, cyclopentyl, or cyclohexyl), an alkenyl group (e.g., allyl, 2-butenyl, or 3-pentenyl), an alkynyl group (e.g., propargyl or 3-pentynyl), an aralkyl group (e.g., benzyl or phenethyl), an aryl group (e.g., phenyl, naphthyl, or 4-methylphenyl), a heterocyclic group (e.g., pyridyl, furyl, imidazolyl, piperiodyl, or morpholyl), an alkoxy group (e.g., methyoxy, ethoxy, or butoxy), an aryloxy group (e.g., phenoxy or naphthoxy), an amino group (e.g., unsubstituted amino, dimethylamino, ethylamino, and anilino), an acylamino group (e.g., acetylamino and benzoylamino), a ureido group (e.g., unsubstituted ureido, N-methylureido, and N-phenylureido), a urethane group (e.g., methoxycarbonylamino and phenoxycarbonylamino), a sulfonylamino group (e.g., methylsulfonylamino and phenylsulfonylamino), a sulfamoylamino group (e.g., sulfamoyl, N-methylsulfamoyl, and N-phenylsulfamoyl), a carbamoyl group (e.g., carbamoyl, diethylcarbamoyl, and phenylcarbamoyl)a sulfonyl group (e.g., methylsulfonyl and benzenesulfonyl), a sulfinyl group (e.g., methylsulfinyl and phenylsulfinyl), an alkyloxycarbonyl group (e.g., methoxycarbonyl and ethoxycarbonyl), an aryloxycarbonyl group (e.g., phenoxycarbonyl), an acyl group (e.g., acetyl, benzoyl, formyl, and pivaloyl), an acyloxy group (e.g., acetoxy and benzoyloxy), an amidophosphoryl group (e.g., N,N-diethylamido-phosphoryl), an alkylthio group (e.g., methylthio and ethylthio), an arylthlo group (e.g., a phenylthio), a cyano group, sulfo group, a carboxyl group, a hydroxy group, a phosphono group, or a nitro group.

In the case where $R_{112}$ and $R_{113}$ exist in the number of two or more each (i=2 to 5), the groups $R_{112}$ may be either identical or different, and so may be the groups $R_{113}$.

These groups may have one or more substituent groups. If they have two or more substituent groups, these substituent groups may be identical or different.

A carbocyclic ring or a heterocyclic ring, which $R_{111}$, $R_{112}$ and $R_{113}$ form when linked together, is a 5to 7-membered carbocyclic ring or a 5- to 7-membered heterocyclic ring containing one or more nitrogen, oxygen or sulfur atoms. The carbocyclic ring or the heterocyclic ring include one which is fused at an appropriate position. Rings which can be exemplified as these rings are: cyclopentane, cyclohexane, cycloheptane, cyclopentene, cyclohexene, benzene, naphthalene, imidazole, pyridine, thlophene, quinoline, 4-pyridone, 2-pyrone, coumarin, uracil, and cyclopentanedione. The carbocyclic ring or the heterocyclic ring may be substituted. If two or more substituent groups are present, they may either be the same or different.

In the formula (II-1), it is desirable that i=1 to 3. More preferably, i=1 or 2.

Of the compounds of the formula (II-I), preferable are those which are represented by the following formula (II-II):

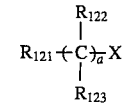

Formula (II-II)

where X represents an iodine atom, $R_{121}$ represents a hydrogen atom or an organic group having a Hammett's $\sigma_p$ constant of 0 or less, and each of $R_{122}$ and $R_{123}$ represents a hydrogen atoms or a substituent group. The groups $R_{121}$, $R_{122}$ and $R_{123}$ may link together to form a carbon ring or a heterocyclic ring. a represents 1, 2 or 3.

The formula (II-II) will be explained in detail.

As described above, $R_{121}$ represents a hydrogen atom or an organic group having a Hammett's $\sigma_p$ constant of 0 or less. The Hammett's $\sigma_p$ constant can be selected from the table contained in "Structure-Activity Correlation of Medicines," Nankodo, pp. 96 (1979). Preferable as $R_{121}$ are: a hydrogen atom, $OR_{124}$ ($R_{124}$ represents a hydrogen atom, an alkyl group, an alkenyl group, an alkynyl group, an aralkyl group, or an aryl group), $NR_{125}R_{126}$ ($R_{125}$ and $R_{126}$ represent each a hydrogen atom, an alkyl group, an alkenyl group, an alkynyl group, an aralkyl group, an aryl group, an acyl group, a carbamoyl group, an oxycarbonyl group, or a sulfonyl group, and $R_{125}$ and $R_{126}$ may link together to from a substituted or unsubstituted nitrogen-containing heterocyclic ring), or $SR_{127}$ ($R_{127}$ represents a hydrogen atom, an alkyl group, an alkenyl group, an alkynyl group, an aralkyl group, or an aryl group). The Hammett's $\sigma_p$ constant for $R_{121}$ is preferably −0.85 to 0.0.

In the formula (II-II), the alkyl group, the alkenyl group and the alkynyl group, which are represented by $R_{124}$, $R_{125}$, $R_{126}$ and $R_{127}$, are those having 1 to 30 carbon atoms. Of these groups, particularly preferable are straight chain, branched or cyclic groups which have 1 to 10 carbon atoms. Specific examples of the alkyl, alkenyl and alkynyl groups are: methyl, ethyl, n-propyl, isopropyl, t-butyl, n-octyl, n-decyl, n-hexadecyl, cyclopentyl, eyclohexyl, allyl, 2-butenyl, 3-pentenyl, propargyl, and 3-pentynyl.

In the formula (II-II), the aralkyl groups represented by $R_{124}$, $R_{125}$, $R_{126}$ and $R_{127}$ are those having 7 to 30 carbon atoms, preferably those having 7 to 10 carbon atoms. Specific examples of the aralkyl groups are benzyl, phenethyl, and naphthylmethyl.

In the formula (II-II), the aryl groups represented by $R_{124}$, $R_{125}$, $R_{126}$ and $R_{127}$ are those having 6 to 30 carbon atoms, preferably those having 6 to 10 carbon atoms. Specific examples of the aryl groups are phenyl and naphthyl.

In the formula (II-II), the acyl groups represented by $R_{125}$ and $R_{126}$ are those having 1 to 30 carbon atoms, preferably those having 1 to 10 carbon atoms. Specific examples of the acyl groups are: formyl, acetyl, butyryl, pivaloyl, myristoyl, acryloyl, benzoyl, toluoyl, and naphthoyl.

In the formula (II-II), the carbamoyl groups represented by $R_{125}$ and $R_{126}$ are those having 1 to 30 carbon atoms, preferably those having 1 to 10 carbon atoms. Specific examples of the carbamoyl groups are: unsubstituted carbamoyl, methylcarbamoyl, diethylcar bamoyl, and phenylcarbamoyl.

In the formula (II-II), the oxycarbonyl groups represented by $R_{125}$ and $R_{126}$ are those having 2 to 30 carbon atoms, preferably those having 2 to 10 carbon atoms. Specific examples of the oxycarbonyl groups are methoxycarbonyl, ethoxycarbonyl, and phenoxycarbonyl.

In the formula (II-II), the sulfonyl groups represented by $R_{125}$ and $R_{126}$ are those having 1 to 30 carbon atoms, preferably those having 1 to 10 carbon atoms. Specific examples of the sulfonyl groups are methanesulfonyl, ethanesulfonyl, and benzensulfonyl.

Heterocyclic rings which can be exemplified as saturated or unsaturated nitrogen-containing heterocyclic ring which $R_{125}$ and $R_{126}$ form when they link together are: morpholine, pyrrolydine, piperazine, pyrrol, pirazole, imidazole, triazole, tetrazole, indole, benzotriazole, succinimide, and phthalimide. These heterocyclic rings may be further substituted. Specific examples of the substituent groups are identical to those exemplified as $R_{111}$, $R_{112}$ and $R_{113}$.

In the formula (II-II), the alkyl group, the alkenyl group, the alkynyl group, the aralkyl group, or the aryl group represented by any of $R_{124}$, $R_{125}$, $R_{126}$ and $R_{127}$, and the acyl group, the carbamoyl group, the oxycarbonyl group, or the sulfonyl group represented by $R_{125}$ or $R_{126}$ may be further substituted. The specific examples of the substituent groups are identical to those exemplified as $R_{111}$, $R_{112}$ and $R_{113}$.

In the formula (II-II), particular preferable as $R_{121}$ are $OR_{124}$ and $NR_{125}R_{126}$.

In the formula (II-II), the substituent groups represented by $R_{122}$ and $R_{123}$ are identical to those exemplified as $R_{112}$ and $R_{113}$. Preferable as each of these groups are: an alkyl group, an aralkyl group, an aryl group, a sulfo group, an carboxy group, a phosphono group, a sulfamoyl group, a carbamoyl group, a sulfonyl group, a sulfinyl group, an alkyloxycarbonyl group, aryloxycarbonyl group, an acyl group, a cyano group, and a group represented by $R_{121}$. Of these, particularly preferable are an alkyl group, an aralkyl group, an aryl group, a sulfo group, a carboxy group, a phosphono group, and a group represented by $R_{121}$.

In the formula (II-II), a is preferably 1 or 2.

Specific examples of the iodide ion-releasing agent represented by the formula (II-I) will be descried in the following. However, the compounds used in the invention are not limited to these.

$ICH_2COOH$ (II-I-1)

$ICH_2CONH_2$ (II-I-2)

$ICH_2CN$ (II-I-3)

$I(CH_2)_2COOH$ (II-I-4)

$I(CH_2)_3COOH$ (II-I-5)

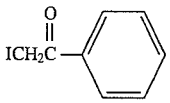
(II-I-6)

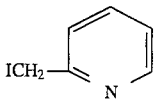
(II-I-7)

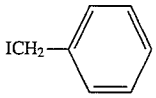
(II-I-8)

$I(CH_2)_2SO_3Na$ (II-I-9)

$I(CH_2)_2SO_2CH_3$ (II-I-10)

$I(CH_2)_2OH$ (II-I-11)

$I(CH_2)_3OH$ (II-I-12)

$I(CH_2)_4OH$ (II-I-13)

-continued $ICH_2CHOH$ (II-I-14)
$CH_3$ $ICH_2CHOH$ (II-I-15)

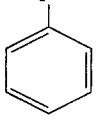

$ICH_2CHCH_2OH$ (II-I-16)
OH $ICH_2CHCH_2SO_3Na$ (II-I-17)
OH

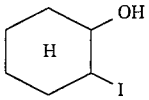
(II-I-18)

$ICH_2CHCHCH_2I$ (II-I-19)
OHOH

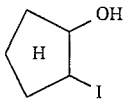
(II-I-20)

ICHCOOH (II-I-21)

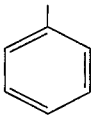

$I(CH_2)_2SO_2CH_2COOH$ (II-I-22)

$I(CH_2)_2NH_2$ (II-I-23)

$I(CH_2)_2NHSO_2CH_3$ (II-I-24)

$I(CH_2)_2NHCOCH_3$ (II-I-25)

$I(CH_2)_2OCH_3$ (II-I-26)

$I(CH_2)_2SCH_3$ (II-I-27)

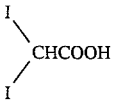
(II-I-28)

$ICH_2CHCH_2I$ (II-I-29)
OH $I(CH_2)_2SO_2NH_2$ (II-I-30)

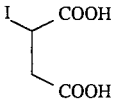
(II-I-31)

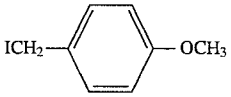
(II-I-32)

(II-I-33)
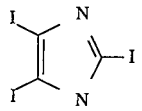
(II-I-34)
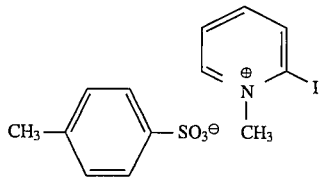
(II-I-35)
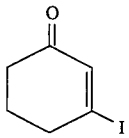
(II-I-36)
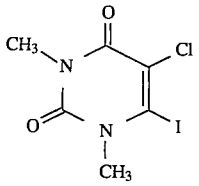
(II-I-37)
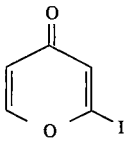
(II-I-38)
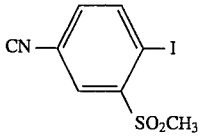
(II-I-39)
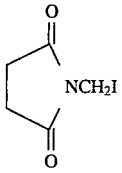
(II-I-40)
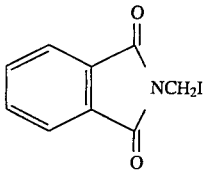
(II-I-41)
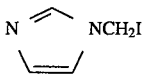
(II-I-42)
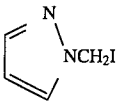
(II-I-43)
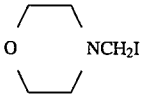
(II-I-44)
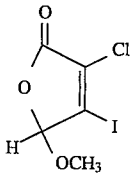
(II-I-45)
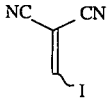
(II-I-46)
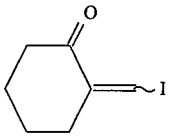
(II-I-47) $I(CH_2)_5COOH$
(II-I-48)
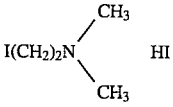
(II-I-49) $I(CH_2)_2NCH_3SO_2CH_3$
(II-I-50) $I(CH_2)_2OCOCH_3$
$I(CH_2)_2NCH_3COCH_3$
(II-I-51)
(II-I-52)
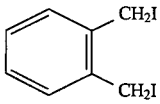
(II-I-53)
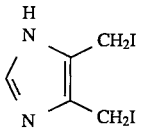
(II-I-54)
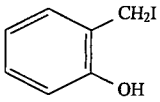
(II-I-55)
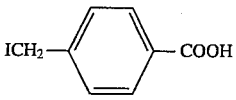
(II-I-56)
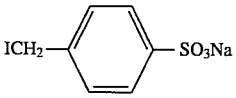
(II-I-57) $ICH_2CONH(CH_2)_2-SO_3Na$
(II-I-58)
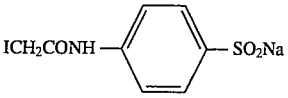
(II-I-59)
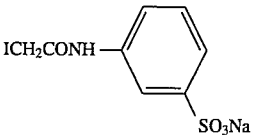

-continued

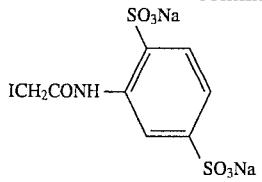

(II-I-60)

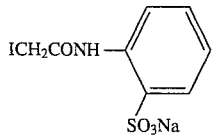

(II-I-61)

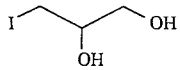

(II-I-62)

The iodide ion-releasing agent of the invention can be synthesized by the methods described in the following literatures:

J. Am. Chem. Soc., 76, 3227–8 (1954), J. Org. Chem., 16, 708 (1951), Chem. Ber., 97, 390 (1964), Org. Synth., V, 478 (1973), J. Chem. Soc., 1951, 1851, J. Org. Chem., 19, 1571 (1954), J. Chem. Soc., 1952, 142, J. Chem. Soc., 1955, 1383, Angew. Chem., Int. Ed., 11, 229 (1972), Chem. Commun., 1971, 1112.

The silver halide emulsion according to this invention is manufactured under controlled release of iodide ions from the iodide ion-releasing agent.

"Under controlled release of iodide ions" means that the speed and timing of release of iodide ions from the iodide ion-releasing agent are controlled, by changing the pH of the solution, the concentration of a nucleophilic substance used together, and/or the temperature of the solution.

In the formula (II-I.), groups are selected for $R_{111}$, $R_{112}$, and $R_{113}$ in accordance with the pH, composition and temperature of the solution during formation of silver halide grains and the necessary timing period.

The speed and timing of releasing iodide ions can be controlled over a broad range, not only by changing the pH of the solution at the time of forming grains, but also by utilizing a nucleophilic substance such as sulfite ions, hydroxylamine, thiosulfate ions, metabisulfite ions, hydroxsamic acids, oximes, and dihydroxybenzene.

The iodide ion-releasing agent of the present invention is added in an amount of 0.5 to 15 mol % of all silver halide. Preferably, it is used in an amount of 0.5 to 10 mol %, more preferably in an amount of 0.5 to 5 molt.

In the case where a nucleophilic substance is also used, it is added in an molar ratio of 1:1 to 1:20 with respect to the iodide ion-releasing agent. Preferably, it is added in a molar ratio of 1:1 to 1:10, more preferably in a molar ratio of 1:1 to 1:5. When the nucleophilic substance is used, and the release of iodide ions from the iodide ion-releasing agent is controlled or adjusted by the change of a concentration of the nucleophilic substance, the concentration of the nucleophilic substance is so selected as to obtain optimal release rate of iodide ions and timing of the release. The concentration of the nucleophilic substance is selected depending on the kind of the releasing agent and nucleophilic substance. In the present invention, the concentration of the nucleophilic substance is changed such that iodide ions are rapidly and uniformly released from the releasing agent at a timing at which the silver halide phase is formed using the releasing agent.

In the case where the pH of the solution is changed to control the release of iodide ions, the range of pH is 4 to 12 at the time of the release of iodide ions. In the present invention, the pH should preferably be raised to 7 or more for the purpose of rapidly releasing iodide ions. More preferably, the pH should be raised to 8 or more for the same purpose.

Also in the case where a nucleophilic substance is used, the pH may be changed to control the speed and timing of releasing iodide ions.

Preferably, the temperature at which to control the release of iodide ions from the iodide ion-releasing agent of the present invention ranges from 30° to 80° C. Iodide ions are released from the agent while the temperature is controlled appropriately. When the release of the iodide ions from the iodide ion-releasing agent is controlled or adjusted by the change of the temperature, the temperature is changed to match with the release rate and timing. Usually, the temperature is raised when the release rate of iodide ions is increased, while the temperature is lowered when the release rated is decreased or the release is substantially ceased. The temperature is optimally selected in view of the structure of the releasing agent, the pH of the solution, and the concentration of the nucleophilic agent used.

At the time of controlling the release of iodide ions in the present invention, bromide ions and/or chloride ions may exist in the solution.

In the present invention, all iodine may be released from the iodine-ion releasing agent, or part of the agent may remain not decomposed.

The release of iodide ions is controlled in the present invention, preferably in the following method.

Namely, iodide ions are released uniformly, within a grain-forming vessel, from the iodide-ion releasing agent already added to, and uniformly distributed throughout, the bulk solution (reaction solution) contained in the grain-forming vessel, by changing the pH of the solution, the concentration of the nucleophilic substance used, and/or the temperature of the solution, preferably by raising the pH from low to high.

An alkali used for increasing the pH at the time of releasing iodide ions, and the nucleophilic substance should preferably be added when the iodide ion-releasing agent is uniformly distributed in the entire solution. Any alkali may be used, and may include NaOH, KOH and $NH_3$.

It would be preferable to add the alkali and/or the nucleophilic substance to the solution at a constant flow rate, than to add them at a time. The flow rate may be controlled in order to release iodide ions from the agent appropriately.

The pH is changed preferably withing a period of 0.01 second to 5 minutes, more preferably 0.1 second to 2 minutes for one unit ($\Delta pH=1.0$).

The time, which is required for forming a silver halide phase by using the iodide ion-releasing agent of this invention, should preferably be 20 minutes or less, more preferably 10 minutes or less, and most preferably 1 second to 5 minutes.

The present invention is characterized in that iodine ions are released uniformly throughout the entire bulk solution contained in the grain-forming vessel, thereby rapidly forming a silver halide phase having a high iodide content.

If the conventional KI aqueous solution is used as iodide ion source, the iodide ions will be added, in free state, into the bulk solution. In this instance, the iodide ion concentration become non-uniform microscopically in the solution. This makes it difficult to uniformly grow a silver halide phase containing iodide in silver halide grain.

In a method using fine grains of silver iodide as a source of iodide ions, the fine grains are hard to be dissolved. It is therefore impossible to form a high-iodide silver halide phase at a high speed, while con trolling the supply of iodide ions.

An iodide ion-releasing agent similar to the type of the present invention is disclosed in JP-A-2-68538. However, the method of JP-A-2-68538 differs from the present invention in that iodide ions are released under constant conditions to form a silver halide phase containing iodide which remains uniformly distributed throughout the growth of grains, starting from the nucleus-forming step.

In other words, the method disclosed in JP-A-2-68538 is to release iodide ions gradually under a constant condition throughout the formation of silver halide, whereas the release of iodide ions is controlled such that iodide ions are released uniformly and rapidly at a certain timing during the forming of grains in the invention.

Due to the controlled uniform release of iodide ions, which is achieved in this invention, it is possible to release iodide ions, at high speed at a specific timing, uniformly in the entire bulk solution contained in a reaction vessel. By so doing, a silver halide phase containing silver iodide is formed uniformly within each grain and among grains, thereby achieving the object of the present invention.

The silver halide grains used in this invention are made of silver chloroiodide, silver bromoiodide, or silver bromochloroiodide. Other silver salts, such as silver rhodanide, silver sulfide, sliver selenide, silver carbonate, silver phosphate, organic acid silver, may be contained as other grains or as parts of silver halide grains.

The grains according to the present invention contains at least one phase selected from the group consisting of a silver bromoiodide phase, a silver chloroiodide and a silver bromochloroiodide phase.

When to form any of these phases during the forming of grains is arbitrary. The phase may be formed in the center portion of the silver halide grain, or in the entirety thereof, or in the surface thereof. A plurality of silver halide phases may be formed.

If a plurality of silver halide phases are formed in the grain, the grain will have a layered structure in many cases because of the mechanism of grain forming. Nonetheless, the phases can be formed in specific portions of the grain. For example, silver halide phases can be formed in only the edges or corners of the grain, taking advantage of the difference in property between the edge and corner of the grain.

The content of silver iodide contained in these phases is 1 to 45 mol %, preferably 5 to 40 mol %.

In a silver halide grain in which two or more silver halides are present as a mixed crystal or with a structure, it is important to control the distribution of halogen compositions among grains. A method of measuring the distribution of halogen compositions among grains is described in JP-A-60-254032. A uniform halogen distribution among the grains is a desirable characteristic. In particular, a highly uniform emulsion having a variation coefficient of 20% or less is preferable. An emulsion having a correlation between a grain size and a halogen composition is also preferable. An example of the correlation is that larger grains have higher iodide contents and smaller grains have lower iodide contents. An opposite correlation or a correlation with respect to another halogen composition can also be selected in accordance with the intended use. For this purpose, it is preferable to mix two or more emulsions having different compositions.

It is important to control the halogen composition near the surface of a grain. Increasing the silver iodide content or the silver chloride content near the use because this changes a dye absorbing property or a developing rate. In order to change the halogen composition near the surface, it is possible to use either the structure in which a grain is entirely surrounded by a silver halide or the structure in which a silver halide is adhered to only a portion of a grain. For example, a halogen composition of only one of a (100) face and a (111) face of a tetradecahedral grain may be changed, or a halogen composition of one of a major face or a side face of a tabular grain may be changed.

Silver halide grains for use in the emulsions of the present invention and emulsions to be used together with the emulsions of the present invention can be selected in accordance with the intended use. Examples are a regular crystal not containing a twin plane and crystals explained in Japan Photographic Society ed., The Basis of Photographic Engineering, Silver Salt Photography (CORONA PUBLISHING CO., LTD.), page 163, such as a single twinned crystal containing one twin plane, a parallel multiple twinned crystal containing two or more parallel twin planes, and a nonparallel multiple twinned crystal containing two or more nonparallel twin planes. A method of mixing grains having different shapes is disclosed in U.S. Pat. No. 4.865,964. So this method can be selected as needed. In the case of a regular crystal, it is possible to use a cubic grain constituted by (100) faces, an octahedral grain constituted by (111) faces, or a dodecahedral grain constituted by (110) faces disclosed in JP-B-55-42737 or JP-A-60-222842. It is also possible to use, in accordance with the intended use of an emulsion, an (hll) face grain represented by a (211) face, an (hhl) face grain represented by a (331) face, an (hkO) face grain represented by a (210) face, or an (hkl) face grain represented by a (321) face, as reported in Journal of Imaging Science. vol. 30, page 247, 1986, although the preparation method requires some improvements. A grain having two or more different faces, such as a tetradeca hedral grain having both (100) faces and (111) faces, a grain having (100) faces and (110) faces, or a grain having (111) faces and (110) faces can also be used in accordance with the intended use of an emulsion.

A value obtained by dividing the equivalent-circle diameter of the projected area of a grain by the thickness of that grain is called an aspect ratio that defines the shape of a tabular grain. Tabular grains having aspect ratios higher than 1 can be used in the present invention. Tabular grains can be prepared by the methods described in. e.g., Cleve. Photography Theory and Practice (1930), page 131: Gutoff, Photographic Science and Engineering, vol. 14. pages 248 to 257, (1970), and U.S. Pat. Nos. 4,434,226, 4,414,310, 4,433,048, and 4,439,520, and British Patent 2,112,157. The use of tabular grains brings about advantages, such as an increase in coating adhesion and a enhancement in the efficiency of color sensitization due to sensitizing dyes. These advantages are described in detail in U.S. Pat. No. 4,434,226 cited above. An average aspect ratio of 80% or more of a total projected area of grains is preferably 1 to 100, more preferably 2 to 20, and most preferably 3 to 10. The shape of a tabular grain can be selected from, e.g., a triangle, a hexagon, and a circle. An example of a preferable shape is a regular hexagon having six substantially equal sides, as described in U.S. Pat. No. 4,797,354.

The equivalent-circle diameter of a tabular grain is preferably 0.15 to 5.0 μm. The thickness of a tabular grain is preferably 0.05 to 1.0 μm.

It is desirable that the tabular grains having aspect ratio of 2 or more occupy 50% or more, preferably 80% or more, and more preferably 90% or more, of the total projected area of all grains.

It is sometimes possible to obtain more preferable effects by using monodispersed tabular grains. The structure and the method of manufacturing monodispersed tabular grains are described in. e.g., JP-A-63-151618. The shape of the grains will be briefly described below. That is, a hexagonal tabular silver halide, in which the ratio of an edge having the maximum length with respect to the length of an edge having the minimum length is 2 or less, and which has two parallel faces as outer surfaces, accounts for 70% or more of the total projected area of silver halide grains. In addition, the grains have monodispersivity; that is, a variation coefficient of a grains size distribution of these hexagonal tabular silver halide grains (i.e., a value obtained by dividing a variation (standard deviation) in grain sizes, which are represented by equivalent-circle diameters of projected area of the grains, by their average grains size) is 20% or less.

Dislocation lines of a tabular grain can be observed by using a transmission electron microscope. It is preferable to select a grain containing no dislocation lines, a grain containing several dislocation lines, or a grain containing a large number of dislocation lines in accordance with the intended use. It is also possible to select dislocation lines introduced linearly with respect to a specific direction of a crystal orientation of a grain or dislocation lines curved with respect to that direction. Alternatively, it is possible to selectively introduce dislocation lines throughout an entire grain or only to a particular portion of a grain, e.g., the fringe portion of a grain. Introduction of dislocation lines is preferable not only for tabular grains but for a regular crystal grain or an irregular grain represented by a potato-like grain. Also in this case, it is preferable to limit the positions of dislocation lines to specific portions, such as the corners or the edges, of a grain.

A silver halide emulsion used in the present invention may be subjected to a treatment for rounding grains, as disclosed in EP 96,727B1 or EP 64,412B1, or surface modification, as disclosed in West German Patent 2,306, 447C2 or JP-A-60-221320.

Although a flat grain surface is common, intentionally forming concavo-convex on the surface is preferable in some cases. Examples are a methods described in JP-A-58-106532 and JP-A-60-221320, in which a hole is formed in a portion of a crystal, e.g., the corner or the center of the face of a crystal, and a ruffle grain described in U.S. Pat. No. 4,643,966.

The grain size of an emulsion used in the present invention can be evaluated in terms of the equivalentcircle diameter or rne projected area of a grain obtained by using an electron microscope, the equivalent-sphere diameter of the volume of a grain calculated from the projected area and the thickness of the grains, or the equivalent-sphere diameter of the volume of a grain obtained by a Coulter counter method. It is possible to selectively use various grains from a very fine grain having an equivalent-sphere diameter of 0.05 μm or less to a large grain having that of 10 μm or more. It is preferable to use a grain having an equivalent-sphere diameter of 0.1 to 3 μm as a light-sensitive silver halide grain.

In the present invention, it is possible to use a so-called polydisperse emulsion having a wide grain size distribution or a monodisperse emulsion having a narrow grains size distribution in accordance with the intended use. As a measure representing the size distribution, a variation coefficient of either the equivalent-circle diameter of the projected area of a grain or the equivalent-sphere diameter of the volume of a grain is sometimes used. When a monodisperse emulsion is to be used, it is desirable to use an emulsion having a size distribution with a variation coefficient of preferably 25% or less, more preferably 20% or less, and most preferably 15% or less.

The monodisperse emulsion is sometimes defined as an emulsion having a grain size distribution in which 80% or more by number or by weight of all grains fall within a range of ±30% of an average grain size. In order for a light-sensitive material to satlsfy its target gradation, two or more monodispersed silver halide emulsions having different grain sizes can be mixed in the same emulsion layer or coated as different layers in an emulsion layer having essentially the same color sensitivity. It is also possible to mix, or coat as different layers, two or more types of polydisperse silver halide emulsions or monodisperse emulsions together with polydisperse emulsions.

Photographic emulsions used in the present invention and other photographic emulsions used together with the photographic emulsions of the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by a reaction of a soluble silver salt and a soluble halogen salt. any of a single-jet method, a double-jet method, and a combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which a crystal shape is regular and a grain size is nearly uniform.

In some cases, it is preferable to make use of a method of adding silver halide grains already formed by precipitation to a reactor vessel for emulsion preparation, and the methods described in U.S. Pat. Nos. 4,334,012. 4,301,241, and 4,150, 994. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, EP 273,429 and EP 273,430, and West German Patent 3,819,241. This method is an effective grain formation method. To convert into a silver salt which can hardly be dissolved, it is possible to add a solution of a soluble halogen salt or silver halide grains. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent 1,469,480 and U.S. Pat. Nos. 3,650,757 and 4,242,445. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added or a plurality of soluble halogen salts of different solution compositions are to be added, a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and west German Patents 2,556,885 and 2,555,364.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of silver and halide salts, or can be introduced to the reactor vessel simultaneously with addition of a haldie salt, a silver salt, or a deflocculant. Alternatively, ripening agents can be independently added in the step of adding a halide salt and a silver salt.

Examples of the ripening agent are, in addition to the above, ammonia, a thiocyanate salt (e.g.. potassium rhodanite and ammonium rhodanite). an organic thioether compound (e.g., compounds described in U.S. Pat. Nos. 3,574,628, 3,021,215, 3,057,724, 3,038,805, 4,276,374, 4,297,439, 3,704,130, and 4,782,013 JP-A-57-104926), a thione compound (e.g., tetra-substituted thioureas described in JP-A-53-82408, JP-A-55-77737, and U.S. Pat. Nos. 4,221,863, and compounds described in JP-A-53-144319), a mercapto compounds capable of accelerating growth of silver halide grains, described in JP-A-57-202531, and an amine compound (e.g.. JP-A-54-100717).

It is advantageous to use gelatin as a protective colloid for use in preparation of emulsions of the present invention or as a binder for other hydrophilic colloid layers. However, another hydrophilic colloid can also be used in place of gelatin. Examples of the hydrophilic colloid are protein, such as a gelatin derivative, a graft polymer of gelatin and another high polymer, albumin, and casein, a cellulose derivative, such as hydroxyethylcellulose, carboxymethylcellulose, and cellulose sulfates: sugar derivative, such as soda alginate, and a starch derivative; and a variety of synthetic hydrophilic high polymers, such as homopolymers or copolymers, e.g., polyvinyl alcohol, polyvinyl alcohol partial acetal, poly N vinylpyrrolidone, polyacrylic acid, polymethacrylic acid, polyacrylamide, polyvinylimidazole, and polyvinyl pyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash an emulsion of the present invention for a desalting purpose and disperse it in a newly prepared protective colloid. Although the temperaure of washing can be selected in accordance with the intended use, it is preferably 5° C. to 50° C. Although the pH at washing can also be selected in accordance with the intended use, it is preferably 2 to 10, and more preferably 3 to 8. The pAg at washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of an emulsion of the present invention, it is preferable to make a salt of metal ion exist during grain formation, desalting, or chemical sensitization, or before coating in accordance with the intended use. The metal ion salt is preferably added during grain formation in performing doping for grains, and after grain formation and before completion of chemical sensitization in modifying the grain surface or when used as a chemical sensitizer. The doping can be performed for any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of a salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in a combination of two or more types of them.

The metal ion salts are preferably dissolved in water or an appropriate organic solvent, such as methanol or acetone, and added in the form of a solution. To stabilize the solution, an aqueous hydrogen halide solution (e.g., HCl and HBr) or an alkali halide (e.g., KCl, NaCl, KBr, and NaBr) can be added. It is also possible to add an acid or alkali if necessary. The metal compounds can be added to a reactor vessel either before or during grain formation. Alternatively, the metal ion salts compounds can be added to a water-soluble silver salt (e.g., $AgNO_3$) or an aqueous alkali halide solution (e.g., NaCl, Kbr, and KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to add a chalcogen compound during preparation of an emulsion, as described in U.S. Pat. No. 3,772,031. In addition to S, Se, and Te, a cyanate, thiocyanate, selenocyanic acid, carbonate, phosphate, or acetate salt can be present.

In formation of silver halide grains of the present invention, at least one of sulfur sensitization, selenium sensitization, a noble metal sensitization (e.g., gold sensitization, palladium sensitization), and reduction sensitization can be performed at any point during the process of manufacturing a silver halide emulsion. The use of two or more different sensitizing methods is preferable. Several different types of emulsions can he prepared by changing the timing at which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, the location of a chemical sensitization speck can be selected in accordance with the intended use. It is, however, generally preferable to form at least one type of a chemical sensitization speck near the surface.

One chemical sensitization which can be preferably performed in the present invention is chalcogen sensitization, noble metal sensitization, or a combination of these. The sensitization can be performed by using an active gelation as described in T. H. James. The Theory of the Photographic Process, 4th ed., Macmillan, 1977, pages 67 to 76. The sensitization can also be performed by using any of sulfur, selenium, tellurium, gold, platinum, palladium, and iridium, or by using combination of a plurality of these sensitizers at pAg 5 to 10, pH 5 to 8, and a temperature of 30° to 80° C. as described in Research Disclosure. Vol. 120, April, 1974, 12008, Research Disclosure, Vol. 34. June, 1975, 13452, U.S. Pat. Nos. 2,642,361, 3,297,446, 3,772,031, 3,857,711, 3.901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferable. In the gold sensitization, it is possible to use known compounds, such as chloroauric acid, potassium chloroaurate, potassium aurithiocyanate, gold sulfide, and gold selenide. A palladium sensitizer means a salt of divalent or tetravalent palladium. A preferable palladium sensitizer can be represented by $R_2PdX_6$ or $R_2PdX_4$ wherein R represents a hydrogen atom, an alkali metal atom, or an ammonium group, and X represents a halogen atom, i.e., a chlorine, bromine, or iodine atom. More preferably, the palladium sensitizer is $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold sensitizer and the palladium sensitizer be used in combination with a thiocyanate salt or a selenocyanate salt.

It is preferable to perform gold sensitization together with the other sensitization for emulsions of the present invention. An amount of gold sensitizer is preferably $1\times10^{-4}$ to $1\times10^{-7}$ mole, and more preferably $1\times10^{-5}$ to $5\times10^{-7}$ mole per mole of silver halide. A preferable amount of palladium sensitizer is $1\times10^{-3}$ to $5\times10^{-7}$ mole per mole of silver halide. A preferable amount of a thiocyan compound or a selenocyan compound is $5\times10^{-2}$ to $1\times10^{-6}$ mole per mole of silver halide.

Examples of a sulfur sensitizer are hypo, a thiourea-based compound, a rhodanine-based compound, and sulfur-containign compounds described in U.S. Pat. Nos. 3,857,711, 4,266,018, and 4,054,457.

An amount of a sulfur sensitizer with respect to silver halide grains of the present invention is preferably $1\times10^{-4}$ to $1\times10^{-7}$ mole, and more preferably $1\times10^{-5}$ to $5\times10^{-7}$ mole per mole of silver halide.

Selenium sensitization is a preferable sensitizing method for emulsions of the present invention. Known unstable selenium compounds can be used in the selenium sensitization. Practical examples of the selenium compound are colloidal metal selenium, sclenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411, 914, and 3,554,757, JP-A-58-126526, and G. F. Duffin, Photographic Emulsion Chemistry, pages 138 to 143.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg environment at pAg 1 to 7, and a method called high-pH riuening in which grains are grown or ripened in a high-pH environment at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidine-sulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride. thiourea dioxide, dimethylamineborane, and ascorbic acid and its derivative. Although an addition amount of the reduction sensitizers must be so Eelected as to meet the emulsion manufacturing conditions. a preferable amount is $10^{-7}$ to $10^{-3}$ mole per mole of silver halide.

The reduction sensitizers are dissolved in water or an organic solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

It is preferable to use an oxidizer for silver during the process manufacturing emulsions of the present invention. The oxidizer for silver means a compound having an effect of converting metal silver into silver ion. A particularly effective compound is the one that converts very fine silver grains, as a by-product in the process of formation of silver halide grains and chemical sensitization, into silver ions. The silver ions thus produced may form a silver salt hardly soluble in water, such as a silver halide, silver sulfide, or silver selenide, or a silver salt readily soluble in water, such as silver nitrate. The oxidizer for silver may be either an inorganic or organic substance. Examples of the inorganic oxidizer are ozone, hydrogen peroxide and its adduct (e.g., $NaBO_2\cdot H_2O_2\cdot 3H_2O$, $2NaCO_3\cdot 3H_2O_2$, $Na_4P_2O_7\cdot 2H_2O_2$, and $2Na_2SO_4\cdot H_2O_2\cdot 2H_2O$), a peroxy acid salt (e.g., $K_2S_2O_8$, $K_2C_2O_6$, and $K_2P_2O_8$), a peroxy complex compound (e.g., $K_2[Ti(O_2)C_2O_4]\cdot 3H_2O$, $4K_2SO_4\cdot Ti(O_2)OH\cdot SO_4\cdot 2H_2O$, and $Na_3[VO(O_2)(C_2H_4)_2]\cdot 6H_2O$), a permanganate salt (e.g., $KMnO_4$), an oxyacid salt such as chromate (e.g., $K_2Cr_2O_7$), a halogen element such as iodine and bromine, a perhalogenate salt (e.g., potassium periodate), a salt of a high-valence metal (e.g., potassium hexacyanoferrate(II)), and a thiosulfonate salt.

Examples of the organic oxidizer are quinones such as p-quinone, an organic peroxide such as peracetic acid and perbenzoic acid, and a compound which releases active halogen (e.g., N-bromosuccinimide, chloramine T, and chloramine B).

Preferable oxidizers of the present invention are an inorganic oxidizer such as ozone, hydrogen peroxide and its adduct, a halogen element, or a thiosulfonate salt, and an organic oxidizer such as quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be performed during grain formation or chemical sensitization.

Photographic emulsions used in the present invention may contain various compounds in order to prevent fog during the manufacturing process, storage, or photographic processing of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxysubstituted(1,3,3a,7)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Photographic emulsions used in the present invention are preferably subjected to spectral sensitization by methine dyes or the other dyes in order to achieve the effects of the present invention. Useful dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be contained in these dyes. Examples of a nucleus are a pyrroline nucleus, an oxazoline nucleus, a thiozoline nucleus, a pyrrole nucleus, an oxazole nucleus, a thiazole nucleus, a selenazole nucleus, an imidazole uncleus, a tetrazole uncleus, and a pyridine nucleus; a a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxazole nucleus, a naphthoxazole nucleus, a benzthiazole nucleus, a naphthothiazole nucleus, a benzoselenazole nucleus, a benzimidazole nucleus, and a quinoline nucleus. These nuclei may have a substitutent on a carbon atom.

It is possible for a merocyanine dye or a composite merocyanine dye to have a 5- or 6-membered heterocyclic nucleus as a nucleus having a ketomethylene structure. Examples are a pyrazolin-5-one nucleus, a thiohydantoin uncleus, a 2-thiooxazolidine-2-4-dione nucleus, a thiazolidine-2,4-dione nucleus, a rhodanine nucleus, and a thioharhituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

The emulsions used in the present invention may contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same time as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. 4,225,666, these compounds described above can be added separately: a portion of the compounds may be added prior to chemical sensitization, while the remaining portion is added after that. That is, the compounds can be added at any timing during formation of silver halide grains, including the method disclosed in U.S. Pat. No. 4,183,756.

The addition amount of the spectral sensitizing dye may be $4\times10^{-6}$ to $8\times10^{-3}$ mole per mole of silver halide. However, for a more preferable silver halide grain size of 0.2 to 1.2 μm, an addition amount of about $5\times10^{-5}$ to $2\times10^{-3}$ mole per mole of silver halide is more effective.

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in west German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

To improve the color reproduction, a donor layer (CL) of an interlayer effect can be arranged directly adjacent to, or close to, a main light-sensitive layer such as BL, GL or RL. The donor layer has a spectral sensitivity distribution which is different from that of the main light-sensitive layer. Donor layers of this type are disclosed in U.S. Pat. No. 4,663,271, U.S. Pat. No. 4,705,744, U.S. Pat. No. 4,707,436, JP-A-62-160448, and JP-A-63-89850.

As described above, various layer configurations and arrangements can be selected in accordance with the application of the light-sensitive material.

A preferable silver halide contained in photographic emulsion layers of the photographic light-sensitive material of the present invention is silver bromoiodide, silver chloroiodide, or silver chlorobromoiodide containing about 30 mol % or less of silver iodide. The most preferable silver halide is silver bromoiodide or silver chlorobromoiodide containing about 2 mol % to about 10 mol % of silver iodide.

Silver halide grains contained in the photographic emulsion may have regular crystals such as cubic, octahedral, or tetradecahedral crystals, irregular crystals such as spherical, or tabular crystals, crystals having defects such as twin planes, or composite shapes thereof.

The silver halide may consist of fine grains having a grain size of about 0.2 μm or less or large grains having a projected-area diameter of up to 10 μm, and the emulsion may be either a polydisperse emulsion or a monodisperse emulsion.

The silver halide photographic emulsion which can be used in the present invention can be prepared by methods described in, for example, Research Disclosure (RD) No. 17643 (December 1978), pp. 22 to 23, "I. Emulsion preparation and types", RD No. 18716 (November 1979), page 648, and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394, and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,499,520, and British Patent 2,112,157.

The crystal structure may be uniform, may have different halogen compositions in the interior and the surface thereof, or may be a layered structure. Alternatively, silver halides having different compositions may be joined by an epitaxial junction, or a compound other than a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in RD Nos. 17,643; 18,716 and 307,105 and they are summarized in the table represented later.

In the light-sensitive material of the present invention, two or more types of emulsions different in at least one of features such as a grain size, a grain size distribution, a halogen composition, a grain shape, and sensitivity can be mixed and used in the same layer.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed despite the presence of a non-exposed portion and exposed portion of the light-sensitive material. A method of preparing the internally fogged or surface-fogged silver halide grain is described in U.S. Pat. No. 4,626,498 or JP-A-59-214852.

The silver halides which form the core of the internally fogged or surface-fogged core/shell silver halide grains may be of the same halogen composition or different halogen compositions. Examples of the internally fogged or surface-fogged silver halide are silver chloride, silver bromochloride, silver bromoiodide, and silver bromochloroiodide. Although the grain size of these fogged silver halide grains is not particularly limited, an average grain size is preferably 0.01 to 0.75 μm, and most preferably, 0.05 to 0.6 μm. The grain shape is also not particularly limited, and may be a regular grain shape. Although the emulsion may be a polydisperse emulsion, it is preferably a monodisperse emulsion (in which at least 95% in weight or number of silver halide grains have a grain size falling within a range of ±40% of the average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table:

| Additives | RD17643 | RD18716 | RD307105 |
|---|---|---|---|
| 1. Chemical sensitizers | page 23 | page 648, right column | page 866 |
| 2. Sensitivity-increasing agents | | page 648, right column | |
| 3. Spectral sensitizers, super-sensitizers | pp. 23–24 | page 648, right column to page 649, right column | pp. 866–868 |
| 4. Brighteners | page 24 | page 648, right column | page 868 |
| 5. Antifoggants, stabilizers | pp. 24–25 | page 649, right column | pp. 868–870 |
| 6. Light absorbent, filter dye, ultra-violet absorbents | pp. 25–26 | page 649, right column to page 650, left column | page 873 |

-continued

| Additives | RD17643 | RD18716 | RD307105 |
|---|---|---|---|
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-1-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

RD Nos. 11449 and 24241, and JP-A-61-201247, for example, disclose couplers which release bleaching accelerator. These couplers effectively serve to shorten the time of any process that involves bleaching. They are effective, particularly when added to light-sensitive material containing tabular silver halide grains. Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcitrate), an aniline derivative (e.g., N,N-dibutyl-2-butoxy-5-tertoctylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl phydroxybenzoate, phenol, 4-chloro-3,5-dimethylphenol, 2-phenoxyethanol, and 2-(4-thiazolyl-)benzimidazole, which are described in JP-A-63-257747, JP-A-62-272248, and JP-A-1-80941.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloid layers at the side having emulsion layers is preferably 28 μm or less, more preferably, 23 μm or less, much more preferably, 18 μm or less, and most preferably, 16 μm or less. A film swell speed $T_{1/2}$ is preferably 30 seconds or less, and more preferably, 20 seconds or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swello-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness—film thickness)/film thickness.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these compounds, 3-methyl-4-amino-N-ethyl-N-β-hydroxyethylaniline, and the sulfates thereof are preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

Processing solutions except for the color developer and processing steps of the color reversal light-sensitive material of the present invention will be described below.

Of the processing steps of the color reversal light-sensitive material of the present invention, those from black-and-white (B/W) development to color development are as follows.

1) B/W development—washing—reversal—color development
2) B/W development—washing—photo-reversal—color development
3) B/W development—washing—color development The washing in any of the processes 1) to 3) can be replaced with rinsing described in U.S. Pat. No. 4,804,616 in order to simplify the process and reduce the quantity of a waste liquor.

Steps after the color development will be described.

4) Color development—conditioning—bleaching—fixing—washing—stabilization
5) Color development—washing—bleaching—fixing—washing—stabilization
6) Color development—conditioning—bleaching—washing—fixing—washing—stabilization
7) Color development—washing—bleaching—washing—fixing—washing—stabilization
8) Color development—bleaching—fixing—washing—stabilization
9) Color development—bleaching—bleach-fixing—washing—stabilization
10) Color development—bleaching—bleach-fixing—fixing—washing—stabilization
11) Color development—bleaching—washing—fixing—washing—stabilization
12) Color development—conditioning—bleach-fixing—washing—stabilization
13) Color development—washing—bleach-fixing—washing stabilization
14) Color development—bleach-fixing—washing—stabilization
15) Color development—fixing—bleach-fixing—washing—stabilization In the processes 4) to 15), the washing immediately before the stabilization can be omitted, and the last stabilization step need not be performed. One of the processes 1) to 3) and one of the processes 4) to 15) combine together to form a color reversal process.

Processing solutions used in the color reversal process of the present invention will be described below.

As a B/W developing solution for use in the present invention, it is possible to use developing agents known to those skilled in the art. Examples of the developing agent are dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and a heterocyclic compound described in U.S. Pat. No. 4,067,872, in which a 1,2,3,4-tetrahydroquinoline ring and an indolene ring are condensed. These developing agents can be used singly or in a combination of two or more types of them.

The B/W developing solution for use in the present invention can contain, if necessary, a preservative (e.g., a sulfite or a bisulfite), a buffering agent (e.g., a carbonate, boric acid, a borate salt, or an alkanolamine), an alkaline agent (e.g., a hydroxide or a carbonate salt), a solubilizing aid (e.g., polyethyleneglycols or their esters), a pH control agent (e.g., an organic acid such as acetic acid), a sensitizer (e.g., a quaternary ammonium salt), a development accelerator, a surfactant, an anti-foaming agent, a film hardener, and a viscosity-imparting agent.

It is necessary to add a compound acting as a silver halide solvent to the B/W developing solution used in the present invention. In general, however, a sulfite salt to be added as the preservative described above plays this role as a solvent. Examples of a sulfite and other usable silver halide solvents are KSCN, NaSCN, $K_2SO_3$, $Na_2SO_3$, $K_2S_2O_5$, $Na_2S_2O_5$, $K_2S_2O_3$, and $Na_2S_2O_3$.

Although the pH of a developing solution thus prepared is so selected as to yield desired density and contrast, it falls within the range of about 8.5 to about 11.5.

To perform sensitization using such a B/W developing solution, a processing time is prolonged a maximum of about three times that of standard processing. In this case, raising the processing temperature can shorten the time prolonged for sensitization.

The pH of the color and black-and-white developers is generally 9 to 12. Although the quantity of a replenisher of these developers depends on a color photographic light-sensitive material to be processed, it is generally 3 liters or less per $m^2$ of the light-sensitive material. The quantity of a replenisher can be decreased to be 500 ml or less by decreasing a bromide ion concentration in the replenisher. When the quantity of a replenisher is to be decreased, a contact area of a processing tank with air is preferably decreased to prevent evaporation and oxidation of the replenisher.

A contact area of a photographic processing solution with air in a processing tank can be represented by an aperture defined below:

$$\text{Aperture} = \frac{\text{contact area (cm}^2\text{) of processing solution with air}}{\text{volume (cm}^3\text{) of processing solution}}$$

The above aperture is preferably 0.1 or less, and more preferably, 0.001 to 0.05. In order to reduce the aperture, a shielding member such as a floating cover may be provided on the liquid surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing accumulation of bromide ions in the developing solution.

A reversal bath used for the B/W development can contain a known fogging agent. Examples of the fogging agent are stannous ion complex salts, such as stannous ion-organic phosphoric acid complex salt (U.S. Pat. No. 3,617,282), stannous ion organic phosphonocarboxylic acid complex salt (JP-B-56-32616), and stannous ion-aminopolycarboxylic acid complex salt (U.S. Pat. No. 1,209,050), and boron compounds, such as a boron hydride compound (U.S. Pat. No. 2,984,567) and a heterocyclic amineborane compound (British Patent 1,011,000). The pH of this fogging bath (reversal bath) covers a wide range from acidic to alkaline sides. The pH is 2 to 12, preferably 2.5 to 10, and most preferably 3 to 9. Photoreversal using re-exposure may be performed instead of the reversal bath. Alternatively, the reversal step itself may be omitted by adding the above fogging agent to the color developing solution.

The silver halide color photographic light-sensitive material of the present invention is subjected to bleaching or bleach-fixing after the color development. These processes may be performed immediately after the color development without performing any other processing. Alternatively, in order to prevent unnecessary post-development or aerial fog and reduce a carry-over of the color developing solution to a desilvering step or to wash out or make harmless the color developing agent impregnated in light-sensitive portions, such as sensitizing dyes or dyes contained in the photographic light-sensitive material, and impregnated in the photographic light-sensitive material, the light-sensitive material may be subjected to, e.g., stopping, conditioning, and washing, after the color development before it is subjected to the bleaching or the bleach-fixing.

The photographic emulsion layer is generally subjected to bleaching after color development. The bleaching may be performed either simultaneously with fixing (bleach-fixing) or independently of it. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, according to the intended use. Examples of the bleaching agent are a compound of a multivalent metal such as iron(III); peracids; quinones; and nitro compounds. Typical examples of the bleaching agent are organic complex salts of iron(III), e.g., complex salts of an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid; and complex salts of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent environmental contaminations. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfido group described in, e.g., U.S. Pat. No. 3,893,858, west German Patents 1,290,812 and 2,059,988, JP-A-53-32736, JP-A-53-57831, JP-A-53-37418, JP-A-53-72623, JP-A-53-95630, JP-A-53-104232, JP-A-53-124424, and JP-A-53-141623, and JP-A-53-28426, and Research Disclosure No. 17,129 (July, 1978); a thiazolidine derivative described in JP-A-50-140129; iodide salts described in JP-B-45-8506, JP-A-52-20832, JP-A-53-32735, U.S. Pat. No. 3,706,561, and JP-A-58-16235; polyoxyethylene compounds descried in West German Patents 977,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and bromide ions. Of these compounds, a compound having a mercapto group or a disulfido group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are effective especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, for example, acetic acid, propionic acid, or hydroxyacetic acid.

Examples of the fixing agent for use in the fixing or bleach-fixing solution are a thiosulfate, a thiocyanate, a thioether-based compound, a thiourea and a large amount of an iodide. Of these compounds, a thiosulfate, especially, ammonium thiosulfate can be used in the widest range of applications. In addition, a combination of a thiosulfate and a thiocyanate, a thioether-based compound or a thiourea is preferably used. As a preservative of the fixing or bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution. The total time of a desilvering step is preferably as short as possible provided that no desilvering inadequacy occurs. A preferable time is one to three minutes, and more preferably, one to two minutes. The processing temperature is 25° C. to 50° C., and preferably, 35° C. to 45° C. within the preferable temperature range, a desilvering speed is increased, and generation of a stain after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyor means described in JP-A-60-191257, JP-A-191258, or JP-A-60-191259. As described in JP-A-60-191257, this conveyor means can significantly reduce a carry-over of a processing solution from a pre-bath to a post-bath, thereby effectively preventing degradation in performance of the processing solution. This effect significantly shortens especially a processing time in each processing step and reduces the quantity of a replenisher for each processing solution.

The photographic light-sensitive material of the present invention is normally subjected to washing and/or stabilizing steps after desilvering. An amount of water used in the washing step can be selected within a broad range in accordance with the properties (e.g., a property determined by used substances such as a coupler) of the light-sensitive material, the intended use of the material, the temperature of the water, the number of water tanks (the number of stages), a replenishing scheme such as a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). According to the above-described multistage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing the photographic light-sensitive material of the present invention is 4 to 9, and preferably, 5 to 8. The water temperature and the washing time can vary in accordance with the properties and the intended use of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilization is sometimes performed subsequently to washing. An example is a stabilizing bath containing a dye stabilizing agent and a surface-active agent to be used as a final bath of the photographic color light-sensitive material. Examples of the dye stabilizing agent are an aldehyde such as formalin and glutaraldehyde, an N-methylol compound, hexamethylenetetramine, and an aldehyde sulfurous acid adduct. Various chelating agents or antifungal agents can also be added to this stabilizing bath.

An overflow solution produced upon washing and/or replenishment of the stabilizing solution can be resued in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The present invention will be described in more detail below by way of its examples, but the present invention is not limited to these examples.

EXAMPLE 1

Preparation of Emulsion Em-1 (Comparative Emulsion)

First, 1000 ml of an aqueous solution containing 40 g of gelatin and 0.65 g of KBr was stirred, while maintaining its temperature at 74° C. After adding 2.7 g of ammonium nitrate and 7 cc of 1N NaOH to the solution, a silver nitrate ($AgNO_3$ 20 g) aqueous solution and a KBr aqueous solution were added over 27 minutes by double jet method. In the process, the silver potential was maintained at 55 mV with respect to the saturated calomel electrode. Next, a silver nitrate ($AgNO_3$ 23 g) aqueous solution and a halogen aqueous solution (containing 10 molt of KI based on KBr) were added over 7 minutes by the double jet method. After adjusting the pH of the solution to 6.0 with 1N $H_2SO_4$, a 1% KI (2.2 g) aqueous solution was added at a constant flow rate. Then, a silver nitrate ($AgNO_3$ 57 g) aqueous solution and a KBr aqueous solution were added over 30 minutes by the double jet method. In the process, the silver potential was maintained at 65 mV to the saturated calomel electrode. The emulsion thus prepared was desalted by means of flocculation method. After adding gelatin, pH and pAg were adjusted to 6.4 and 8.6, respectively. This emulsion contained tetradecahedral grains having an average equivalent-sphere diameter of 0.4 μm, a variation coefficient of 16%, an average AgI content of 4.6 molt, and a standard deviation of 17% in terms of inter-gain AgI content.

This emulsion was subjected to optimum gold-sulfur sensitization using sodium thiosulfate, chloroauric acid, and potassium thiocyanate. Sensitizing dyes S-2 and S-3 were added to the emulsion in an amount of 0.02 g/mol $AgNO_3$ and an amount of 0.25 g/mol $AgNO_3$, respectively, thereby forming Emulsion Em-1.

Preparation of Emulsion Em-2

An emulsion Em-2 was prepared in the same way as Emulsion Em-1, except for the following points.

In place of 1% KI (2.2 g) aqueous solution, 2-iodoethanol (3.6 cc), which is an iodide ion-releasing agent, was added to the solution. Thereafter, a 0.1N $NaOH_3$ aqueous solution was added for 5 minutes at a constant flow rate, increasing the pH of the bulk solution to 10.0. The solution was maintained at pH of 10.0 for 5 minutes, and then the pH was lowered back to 5.6.

Like Emulsion Em-1, Emulsion Em-2 contained tetradecahedral grains having an average equivalent-sphere diameter of 0.4 μm, a variation coefficient of 16%, an average AgI content of 4.6 molt, and a standard deviation of 16% in terms of inter-gain AgI content.

Preparation of Emulsion Em-3

An emulsion Em-3 was prepared in the same way as Emulsion Em-1, except for the following points.

Instead of 1% KI (2.2 g) aqueous solution, an aqueous solution of sodium p-iodoacetamidobenzensul fonate (4.8 g), which is an iodide ion-releasing agent, was added to the solution. Thereafter, a sodium sulfite (3.0 g) aqueous solution was added for 5 minutes at a constant flow rate. The solution was maintained at pH of 8.0 for 5 minutes, and then the pH was lowered back to 5.6.

Like Emulsion Em-1, Emulsion Em-3 contained tetradeca hedral grains having an average equivalent-sphere diameter of 0.4 μm, a variation coefficient of 16%, and an average AgI content of 4.6 molt.

Preparation of Emulsion Em-4

An aqueous solution was prepared by dissolving 15 g of potassium bromide and 25 g of inactive gelatin in 3.7 liters of distilled water. While thoroughly stirring this aqueous solution, a 14% potassium bromide aqueous solution and a 20% silver nitrate aqueous solution were added for 1 minute at 50° C. at a constant flow rate by means of double jet method. (By this addition (I), 10.0% of all silver was consumed.) Thereafter, a gelatin aqueous solution (17%, 300 cc) was added to the solution, and the solution was heated to 75° C. and ripened for 10 minutes. Next, 35 cc of a 25% $NH_3$aqueous solution was added. The resultant solution was left to stand for 15 minutes. Then, 510 cc of 1N $N_2SO_4$ was added to the solution, thereby neutralizing the solution.

Furthermore, a 20% potassium bromide aqueous solution and a 33% silver nitrate aqueous solution was added over 40 minutes by the double jet method. (By this addition (II), 40% of all silver was consumed.) At this time, the temperature and the pAg were maintained at 75° C. and 8.40, respectively, and the pH was 5.8. The temperature was lowered to 50° C. Potassium bromide was added, adjusting the pAg to 9.4. Then, 1040 ml of a 1% potassium iodide aqueous solution was added over 120 seconds. Thereafter, the remaining part of the addition (II) was performed over 50 minutes. By this addition, 50% of all silver was consumed. The amount in which silver nitrate used to prepare this emulsion was 425 g. The resultant solution was desalted by means of flocculation method, and was subjected to optimum gold-sulfur sensitization using sodium thiosulfate, chloroauric acid and potassium thiocyanate in the presence of sensitizing dyes S-6 and S-7, thereby preparing a comparative tabular AgBrI (AgI=2.5 mol %) Emulsion Em-4.

Emulsion Em-4 contained tabular grains, 98% of which had a ratio of equivalent-circle diameter to thickness of 2 or more. The grains had an equivalent-sphere diameter of 0.65 μm, and their average diameter-to-thickness ratio was 5.2.

Preparation of Emulsion Em-5

Emulsion E-5 was prepared in the same way as Emulsion Em-1, except for the following points.

An aqueous solution of sodium p-iodoacetamidobenzenesulfonate (22.7 g), which is an iodide ion-releasing agent, was added, instead of 1% KI aqueous solution. Then, a sodium sulfite (10.5 g) aqueous solution was added over 5 minutes at a constant flow rate. The pH was maintained at 8.0 for 5 minutes, and then the pH was adjusted to 5.6.

Preparation of Coated Samples and Evaluation Thereof

An emulsion layer and a protective layer, of the following compositions, were coated on an undercoated triacetylcellulose film support, thereby preparing Sample 101.

| | |
|---|---|
| (1) Emulsion layer | |
| Emulsion E-1 | coated silver 2.15 g/m$^2$ |
| Coupler C-5 | 1.5 g/m$^2$ |
| Tricresyl phosphate | 1.1 g/m$^2$ |
| Gelatin | 2.0 g/m$^2$ |
| (2) Protective layer | |
| 2,4-dichloro-6-hydroxy-s-triazine sodium salt | 0.08 g/m$^2$ |
| Gelatin | 1.80 g/m$^2$ |

Samples 102 to 109 were prepared by using different emulsions specified in the following Table 1, and by adding various compounds also specified in Table 1.

TABLE 1

| Sample No. | Emulsion | Release of iodide ions | Compound added |
|---|---|---|---|
| 101 Comparative example | Em-1 | Not controlled | None |
| 102 Comparative example | Em-1 | Not controlled | I-I-26 |
| 103 This invention | Em-2 | Controlled | I-I-26 |
| 104 This invention | Em-3 | Controlled | I-I-26 |

TABLE 1-continued

| Sample No. | Emulsion | Release of iodide ions | Compound added |
|---|---|---|---|
| 105 This invention | Em-3 | Controlled | I-II-1 |
| 106 This invention | Em-3 | Controlled | I-III-6 |
| 107 Comparative example | Em-4 | Not controlled | None |
| 108 Comparative example | Em-4 | Not controlled | I-I-26 |
| 109 This invention | Em-5 | Controlled | I-I-26 |

These samples were left for 14 hours at 40° C. and relative humidity of 70%, and were then tested as will be described in the following.

First, the silver halide color photographic light-sensitive material samples, prepared as described above, were processed in the following steps:

| Steps | Time | Temperature |
|---|---|---|
| First development | 4 min. | 38° C. |
| Water washing | 2 min. | " |
| Reversing | 2 min. | " |
| Color development | 6 min. | " |
| Pre-bleaching | 2 min. | " |
| Bleaching | 6 min. | " |
| Fixing | 4 min. | " |
| Water Washing | 4 min. | " |
| Final rinsing | 1 min. | 25° C. |

The compositions of the respective processing solutions were as follows:

| [First development solution] | |
|---|---|
| Pentasodium nitrilo-N,N,N-trimethylenephosphonate | 1.5 g |
| Pentasodium diethylene-triaminepentaacetate | 2.0 g |
| Sodium sulfite | 30 g |
| Sodium hydroquinone monosulfonate | 20 g |
| Potassium carbonate | 15 g |
| Sodium biscarbonate | 12 g |
| 1-phenyl-4-methyl-4-hydroxy-methyl-3-pyrazolidone | 1.5 g |
| Potassium bromide | 2.5 g |
| Potassium thiocyanate | 1.2 g |
| Potassium iodide | 2.0 mg |
| Diethylene glycol | 13. g |
| Water to make | 1000 ml |
| pH | 9.60 |

The pH was adjusted by sulfuric acid or potassium hydroxide.

| [Reversing solution] | |
|---|---|
| Pentasodium nitrilo-N,N,N-trimethylenephosphonate | 3.0 g |

-continued

| [Reversing solution] | |
|---|---|
| Stannous chloride dihydrate | 1.0 g |
| P-aminophenol | 0.1 g |
| Sodium hydroxide | 8 g |
| Glacial acetic acid | 15 ml |
| Water to make | 1000 ml |
| pH | 6.00 |

The pH was adjusted by acetic acid or sodium hydroxide.

| [Color developing solution] | |
|---|---|
| Pentasodium nitrilo-N,N,N-trimethylenephosphonate | 2.0 g |
| Sodium sulfite | 7.0 g |
| Trisodium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-ethyl-N-β-methane-sulfonamidoethyl)-3-methyl-4-aminoaniline 3/2 sulfate monohydrate | 11 g |
| 3,6-dithiaoctane-1,8-diol | 1.0 g |
| Water to make | 1000 ml |
| pH | 11.80 |

The pH was adjusted by sulfuric acid or potassium hydroxide.

| [Pre-bleaching solution] | |
|---|---|
| Disodium ethylenediamine-tetraacetate dihydrate | 8.0 g |
| Sodium sulfite | 6.0 g |
| 1-thioglycerol | 0.4 g |
| Formaldehyde-sodium bisulfite adduct | 30 g |
| Water to make | 1000 ml |
| pH | 6.20 |

The pH was adjusted by acetic acid or sodium hydroxide.

| [Bleaching solution] | |
|---|---|
| Disodium ethylenediamine-tetraacetate dihydrate | 2.0 g |
| Ammonium Fe (III) ethylene-diaminetetraacetate dihydrate | 120 g |
| Potassium bromide | 100 g |
| Ammonium nitrate | 10 g |
| Water to make | 1000 ml |
| pH | 5.70 |

The pH was adjusted by nitric acid or sodium hydroxide.

| [Fixing solution] | |
|---|---|
| Ammonium thiosulfate | 80 g |
| Sodium sulfite | 5.0 g |
| Sodium bisulfite | 5.0 g |
| Water to make | 1000 ml |
| pH | 6.60 |

The pH was adjusted by acetic acid or ammonia water.

| [Final rinsing solution] | |
|---|---|
| 1,2-benzoylthiazolin-3-one | 0.02 g |
| Polyoxyethylene-p-mononyl-phenylether (average polymerization degree: 10) | 0.3 g |
| Polymaleic acid (average molecular weight: 2,000) | 0.1 g |
| Water to make | 1000 ml |
| pH | 7.0 |

Process B

The silver halide color photographic light-sensitive material samples, prepared as described above, were processed in the same way as in Process A, except the amount of potassium bromide contained in the first development solution was changed to 3.1 g.

In order to determine the dependency on the changes in processing factors, the exposure amount of each sample, which obtained color density of 0.5 when subjected to Process A, was measured in logarithm, log E(A), and the exposure amount of each sample, which obtained color density of 0.5 when subjected to Process B, was measured in logarithm, log E(B). Then, log E(A)—log E(B) was calculated. The less the value for log E(A)—log E(B), the less the dependency on the changes in processing factors. The results were as is shown in the following Table 2.

TABLE 2

| Sample No. | logE(A) − logE(B) |
|---|---|
| 101 (Comparative example) | 0.04 |
| 102 (Comparative example) | 0.11 |
| 103 (This invention) | 0.05 |
| 104 (This invention) | 0.05 |
| 105 (This invention) | 0.06 |
| 106 (This invention) | 0.03 |
| 107 (Comparative example) | 0.02 |
| 108 (Comparative example) | 0.07 |
| 109 (This invention) | 0.03 |

As is evident from Table 2, any emulsion that contained grains formed in the presence of an iodide ion-releasing agent under controlled release of iodine ions had small dependency on the changes in processing factors even if one of the compounds (I-I) to (I-III) of the invention had been added to the emulsion.

EXAMPLE 2

Preparation of Emulsions Em-6 to Em-9

Emulsions Em-6 and Em-7 were prepared in the same way as Emulsion Em-1, such that the temperature, the silver potential and the composition of the halogen aqueous solution (i.e., the ration of KI to KBr) were adjusted similarly, and that the grain size, the crystal habit and the AgI content were changed. Also, Emulsions Em-8 and Em-9 of the present invention were prepared in the same way as Emulsions Em-6 and Em-7, except that the same changes were respectively made as in the preparation of Emulsion Em-2. Emulsions Em-6 and Em-8 were cubic-grain ones, each having a grain size of 0.35 μm, a variation coefficient of 9%, an average AgI content of 3.4%, and a standard deviation of 9% in terms of inter-grain AgI-content distribution. Emulsions Em-7 and Em-9 were cubic-grain ones, each having a grain size of 0.25 μm, a variation coefficient of 13%, an average AgI content of 3.7%, and a standard deviation of 12% in terms of inter-grain AgI-content distribution. Emulsions Em-6 to Em-9 had been optimally sensitized with sodium thiosulfate, N,N-dimethylselenourea, chloroauric acid, potassium thiocyanate and sodium benzenethiosulfonate, and to which sensitizing dyes S-2 and S-3 had been added in an optimum amount. The phrases "optimally sensitized" and "optimum amount" mean a degree of sensitization and an amount which impart the the highest possible sensitivity to the material when the material is exposed to light for 1/100second.

Preparation of Emulsions Em-10 and Em-11

Emulsions Em-10 and Em-11 were prepared in the following way. First, two types of gains were formed and desalted in the same way as in Emulsions Em-4 and Em-5. Then, these two types of grains were optimally sensitized with sodium thiosulfate, chloroauric acid, and potassium thiocyanate, respectively thus forming two emulsions, and sensitizing dyes S-2 and S-3 were added to these emulsions, respectively, as in Emulsions Em-4 and Em-5. An AgBr fine-grain emulsion having an average grain size of 0.05 μm was added to each emulsion in an amount corresponding to 1/50 of the silver amount. Both emulsions were ripened, thereby preparing Emulsions Em-10 and Em-11.

Preparation of Emulsions Em-12 and Em-13

Emulsions Em-12 and Em-13 were prepared by using an iodide ion-releasing agent, as in the preparation of Emulsion Em-11. Of the grains in Emulsion Em-12, 92% were tabular ones having a equivalent-circle diameter/thickness ratio of 2 or more. Emulsion Em-12 had an equivalent-sphere diameter of 0.63 μm, and an average diameter/thickness ratio of 3.7. Of the grains in Emulsion Em-13, 99% were tabular ones having a an equivalent-circle diameter/thickness ratio of 2 or more. Emulsion Em-13 had an equivalent-sphere diameter of 0.67 μm, and an average diameter/thickness ratio of 8.1.

Preparation of Sample 201

Sample 201 was prepared by using Emulsions Em-1, Em-6, Em-7, and Em-10 in layers 4, 5 and 6. More precisely, Sample 201 was prepared as follows:

A multilayered color light-sensitive material was prepared by forming layers having the following compositions on an undercoated triacetylcellulose film support, thereby obtaining Sample 201. Numbers indicate amounts in g/m$^2$. The effect of each compound added is not limited to one related to the use specified.

| Layer 1: Antihalation layer | |
|---|---|
| Black colloidal silver | silver 0.20 g |
| Gelatin | 1.9 g |
| Ultraviolet absorbent U-1 | 0.1 g |
| Ultraviolet absorbent U-3 | 0.04 g |
| Ultraviolet absorbent U-4 | 0.1 g |
| High-boiling organic solvent Oil-1 | 0.1 g |
| Fine crystalline solid dispersion of dye E-1 | 0.1 g |
| **Layer 2: Interlayer** | |
| Gelatin | 0.40 g |
| Compound Cpd-C | 5 mg |
| High-boiling organic solvent Oil-3 | 0.1 g |
| Dye D-4 | 0.8 mg |

Layer 3: Interlayer

| | |
|---|---|
| Surface-fogged and internally fogged fine grain silver iodobromide emulsion (average grain size: 0.06 μm, variation coefficient: 18%; AgI content: 1 mol %) | silver 0.05 g |
| Gelatin | 0.4 g |

Layer 4: Low-speed red-sensitive emulsion layer

| | |
|---|---|
| Emulsion Em-6 | silver 0.2 g |
| Emulsion Em-7 | silver 0.3 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 5 mg |
| High-boiling organic solvent Oil-2 | 0.1 g |
| Dye D-1 | 0.1 g |

Layer 5: Medium-speed red-sensitive emulsion layer

| | |
|---|---|
| Emulsion Em-1 | silver 0.5 g |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Dye D-1 | 0.1 g |

Layer 6: High-speed red-sensitive emulsion layer

| | |
|---|---|
| Emulsion Em-10 | silver 0.4 g |
| Gelatin | 1.1 g |
| Coupler C-1 | 0.3 g |
| Coupler C-2 | 0.1 g |
| Coupler C-3 | 0.7 g |
| Additive P-1 | 0.01 g |

Layer 7: Interlayer

| | |
|---|---|
| Gelatin | 0.6 g |
| Additive M-1 | 0.3 g |
| Color mixing inhibitor Cpd-I | 2.6 mg |
| Dye D-5 | 0.02 g |
| High-boiling organic solvent Oil-1 | 0.02 g |

Layer 8: Interlayer

| | |
|---|---|
| Surface-fogged and internally fogged silver iodobromide emulsion (average grain size: 0.06 μm, variation coefficient: 16%, AgI content: 0.3 mol %) | silver 0.02 g |
| Gelatin | 1.0 g |
| Color mixing inhibitor Cpd-A | 0.1 g |
| Compound Cpd-C | 0.1 mg |

Layer 9: Low-speed green-sensitive emulsion layer

| | |
|---|---|
| Emulsion A | silver 0.1 g |
| Emulsion B | silver 0.2 g |
| Emulsion C | silver 0.2 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-D | 0.02 g |
| Compound Cpd-E | 0.02 g |
| Compound Cpd-F | 0.04 g |
| Compound Cpd-L | 0.02 g |
| High-boiling organic solvent Oil-1 | 0.1 g |
| High-boiling organic solvent Oil-2 | 0.1 g |

Layer 10: Medium-speed green-sensitive emulsion layer

| | |
|---|---|
| Emulsion C | silver 0.3 g |
| Emulsion D | silver 0.1 g |
| Gelatin | 0.6 g |
| Coupler C-4 | 0.1 g |
| Coupler C-7 | 0.2 g |

| | |
|---|---|
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-L | 0.05 g |
| High-boiling organic solvent Oil-2 | 0.01 g |

Layer 11: High-speed green-sensitive emulsion layer

| | |
|---|---|
| Emulsion E | silver 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-E | 0.02 g |
| Compound Cpd-F | 0.04 g |
| Compound Cpd-K | 5 mg |
| Compound Cpd-L | 0.02 g |
| High-boiling organic solvent Oil-1 | 0.02 g |
| High-boiling organic solvent Oil-2 | 0.02 g |

Layer 12: Interlayer

| | |
|---|---|
| Gelatin | 0.6 g |
| Compound Cpd-L | 0.05 g |
| High-boiling organic solvent Oil-1 | 0.05 g |

Layer 13: Yellow filter layer

| | |
|---|---|
| Yellow colloidal silver | silver 0.07 g |
| Gelatin | 1.1 g |
| Color mixing inhibitor Cpd-A | 0.01 g |
| Compound Cpd-L | 0.01 g |
| High-boiling organic solvent Oil-1 | 0.01 g |
| Fine crystalline solid dispersion of dye E-2 | 0.05 g |

Layer 14: Interlayer

| | |
|---|---|
| Gelatin | 0.6 g |

Layer 15: Low-speed blue-sensitive emulsion layer

| | |
|---|---|
| Emulsion F | silver 0.2 g |
| Emulsion G | silver 0.3 g |
| Gelatin | 0.8 g |
| Coupler C-5 | 0.2 g |
| Coupler C-6 | 0.1 g |
| Coupler C-10 | 0.4 g |

Layer 16: Medium-speed blue-sensitive emulsion layer

| | |
|---|---|
| Emulsion Em-4 | silver 0.5 g |
| Gelatin | 0.9 g |
| Coupler C-5 | 0.1 g |
| Coupler C-6 | 0.1 g |
| Coupler C-10 | 0.6 g |

Layer 17: High-speed blue-sensitive emulsion layer

| | |
|---|---|
| Emulsion H | silver 0.2 g |
| Emulsion I | silver 0.2 g |
| Gelatin | 1.2 g |
| Coupler C-5 | 0.1 g |
| Coupler C-6 | 0.1 g |
| Coupler C-10 | 0.6 g |

Layer 18: First protective layer

| | |
|---|---|
| Gelatin | 0.7 g |
| Ultraviolet absorbent U-1 | 0.2 g |
| Ultraviolet absorbent U-2 | 0.05 g |
| Ultraviolet absorbent U-5 | 0.3 g |
| High-boiling organic solvent Oil-1 | 0.02 g |
| Formalin scavenger Cpd-H | 0.4 g |
| Dye D-1 | 0.15 g |
| Dye D-2 | 0.05 g |
| Dye D-3 | 0.01 g |

Layer 19: Second protective layer

| | |
|---|---|
| Colloidal silver | silver 0.1 mg |
| Fine grain silver iodobromide emulsion (average grain size: 0.06 μm; AgI content: 1 mol %) | silver 0.1 g |
| Gelatin | 0.4 g |

-continued

| Layer 20: Third protective layer | |
|---|---|
| Gelatin | 0.4 g |
| Polymethylmethacrylate (average grain size: 1.5 μm) | 0.1 g |
| Copolymer of methyl methacrylate and acrylic acid in a ratio of 4:6 (average grain size: 1.5 μm) | 0.1 g |
| Silicone oil | 0.03 g |
| Surfactant W-1 | 3.0 mg |
| Surfactant W-2 | 0.03 g |

In addition to the above substances, a gelatin hardener H-1 and surfactants W-3, W-4, W-5 and W-6 for coating and emulsification had been added to each layer. Further, as antiseptic and mildewproofing agents, phenol, 1,2-benzisothiazolin-3-one, 2-phenoxyethanol, phenethyl alcohol and butyl p-benzoate had been added.

Preparation of Samples 202 to 207

Samples 202 to 207 were prepared in the same way as Sample 201, except that the emulsions for layers 4, 5 and 6 were changed as shown in the following Table 3 and that layers 4, 5 and 6 contained the compounds shown in Table 3.

TABLE 3

| Sample No. | Emulsions for layers 4 to 6 | Release of iodide ions | Compound* added |
|---|---|---|---|
| 201 (Comparative example) | Em-1, 6, 7, 10 | Not controlled | None |
| 202 (Comparative example) | Em-1, 6, 7, 10 | Not controlled | I-I-26 |
| 203 (This invention) | Em-3, 8, 9, 11 | Controlled | I-I-26 |
| 204 (This invention | Em-3, 8, 9, 11 | Controlled | I-I-30 |
| 205 (This invention | Em-3, 8, 9, 11 | Controlled | I-ii-i |
| 206 (This invention | Em-3, 8, 9, 11 | Controlled | I-III-6 |
| 207 (This invention | Em-3, 8, 9, 11 | Controlled | I-I-26<br>I-I-29 |

*In each sample, the compound was added in each of layers 4 to 6 in an amount of $1 \times 10^{-5}$ mol/m$^2$.

A first set of Samples 201 to 207, thus prepared, were exposed to red light through a continuous wedge. Then, they were developed in the same way as in Example 1, except that the first development was performed for 6 minutes. The processing solutions used were identical in composition to those used in Process A. A second set of the samples were exposed to white light (red light+green light+blue light) and developed in the same way. Of the components of the white light, the red light was applied to each sample in the same amount as the red light which had been applied for the first set of the samples. The exposure amount at a density of 1.0 of each developed sample in the first set, and of each developed sample in the second set, were measured in logarithm, log E(R) and log E(R,G,B), respectively.

Then, log E(R,G,B)—logE(R) was calculated for each sample, in order to evaluate the interimage effect on the red-sensitive layer. It can be said that, the greater the value for log E(R,G,B)—log E(R), the more prominent the interimage effect.

To determine the dependency on the changes in processing factors, each sample was exposed to white light and subjected to Process A and Process B, as in Example 1. However, the first development of each of Processes A and B was conducted for 6 minutes. The exposure amounts at a cyan density of 0.5 of each sample developed in Process A and Process B, respectively, were measured in logarithm, log E(A) and log E(B). Then, log E(A)—log E(B) was calculated. The results were as is shown in the following Table 4.

TABLE 4

| Sample No. | logE (R. G. B) − logE (R) | logE (A) − logE (B) |
|---|---|---|
| 201 | 0.06 | 0.05 |
| 202 | 0.15 | 0.12 |
| 203 | 0.21 | 0.06 |
| 204 | 0.19 | 0.05 |
| 205 | 0.18 | 0.04 |
| 206 | 0.13 | 0.04 |
| 207 | 0.23 | 0.06 |

As is evident from Table 4, although the addition of the compounds represented by the formulas (I-I) to (I-III) serves to enhance the interimage effect, the dependency on the changes in processing factors inevitably increases when no use is made of an emulsion which had been prepared in the presence of an iodide ion-releasing agent under controlled release of iodide ions. Table 4 also reveals that the changes in gradient is small when use is made of an emulsion in the presence of an iodide ion-releasing agent under controlled release of iodide ions.

EXAMPLE 3

Samples 301 to 311 were prepared in the same way as Sample 201 (Example 2), except that changes were made as specified in the following Tables 5 and 6.

TABLE 5

| Sample No. | Emulsions for layers 4–6 | Release of iodide ions | Compound added |
|---|---|---|---|
| 201 (Comparative example) | Em-1, 6, 7, 10 | Not controlled | None |
| 301 (Comparative example) | Em-1, 6, 7, 10 | Not controlled | III-I-57 (added in layers 4 and 7 in an amount of $1 \times 10^{-5}$ mol/m$^2$) |
| 302 (This invention) | Em-3, 8, 9, 11 | Controlled | III-I-57 (added in layers 4 and 7 in an amount of $1 \times 10^{-5}$ mol/m$^2$) |
| 303 (This invention | Em-3, 8, 9, 11 | Controlled | III-I-70 (added in layers 4 and 7 in an amount of $1 \times 10^{-5}$ mol/m$^2$) |
| 304 (This invention | Em-3, 8, 9, 11 | Controlled | III-I-48 (added in layers 4 and 7 in an amount of $1 \times 10^{-5}$ mol/m$^2$) |
| 305 (This invention | Em-3, 8, 9, 11 | Controlled | III-I-88 (added in layers 4 and 7 in an amount of $1 \times 10^{-5}$ mol/m$^2$) |
| 306 (This invention | Em-3, 8, 9, 11 | Controlled | III-I-51 (added in layers 4 and 7 in an amount of $1 \times 10^{-5}$ mol/m$^2$) |

TABLE 5-continued

| Sample No. | Emulsions for layers 4–6 | Release of iodide ions | Compound added | |
|---|---|---|---|---|
| 307 (This invention) | Em-3, 8, 9, 11 | Controlled | III-I-57 | (added in layers 5 and 9 in an amount of $5 \times 10^{-5}$ mol/m$^2$) |

TABLE 6

| Sample No. | Emulsions for layers 4–6 | Release of iodide ions | Compound added | |
|---|---|---|---|---|
| 308 (This invention) | Em-3, 8, 9, 12 | Controlled | III-I-57 | (added in layers 5 and 9 in an amount of $1 \times 10^{-5}$ mol/m$^2$) |
| 309 (This invention | Em-3, 8, 9, 13 | Controlled | III-I-57 | (added in layers 5 and 9 in an amount of $1 \times 10^{-5}$ mol/m$^2$) |
| 310 (This invention | Em-3, 8, 9, 11 | Controlled | III-I-57 | (added in layers 5 and 9 in an amount of $1 \times 10^{-5}$ mol/m$^2$) |
| | | | I-I-26 | (added in layers 4, 5 and 6 in an amount of $1 \times 10^{-5}$ mol/m2) |
| 311 (This invention | Em-3, 8, 9, 11 | Controlled | III-I-57 | (added in layers 5 and 9 in an amount of $3 \times 10^{-5}$ mol/m$^2$) |
| | | | III-I-51 | (added in layers 5 and 9 in an amount of $2 \times 10^{-5}$ mol/m$^2$) |
| | | | I-I-26 | (added in layers 4, 5 and 6 in an amount of $1 \times 10^{-5}$ mol/m$^2$) |
| | | | I-III-3 | (added in layers 4, 5 and 6 in an amount of $1 \times 10^{-5}$ mol/m$^2$) |

Samples 301 to 311 and Sample 201 were tested in the same way as in Example 2. The results of the test were as is shown in the following Table 7.

Samples 301 to 311 exhibited an ISO sensitivity of 110 when subjected to the first development for 6 minutes, and an ISO sensitivity of 400 when subjected to the first development for 11 minutes.

TABLE 7

| Sample No. | logE (R. G. B) – logE (R) | logE (A) – logE (B) |
|---|---|---|
| 201 | 0.06 | 0.05 |
| 301 | 0.28 | 0.23 |
| 302 | 0.31 | 0.09 |
| 303 | 0.24 | 0.08 |
| 304 | 0.21 | 0.07 |
| 305 | 0.26 | 0.11 |
| 306 | 0.25 | 0.08 |
| 307 | 0.38 | 0.06 |
| 308 | 0.39 | 0.07 |
| 309 | 0.37 | 0.06 |
| 310 | 0.42 | 0.08 |
| 311 | 0.44 | 0.09 |

As seen from Table 7, the samples which pertained to the present invention and which contained the compound represented by the formula (III-I) exhibited great interimage effect and small dependency on the changes in processing factors.

The physical properties of Emulsions A to I, which were used in each Example described above, are shown in the following Table 8. The sensitizing dyes added in the emulsions and the amounts in which they were used are shown in the following Table 9. Further, the substances used in the Exampels are indicated below.

TABLE 8

| Emulsion | Features of grains | Average equivalent-sphere diameter (μm) | Variation coefficient in terms of grain size distribution | AgI content (%) |
|---|---|---|---|---|
| A | Monodisperse cubic grains | 0.20 | 17 | 4.0 |
| B | Monodisperse tetradecahedral grains | 0.23 | 16 | 4.0 |
| C | Monodisperse cubic, internal latent-image type grains | 0.28 | 11 | 4.0 |
| D | Monodisperse cubic grains | 0.32 | 9 | 3.5 |
| E | Monodisperse tabular grains, average aspect ratio of 5.0 | 0.80 | 15 | 2.0 |
| F | Monodisperse cubic grains | 0.30 | 18 | 4.0 |
| G | Monodisperse tetradecahedral grains | 0.45 | 17 | 4.0 |
| H | Monodisperse tabular grains, average aspect ratio of 6.0 | 1.00 | 15 | 1.5 |
| I | Monodisperse tabular grains, average aspect ratio of 9.0 | 1.20 | 17 | 1.5 |

TABLE 9

Spectral Sensitization of Emulsions A to I

| Emulsion | Sensitizing dye added | Amount (g) added per mol of silver halide |
|---|---|---|
| A | S-4 | 0.5 |
| | S-5 | 0.1 |
| B | S-4 | 0.3 |
| | S-5 | 0.1 |
| C | S-4 | 0.25 |
| | S-5 | 0.08 |
| | S-9 | 0.05 |
| D | S-4 | 0.2 |
| | S-5 | 0.06 |
| | S-9 | 0.05 |
| E | S-4 | 0.3 |

TABLE 9-continued

Spectral Sensitization of Emulsions A to I

| Emulsion | Sensitizing dye added | Amount (g) added per mol of silver halide |
|---|---|---|
| | S-5 | 0.07 |
| | S-9 | 0.1 |
| F | S-6 | 0.05 |
| | S-7 | 0.2 |
| G | S-6 | 0.05 |
| | S-7 | 0.2 |
| H | S-6 | 0.04 |
| | S-7 | 0.15 |
| I | S-6 | 0.06 |
| | S-7 | 0.22 |

C-1

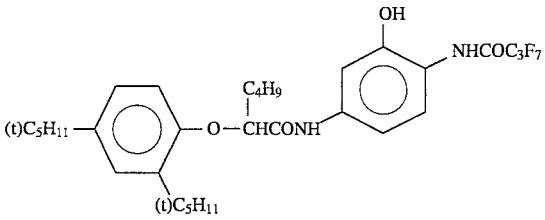

C-2

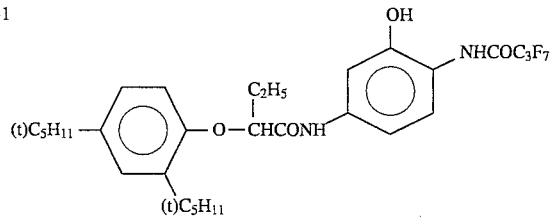

C-3

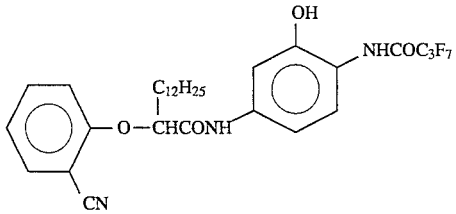

C-4

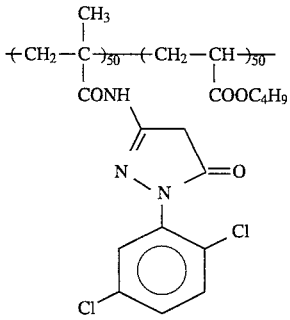

The numerals are % by weight
Average molecular weight: about 25,000

-continued
C-5
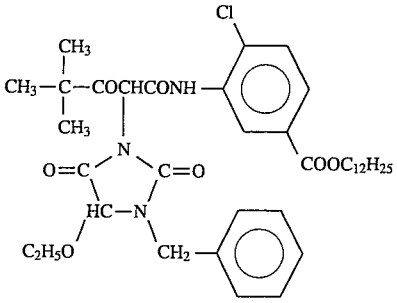
C-6
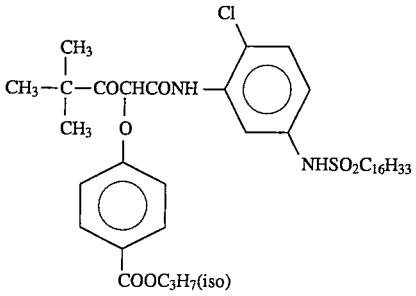
C-7
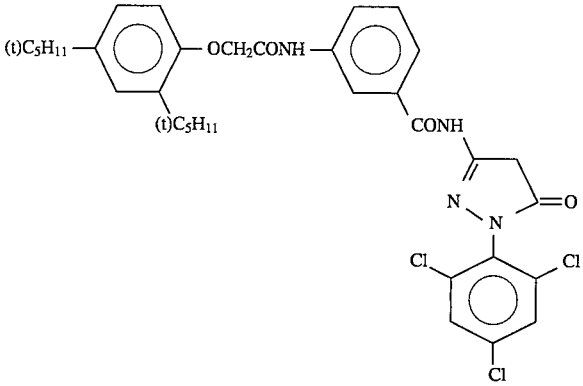
C-8
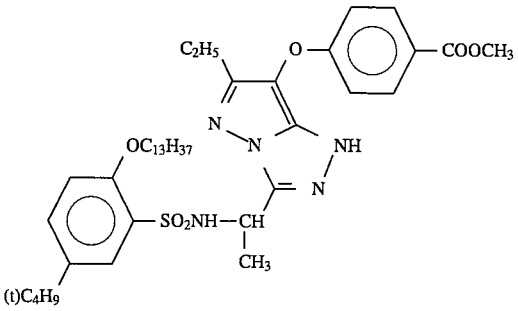
C-9
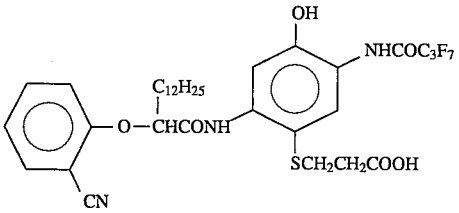
C-10
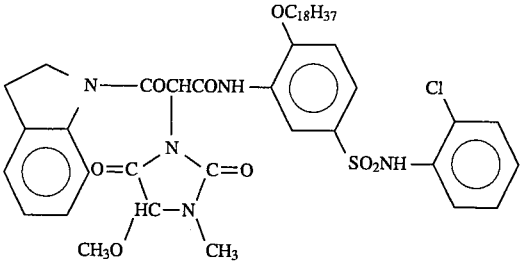
Dibutyl phthalate
Oil-1
Tricresyl phosphate
Oil-2
Oil-3
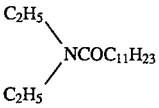
Cpd-A
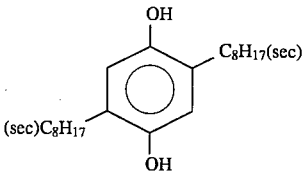
Cpd-B
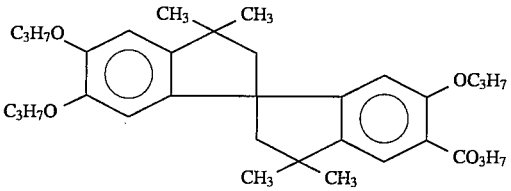

-continued
Cpd-C
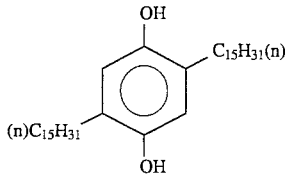
Cpd-D
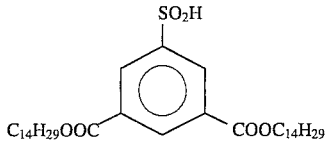
Cpd-E
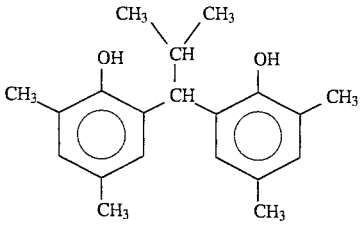
Cpd-F
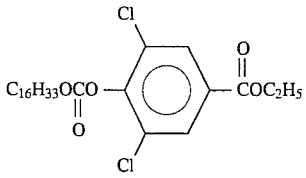
Cpd-H
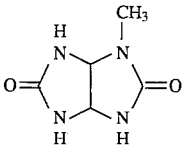
Cpd-I
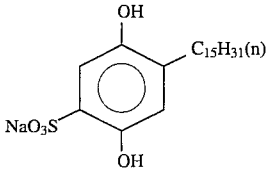
Cpd-K
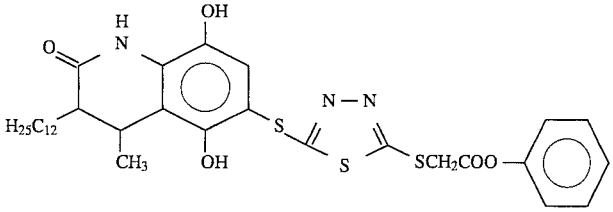
Cpd-L
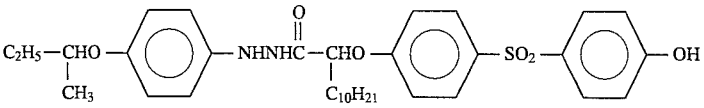
U-1
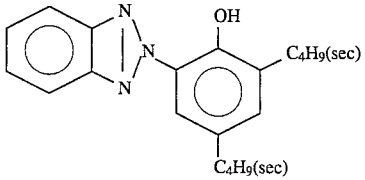
U-2
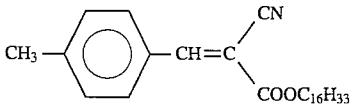
U-3
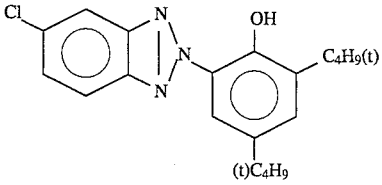
U-4
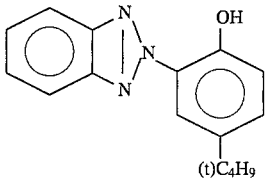
U-5
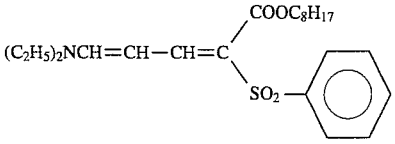
S-2
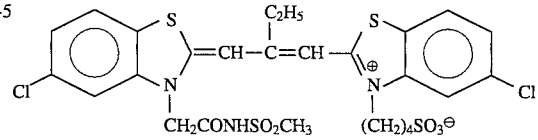

-continued
S-3
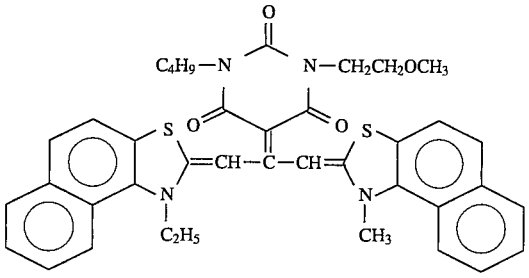
S-4
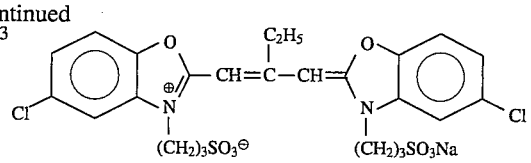
S-5
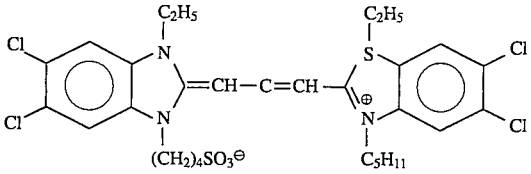
S-6
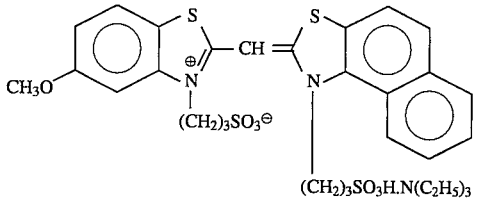
S-7
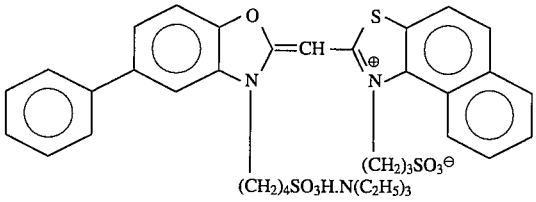
S-9
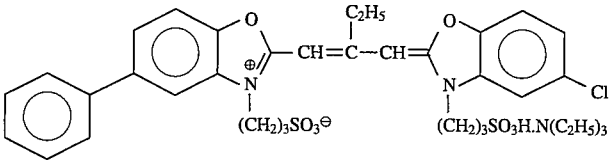
D-1
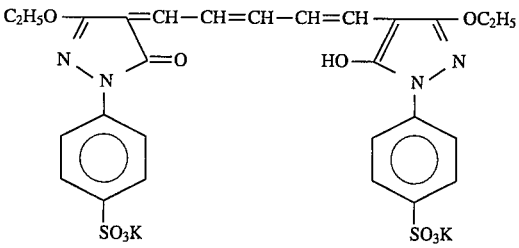
D-2
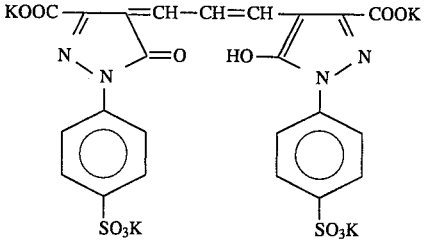
D-3
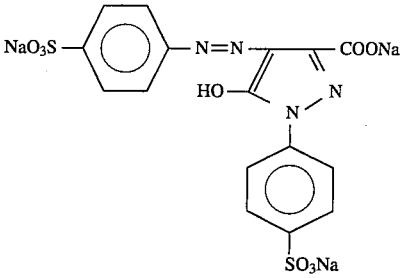
D-4
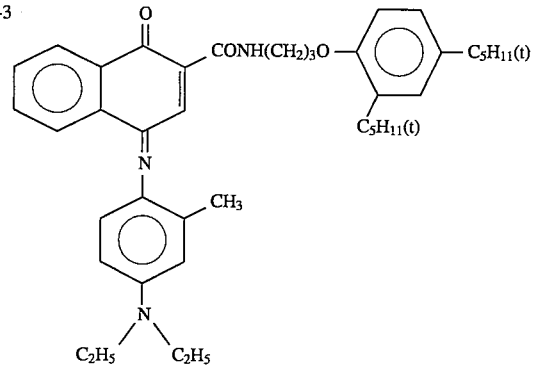

-continued

D-5

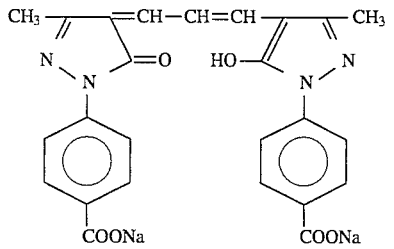

E-1

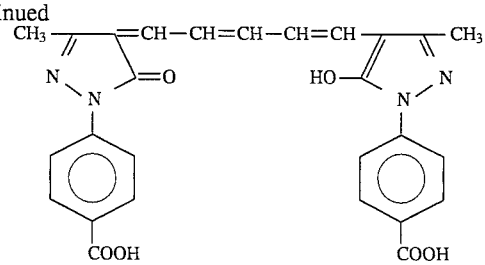

E-2

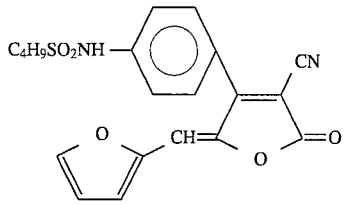

H-1

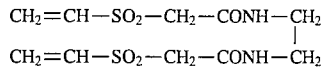

W-1

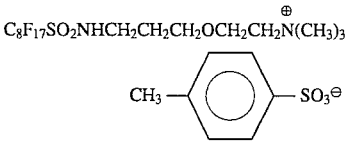

W-2

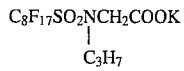

W-3

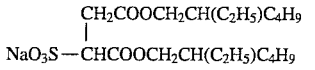

W-4

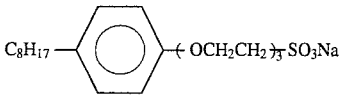

W-5

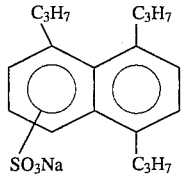

W-6

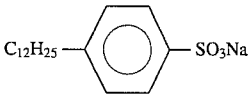

P-1

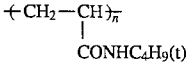

M-1

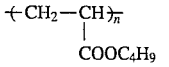

What is claimed is:

1. A silver halide color reversal photographic light-sensitive material comprising at least one blue-sensitive silver halide emulsion layer, at least one green-sensitive silver halide emulsion layer, and at least one red-sensitive silver halide emulsion layer, formed on a support, wherein at least one light sensitive emulsion layer contains silver halide grains having a silver halide phase formed in the presence of an iodide ion-releasing agent, under controlled release of iodide ions from the releasing agent, and further comprising at least one hydrophilic colloid layer which contains at least one compound selected from the group consisting of the compounds represented by one of the following formulas (I-I), (I-II) and (I-III), wherein the hydrophilic colloid layer may be the same as or different from at least one of the light sensitive layers, and wherein formulas (I-I), (I-II) and (I-III) are as follows: Formula (I-I)

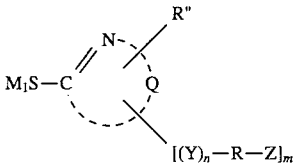

Formula (I-I)

where $M_1$ represents a hydrogen atom, a cation, or a protective group for the mercapto group, which is split off by an alkali; Q represents an atomic group required to form a 5- or 6-membered heterocyclic ring, together with —C=N—; R represents a straight-chain or branched-chain alkylene group, a straight-chain or branched-chain alkenylene group, a straight-chain or branched-chain aralkylene group, or an arylene group; Z represents a polar substitutent; Y represents a divalent group: R" represents a hydrogen atom or a substituent group; n represents 0 or 1; and m represents 0, 1 or 2;

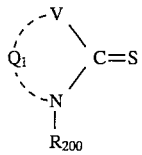

Formula (I-II)

where $R_{200}$ represents an alkyl, aralkyl, alkenyl, aryl or heterocyclic group; V represents O, S, Se, or $NR_{201}$ wherein $R_{201}$ represents an alkyl group, an aralkyl group, an alkenyl group, an aryl group, or a heterocyclic group, and may be the same as, or different from, $R_{200}$; $Q_1$ represents an atomic group required to form a 5- or 6-membered heterocyclic ring, together with V, C and N, and the heterocyclic ring may be further fused;

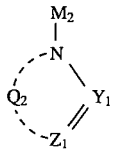

Formula (I-III)

where each of $Y_1$ and $Z_1$ independently represents methine group or a nitrogen atom; $Q_2$ represents an atomic group required to form a 5- or 6-membered heterocyclic ring, together with N, $Y_1$ and $Z_1$, and the heterocyclic ring may be further fused; and $M_2$ represents a hydrogen atom, or a cation.

2. The light-sensitive material according to claim 1, wherein said iodide ion-releasing agent is represented by the following formula (II-I):

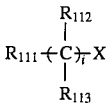

Formula (II-I)

where X represents an iodine atom; each of $R_{111}$, $R_{112}$ and $R_{113}$ are the same or different, represents a hydrogen atom or a substituent group, and may be combined together to form a carboxylic or heterocyclic ring; and i represents an integer of 1 to 5.

3. The light-sensitive material according to claim 1, wherein $R_{200}$ is unsubstituted.

4. The light-sensitive material according to claim 1, wherein both $Y_1$ and $Z_1$ are unsubstituted.

5. The light-sensitive material according to claim 1, wherein said at least one compound is represented by formula (I-I).

6. The light-sensitive material according to claim 1, wherein said at least one compound is represented by formula (I-II).

7. The light-sensitive material according to claim 1, wherein said at least one compound is represented by formula (I-III).

8. A silver halide color reversal photographic light-sensitive material comprising at least one blue-sensitive silver halide emulsion layer, at least one green-sensitive silver halide emulsion layer, and at least one red-sensitive silver halide emulsion layer, formed on a support, wherein at least one light sensitive emulsion layer contains silver halide grains having a silver halide phase formed in the presence of an iodide ion-releasing agent, under controlled release of iodide ions from the releasing agent, wherein said iodide ion-releasing agent is represented by the following formula (II-II):

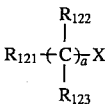

Formula (II-II)

where X represents an iodine atom; $R_{121}$ represents a hydrogen atom or an organic group having a Hammett's $\sigma p$ constant of 0 or less; each of $R_{122}$ and $R_{123}$ represents a hydrogen atom or a substituent group, and the groups $R_{121}$, $R_{122}$ and $R_{123}$ are the same or different and may link together to form a carbon ring or a heterocyclic ring; and a represents 1, 2 or 3; and further comprising at least one hydrophilic colloid layer which contains at least one compound selected from the group consisting of the compounds represented by one of the following formulas (I-I), (I-II) and (I-III), wherein the hydrophilic colloid layer may be the same as or different from at least one of the light sensitive layers, and wherein formulas (I-I), (I-II) and (I-III) are as follows:

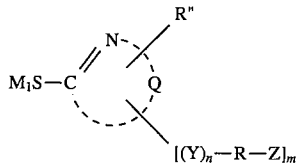

Formula (I-I)

where $M_1$ represents a hydrogen atom, a cation, or a protective group for the mercapto group, which is split off by an alkali; Q represents an atomic group required to form a 5- or 6-membered heterocyclic ring, together with —C=N—; R represents a straight-chain or branched-chain alkylene group, a straight-chain or branched-chain alkenylene group, a straight-chain or branched-chain aralkylene group, or an arylene group; Z represents a polar substituent; Y represents a divalent group; R" represents a hydrogen atom or a substituent group; n represents 0 or 1; and m represents 0, 1 or 2;

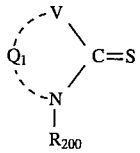

Formula (I-II)

where $R_{200}$ represents an alkyl, aralkyl, alkenyl, aryl or heterocyclic group; V represents O, S, Se, or $NR_{201}$ wherein $R_{201}$ represents an alkyl group, an aralkyl group, an alkenyl group, an aryl group, or a heterocyclic group, and may be the same as, or different from, $R_{200}$; $Q_1$ represents an atomic group required to form a 5- or 6-membered heterocyclic ring, together with V, C and N, and the heterocyclic ring may be further fused:

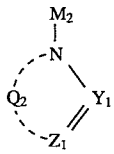

Formula (I-III)

where each of $Y_1$ and $Z_1$ independently represents methine group or a nitrogen atom; $Q_2$ represents an atomic group required to form a 5- or 6-membered heterocyclic ring, together with N, $Y_1$ and $Z_1$, and the heterocyclic ring may be further fused; and $M_2$ represents a hydrogen atom, or a cation.

9. The light-sensitive material according to claim 8, wherein $R_{200}$ is unsubstituted.

10. The light-sensitive material according to claim 8, wherein both $Y_1$ and $Z_1$ are unsubstituted.

11. The light-sensitive material according to claim 8, wherein said at least one compound is represented by formula (I-I).

12. The light-sensitive material according claim 8, wherein said at least one compound is represented by formula (I-II).

13. The light-sensitive material according to claim 8, wherein said at least one compound is represented by formula (I-III).

* * * * *